US007029506B2

(12) United States Patent
Jordan

(10) Patent No.: US 7,029,506 B2
(45) Date of Patent: Apr. 18, 2006

(54) ORGANIC CETANE IMPROVER

(76) Inventor: Frederick L. Jordan, 2051 La. C lina Dr., Santa Ana, CA (US) 92705

( * ) Notice: Subject to any disclaimer, the term of this patent is extended or adjusted under 35 U.S.C. 154(b) by 69 days.

(21) Appl. No.: 10/171,507

(22) Filed: Jun. 12, 2002

(65) Prior Publication Data

US 2003/0167679 A1 Sep. 11, 2003

Related U.S. Application Data

(63) Continuation-in-part of application No. 10/084,603, filed on Feb. 26, 2002, now abandoned, and a continuation-in-part of application No. 10/084,838, filed on Feb. 26, 2002, now Pat. No. 6,638,324, which is a continuation of application No. PCT/US01/40509, filed on Apr. 12, 2001.

(60) Provisional application No. 60/278,011, filed on Mar. 22, 2001, and provisional application No. 60/197,788, filed on Apr. 14, 2000.

(51) Int. Cl.
*C10L 1/02* (2006.01)
*C10L 1/22* (2006.01)

(52) U.S. Cl. ..... 44/307; 44/324

(58) Field of Classification Search ..... 44/307, 44/308, 324, 325

See application file for complete search history.

(56) References Cited

U.S. PATENT DOCUMENTS

| | | | | |
|---|---|---|---|---|
| 2,582,192 | A | 1/1952 | Denison | |
| 2,818,417 | A | 12/1957 | Brown et al. | |
| 3,018,247 | A | 1/1962 | Anderson et al. | |
| 3,438,757 | A | 4/1969 | Honnen et al. | |
| 3,524,909 | A | 8/1970 | Braus et al. | |
| 3,655,833 | A | 4/1972 | Eggenperger et al. | |
| 3,920,661 | A | 11/1975 | Ramey et al. | 260/270 |
| 3,941,745 | A | 3/1976 | Dexter et al. | 260/45.8 NT |
| 3,991,012 | A | 11/1976 | Ramey et al. | 260/45.75 N |
| 4,000,113 | A | 12/1976 | Stephen | 260/45.8 N |
| 4,007,157 | A | 2/1977 | Ramey et al. | 260/45.8 N |
| 4,051,102 | A | 9/1977 | Ramey et al. | 260/45.8 N |
| 4,077,941 | A | 3/1978 | Stephen et al. | 260/45.75 N |
| 4,081,475 | A | 3/1978 | Spivack | 560/55 |
| 4,089,842 | A | 5/1978 | Ramey et al. | 260/45.75 C |
| 4,093,586 | A | 6/1978 | Stephen | 260/45.8 N |
| 4,191,682 | A | 3/1980 | Ramey et al. | 260/45.8 N |
| 4,191,829 | A | 3/1980 | Ramey et al. | 546/222 |
| 4,207,229 | A | 6/1980 | Spivack | 260/45.8 NT |
| 4,208,190 | A | 6/1980 | Malec | |
| 4,231,759 | A | 11/1980 | Udelhofen et al. | 44/75 |
| 4,270,930 | A | 6/1981 | Campbell et al. | 44/71 |
| 4,274,835 | A | 6/1981 | Jordan | 44/1 SR |
| 4,504,499 | A | 3/1985 | Finnan | |
| 4,670,021 | A | 6/1987 | Nelson et al. | 44/66 |
| 4,734,519 | A | 3/1988 | Dunski et al. | 560/75 |
| 4,806,675 | A | 2/1989 | Dunski et al. | 560/75 |
| 5,024,775 | A | 6/1991 | Hanlon et al. | 252/52 R |
| 5,076,814 | A | 12/1991 | Hanlon et al. | 44/450 |
| 5,826,369 | A | 10/1998 | Jordan | 44/308 |
| 6,193,766 | B1 | 2/2001 | Jordan | 44/308 |

FOREIGN PATENT DOCUMENTS

EP 0457589 A1 11/1991

OTHER PUBLICATIONS

Chemfinder.com Lycopene;fact sheet (No date).*
Alpha–carotene; fact sheet (No date).*
"Oxidative Stability Index of Vegetable Oils in Binary Mixtures with Meadowfoam Oil," Terry, et al., United States Department of Agricultures Agricultural Research Service, 1997.

(Continued)

*Primary Examiner*—Cephia D. Toomer

(57) ABSTRACT

The present invention relates generally to a composition and method for increasing the amount of cetane in fuel. More specifically, it was discovered that the amount of cetane in fuel can be increased by mixing a fuel additive comprising β-carotene that was prepared in an inert atmosphere.

58 Claims, 23 Drawing Sheets

OTHER PUBLICATIONS

Scita. G. (1992) "Stability of β–Carotene under Different Laboratory Conditions". Methods in Enzymology, 213:175–185 Academic Press, Berkeley, CA.

Scita, G. (1992) "Stability of β–Carotene under Different Laboratory Conditions", J. Natr. Biochem. 3(3):124–8.

Papadapoulous, K and Ames, J. (1995) "Proposal fo a mechanism for the inhibition of all–trans–β–cartontene autoxidation at elevated temperature by N–(2–phenylethyl)–3,4–diphenylpyrrole", *Food Chemistry* 54:251–253.

Papadopoulou, K. and Ames, J. (1994) "Kinetics of all–trans–β–Carotene Degradation of Heating with and without Phenylalanine" *JAOCS* 71:893–896.

Papadopoulou, K. and Ames, J. (1994) "Thermal Degrdtion of All–Trans–β–Carotene in the Presence of Phenylalanine" *J Sci Food Agric* 65:373–379.

Hattori et al., (1995) "β–Lactoglobulin Protects β–Ionone Related Compounds from Degradation by Heating, Oxidation, and Irradiation." *Biosci. Biotech. Biochem.* 59(12):2295–2297.

Berset, C. and Marty, C. (1992) "Formation of Nonvilatile Compounds by Thermal Degradation of β–Carotene: Protection by Antioxidants." *Methods in Enzymology* 213:129–142.

Berset, C. and Marty, C. (1986) "Use of β–carotene in extrusion–cooking. control of extrusion product color during storage" *Ind. Aliment. Agric.* 103(6), 527–32 (Published in French).

Arya et al. (1979) "Stability of β–carotene in isolated systems" *J. Fd. Technol* 14:571–578.

Desobry et al. (1997) "Comparison of Spray–drying, Drum–drying and Freeze–drying for β–Carotene Encapsulation and Preservation" *Journal of Food Scince* 62:1158–1162.

Desorbry et al. (1999) "Influence of Maltodextrin Systems at an Equivalent 25DE on Encapsulated β–carotene Loss During Stroage" *Journal of Food Processing Preservation* 23:39–55.

Selim et al. (2000) Kinetic studies of degradation of saffron carotenoids encapsulated in amorphous polymer matrices. *Food Chemistry* 71:199–206.

Wagner, L.A. and Warthesen, J.J. (1995) "Stability of spray–dried Encapsulated Carrot Carotenes" *Journal of food Science* 60(5):1048–1053.

Desobry et al. (1998) "Preservation of β–carotene from Carrots" *Critical Reviews in Food Science and Nutrition* 38(5):381–396.

Jernas, B. (1981) "Study of the effect of some antioxidants on the stability of β–carotene in an ointment containing extracts from *Flos arnicae* and *Herba calendulae*" *Herba Pol.*27(1):39–43 Inst. Przem. Zielarskiego, Pozan, Pol. (Published in Polish)(Abstract).

Ochi et al. (1990) "Effects of tocopherols on deterioration of cookies blended with vegatables" *Nippon Shokuhin Kogyo Gakkaishi*. 37(1):39–44 Fac. Home Econ. Sci., Tokyo Kasei Univ., Tokyo, Japan (Published in Japanese)(Abstract).

Zhedek et al. (1970) "Tetrahydroquinone derivatives as feed antioxidants" *Sin. Issled. Eff. khim. Polim. Mater* 4:283–8 (Published in Russian)(Abstract).

Zhedek et al (1971) "Synthesis and inhibiting properties of 3,4–dihydrosantoquin" *Zh. Prikl. Khim.* (*Leningrad*) 44(11):2599–600 (Published in Russian) (Abstract).

Alekseev et al. (1972) "Inhibition of β–carotene oxidation in an aromatic solvent" *Izv. Akac. Nauk SSSR, Ser. Khim.* 2:312–16 (Published in Russian) (Abstract).

Alekseev et al. (1973) "Kinetics and mechanism of oxidation and stabilization of β–carotene" *Vitam. Vitam. Prep.* 232–40 (published in Russian) (Abstract).

Zhedek et al. (1971) "Efficient search for new antioxidants as stabilizers of carotene in dehydrated feeds" *Fiziol.–Biokhim. Osn. Povysh. Prod. Sel'skokhoz. Zhivotn.* 232–41 (Published in Russian)(Abstract).

International Search Report for PCT/US03/18620 mailed Sep. 2, 2003.

* cited by examiner

| Characteristic | |
|---|---|
| Total duration (sec) | 1180 |
| Total distance (km) | 11.007 |
| Max. speed (km/hr) | 120 |

ORGANIC CETANE IMPROVER

RELATED APPLICATIONS

This application is a continuation-in-part of U.S. application Ser. No. 10/084,603, filed Feb. 26, 2002, now abandoned which claims the benefit of U.S. Provisional Application No. 60/278,011, filed Mar. 22, 2001; and is a continuation-in-part of U.S. application Ser. No. 10/084,838, filed Feb. 26, 2002, now U.S. Pat. No. 6,638,324 which is a continuation, under 35 U.S.C. § 120, of copending International Patent Application No. PCT/US01/40509, filed on Apr. 12, 2001 under the Patent Cooperation Treaty (PCT), which was published by the International Bureau in English on Oct. 25, 2001, which designates the U.S. and claims the benefit of U.S. Provisional Application No. 60/197,788, filed Apr. 14, 2000.

FIELD OF THE INVENTION

The present invention relates generally to a composition and method for increasing the amount of cetane in fuel. More specifically, it was discovered that the amount of cetane in fuel can be increased by mixing a fuel additive comprising β-carotene that was prepared in an inert atmosphere.

BACKGROUND OF THE INVENTION

The interest in improving fuel efficiency has become paramount as our natural resources dwindle and the cost of fuel continues to rise. Fuel efficiency can be improved by adding a fuel additive. Several existing fuel additives are known to increase fuel efficiency, for example, U.S. Pat. Nos. 4,274,835, 5,826,369, and 6,193,766 describe fuel additives that improve combustion. Despite the successes of these inventions, there still remains a need for fuel additives that improve combustion.

Hydrocarbon fuels typically contain a complex mixture of hydrocarbons—molecules containing various configurations of hydrogen and carbon atoms. They may also contain various additives, including detergents, anti-icing agents, emulsifiers, corrosion inhibitors dyes, deposit modifiers, and non-hydrocarbons such as oxygenates.

When such hydrocarbon fuels are combusted, a variety of pollutants are generated. These combustion products include ozone, particulates, carbon monoxide, nitrogen dioxide, sulfur dioxide, and lead. Both the U.S. Environmental Protection Agency (EPA) and the California Air Resources Board (CARB) have adopted ambient air quality standards directed to these pollutants. Both agencies have also adopted specifications for lower-emission gasolines.

The Phase 2 California Reformulated Gasoline (CaRFG2) regulations became operative in Mar. 1, 1996. Governor Davis signed Executive Order D-5-99 on Mar. 25, 1999, which directs the phase-out of methyl tertiary butyl ether (MTBE) in California's gasoline by Dec. 31, 2002. The Phase 3 California Reformulated Gasoline (CaRFG3) regulations were approved on Aug. 3, 2000, and became operative on Sep. 2, 2000. The CaRFG2 and CaRFG3 standards are presented in Table 1.

TABLE 1

The California Reformulated Gasoline Phase 2 and Phase 3 Specifications

| | Flat Limits | | | Averaging Limits | | | Cap Limits | | |
|---|---|---|---|---|---|---|---|---|---|
| Property | CaRFG Phase 1 | CaRFG Phase 1 | CaRFG Phase 1 | CaRFG Phase 1 | CaRFG Phase 2 | CaRFG Phase 3 | CaRFG Phase 1 | CaRFG Phase 2 | CaRFG Phase 3 |
| Reid Vapor Pressure (psi) | n/a | 7.0 | 7.0 or 6.9 | 7.8 | n/a | n/a | n/a | 7.0 | 6.4–7.2 |
| Sulfur Content (wt. ppm) | n/a | 40 | 20 | 151 | 30 | 15 | n/a | 80 | 60<br>30 |
| Benzene Content (vol. %) | n/a | 1.0 | 0.8 | 1.7 | 0.8 | 0.7 | n/a | 1.2 | 1.1 |
| Aromatics Content (vol. %) | n/a | 25 | 25 | 32 | 22 | 22 | n/a | 30 | 35 |
| Olefins Content (vol. %) | n/a | 6.0 | 6.0 | 9.6 | 4.0 | 4.0 | n/a | 10.0 | 10.0 |
| T50 (° F.) | n/a | 210 | 213 | 212 | 200 | 203 | n/a | 220 | 220 |
| T90 (° F.) | n/a | 300 | 305 | 329 | 290 | 295 | n/a | 330 | 330 |
| Oxygen Content (wt. %) | n/a | 1.8–2.2 | 1.8–2.2 | n/a | n/a | n/a | n/a | 1.8–3.5<br>0–3.5 | 1.8–3.5<br>0–3.5 |
| MTBE and Other Oxygenates (other than ethanol) | n/a | n/a | Prohibited | n/a | n/a | n/a | n/a | n/a | Prohibited |

n/a = not applicable

Considerable effort has been expended by the major oil companies to formulate gasolines that comply with the EPA and CARB standards. The most common approach to formulating compliant gasolines involves adjusting refinery processes so as to produce a gasoline base fuel meeting the specifications set forth above. Such an approach suffers a number of drawbacks, including the high costs involved in reconfiguring a refinery process, possible negative effects on the quantity or quality of other refinery products, and the inflexibility associated with having to produce a compliant base gasoline.

SUMMARY OF THE INVENTION

Conventional refinery-based processes for producing gasolines that comply with the EPA and CARB standards suffer a number of drawbacks. A method of producing compliant gasolines that does not suffer these drawbacks is therefore desirable. A fuel additive is provided which may be combined with conventional noncompliant gasolines so as to yield a gasoline that complies with the EPA and CARB standards. Because an additive is used to produce compliant gasolines, the equipment and product costs associated with a refinery solution are avoided. The additive may also be combined with other hydrocarbon fuels, such as diesel fuels, jet fuels, two-cycle fuels, and coals, to reduce the emission of pollutants during combustion of the fuel.

In a first embodiment, a cetane improver is provided, the cetane improver including a non-oxygenated cetane improver such as a non-oxygenated carotene, a non-oxygenated carotenoid, a non-oxygenated precursor of a carotene, a non-oxygenated precursor of a carotenoid, a non-oxygenated derivative of a carotene, a non-oxygenated derivative of a carotenoid, and mixtures thereof.

In an aspect of the first embodiment, the cetane improver further includes a supplemental diluent. The supplemental diluent can include an alkyl nitrate. The alkyl nitrate can include 2-ethylhexyl nitrate.

In an aspect of the first embodiment, the cetane improver further includes a diluent. The diluent can include toluene.

In a second embodiment, a cetane improving additive is provided including a diluent and non-oxygenated cetane improver such as a non-oxygenated carotene, a non-oxygenated carotenoid, a non-oxygenated precursor of a carotene, a non-oxygenated precursor of a carotenoid, a non-oxygenated derivative of a carotene, a non-oxygenated derivative of a carotenoid, and mixtures thereof In an aspect of the second embodiment, the cetane improving additive further includes a supplemental cetane improver. The supplemental cetane improver can include an alkyl nitrate. The alkyl nitrate can include 2-ethylhexyl nitrate.

In an aspect of the second embodiment, the diluent includes toluene.

In a third embodiment, a diesel fuel is provided, the diesel fuel including a base fuel and a non-oxygenated cetane improver such as a non-oxygenated carotene, a non-oxygenated carotenoid, a non-oxygenated precursor of a carotene, a non-oxygenated precursor of a carotenoid, a non-oxygenated derivative of a carotene, a non-oxygenated derivative of a carotenoid, and mixtures thereof In an aspect of the third embodiment, the diesel fuel further includes a supplemental cetane improver. The supplemental cetane improver can include an alkyl nitrate. The alkyl nitrate can include 2-ethylhexyl nitrate.

In an aspect of the third embodiment, the diluent can include toluene.

In an aspect of the third embodiment, the diesel fuel includes from about 0.0001 g to about 0.03 g non-oxygenated cetane improver per 3785 ml of the diesel fuel, or from about 0.00025 g to about 0.025 g non-oxygenated cetane improver per 3785 ml of the diesel fuel, or from about 0.0005 g to about 0.02 g non-oxygenated cetane improver per 3785 ml of the diesel fuel, or from about 0.001 g to about 0.015 g non-oxygenated cetane improver per 3785 ml of the diesel fuel, or from about 0.002 g to about 0.01 g non-oxygenated cetane improver per 3785 ml of the diesel fuel.

In an aspect of the third embodiment, the diesel fuel includes from about from about 0.025 g to about 10 g alkyl nitrate per 3785 ml of the diesel fuel, or from about 0.075 g to about 7.5 g alkyl nitrate per 3785 ml of the diesel fuel, or from about 0.1 g to about 5 g alkyl nitrate per 3785 ml of the diesel fuel, or from about 1 g to about 4.0 g alkyl nitrate per 3785 ml of the diesel fuel.

In an aspect of the third embodiment, the diesel fuel includes No. 2 diesel fuel.

In a fourth embodiment, a method of increasing a cetane number of a fuel is provided, the method including dissolving a component in a diluent under an inert atmosphere to yield a cetane improver, the component selected from the group consisting of a carotene, a carotenoid, a precursor of a carotene, a precursor of a carotenoid, a derivative of a carotene, a derivative of a carotenoid, and mixtures thereof; and adding the cetane improver to a base fuel to yield an additized fuel, such that the cetane number of the additized fuel is higher than the cetane number of the base fuel.

In an aspect of the fourth embodiment, the base fuel includes diesel fuel.

In an aspect of the fourth embodiment, the base fuel includes No. 2 diesel fuel.

In an aspect of the fourth embodiment, the diluent includes toluene.

In an aspect of the fourth embodiment, the inert atmosphere includes nitrogen.

In an aspect of the fourth embodiment, the method further includes the step of mixing a supplemental cetane improving component with the cetane improver. The supplemental cetane improving component can include an alkyl nitrate. The alkyl nitrate can include 2-ethylhexyl nitrate.

In a fifth embodiment, a method for producing a diesel fuel is provided, the method including the steps of dissolving a component in a diluent under an inert atmosphere to yield a cetane improver, the component selected from the group consisting of a carotene, a carotenoid, a precursor of a carotene, a precursor of a carotenoid, a derivative of a carotene, a derivative of a carotenoid, and mixtures thereof; and adding the cetane improver to a diesel fuel.

In a sixth embodiment, a method for operating a vehicle equipped with a diesel fuel-powered engine is provided, the method including the step of combusting a diesel fuel in the engine, the diesel fuel comprising a base fuel and a non-oxygenated cetane improver, the non-oxygenated cetane improver selected from the group consisting of a non-oxygenated carotene, a non-oxygenated carotenoid, a non-oxygenated precursor of a carotene, a non-oxygenated precursor of a carotenoid, a non-oxygenated derivative of a carotene, a non-oxygenated derivative of a carotenoid, and mixtures thereof, wherein a cetane number of the diesel fuel is greater than a cetane number of the base fuel.

DETAILED DESCRIPTION OF THE PREFERRED EMBODIMENT

Introduction

Figure 1:
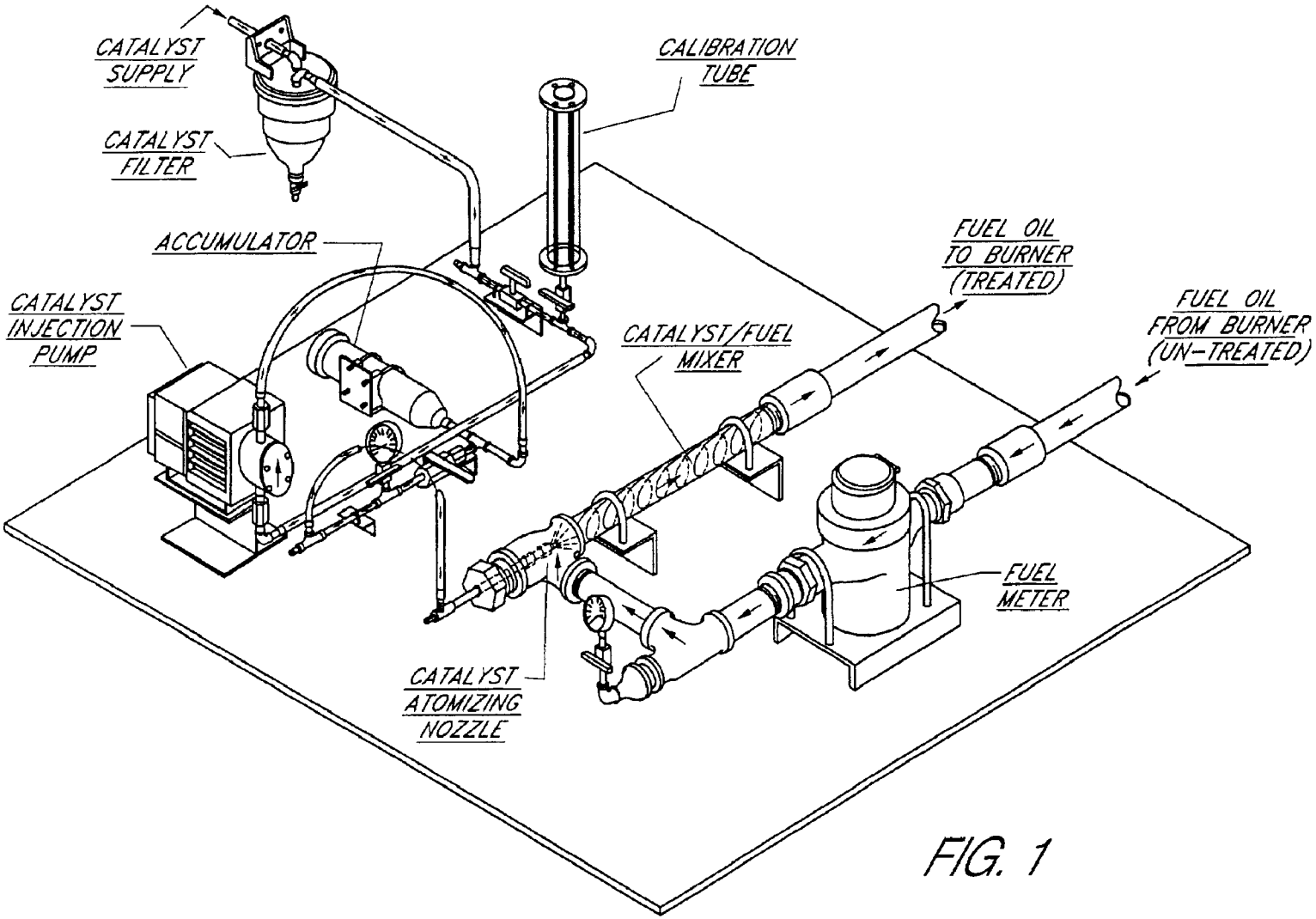
FIG. 1 illustrates a Metered Injection Pumping System for additizing resid fuels.

The following description and examples illustrate preferred embodiments of the present invention in detail. Those of skill in the art will recognize that there are numerous variations and modifications of this invention that are encompassed by its scope. Accordingly, the description of preferred embodiments should not be deemed to limit the scope of the present invention.

Emissions Reduction Additive Formulation

The emissions reduction additive formulation contains three components: an oil extract from vetch, β-carotene, and jojoba oil.

Oil Extract from Vetch

In a preferred embodiment, one of the components of the formulation is a plant oil extracted from, e.g., vetch, hops, barley, or alfalfa. The term "plant oil extract" as used herein, is a broad term and is used in its ordinary sense, including, without limitation, those components present in the plant material which are soluble in n-hexane. Chlorophyll may be used as a substitute for, or in addition to, all or a portion of the oil extract. The hydrophobic oil extract contains chlorophyll. Chlorophyll is the green pigment in plants that accomplishes photosynthesis, the process in which carbon dioxide and water combine to form glucose and oxygen. The hydrophobic oil extract typically also contains many other compounds, including, but not limited to, organometallics, antioxidants, oils, lipids thermal stabilizers or the starting materials for these types of products, and approximately 300 other compounds primarily consisting of low to high molecular weight antioxidants.

While the oil extract from vetch is preferred in many embodiments, in other embodiments it may be desirable to substitute, in whole or in part, another plant oil extract, including, but not limited to, alfalfa, hops oil extract, fescue oil extract, barley oil extract, green clover oil extract, wheat oil extract, extract of the green portions of grains, green food materials oil extract, green hedges or green leaves or green grass oil extract, any flowers containing green portions, the leafy or green portion of a plant of any member of the legume family, chlorophyll or chlorophyll containing extracts, or combinations or mixtures thereof. Suitable legumes include legume selected from the group consisting of lima bean, kidney bean, pinto bean, red bean, soy bean, great northern bean, lentil, navy bean, black turtle bean, pea, garbanzo bean, and black eye pea. Suitable grains include fescue, clover, wheat, oats, barley, rye, sorghum, fax, tritcale, rice, corn, spelt, millet, amaranth, buckwheat, quinoa, kamut, and teff.

Especially preferred plant oil extracts are those derived from plants that are members of the Fabaceae (Leguminosae) plant family, commonly referred to as the pulse family, and also as the pea or legume family. The Leguminosae family includes over 700 genera and 17,000 species, including shrubs, trees, and herbs. The family is divided into three subfamilies: divided into three subfamilies: Mimosoideae, which are mainly tropical trees and shrubs; Caesalpinioideae, which include tropical and subtropical shrubs; and Papilioniodeae which includes peas and beans. A common feature of most members of the Leguminosae family is the presence of root nodules containing nitrogen-fixing *Rhizobium* bacteria Many members of the Leguminosae family also accumulate high levels of vegetable oils in their seeds. The Leguminosae family includes the lead-plant, hog peanut, wild bean, Canadian milk vetch, indigo, soybean, pale vetchling, marsh vetchling, veiny pea, round-headed bush clover, perennial lupine, hop clover, alfalfa, white sweet clover, yellow sweet clover, white prairie-clover, purple prairie-clover, common locust, small wild bean, red clover, white clover, narrow-leaved vetch, hairy vetch, garden pea, chick pea, string green, kidney bean, mung bean, lima bean, broad bean, lentil, peanut or groundnut, and the cowpea, to name but a few.

The most preferred form of oil-extracted material consists of a material having a paste or mud-like consistency after extraction, namely, a solid or semi-solid, rather than a liquid, after extraction. Such pastes typically contain a higher concentration of Chlorophyll A to Chlorophyll B in the extract. The color of such a material is generally a deep black-green with a some degree of fluorescence throughout the material. Such a material can be recovered from many or all the plant sources enumerated for the Leguminosae family. While such a form is generally preferred for most embodiments, in certain other embodiments a liquid or some other form may be preferred.

The oil extract may be obtained using extraction methods well known to those of skill in the art. Solvent extraction methods are generally preferred. Any suitable extraction solvent may be used which is capable of separating the oil and oil-soluble fractions from the plant material. Nonpolar extraction solvents are generally preferred. The solvent may include a single solvent, or a mixture of two or more solvents. Suitable solvents include, but are not limited to, cyclic, straight chain, and branched-chain alkanes containing from about 5 or fewer to 12 or more carbon atoms. Specific examples of acyclic alkane extractants include: pentane, hexane, heptane, octane, nonane, decane, mixed hexanes, mixed heptanes, mixed octanes, isooctane, and the like. Examples of the cycloalkane extractants include cyclopentane, cyclohexane, cycloheptane, cyclooctane, methylcyclohexane, and the like. Alkenes such as hexenes, heptenes, octenes, nonenes, and decenes are also suitable for use, as are aromatic hydrocarbons such as benzene, toluene, and xylene. Halogenated hydrocarbons such as chlorobenzene, dichlorobenzene, trichlorobenzene, methylene chloride, chloroform, carbon tetrachloride, perchloroethylene, trichloroethylene, trichloroethane, and trichlorotrifluoroethane may also be used. Generally preferred solvents are C6 to C12 alkanes, particularly n-hexane.

Hexane extraction is the most commonly used technique for extracting oil from seeds. It is a highly efficient extraction method that extracts virtually all oil-soluble fractions in the plant material. In a typical hexane extraction, the plant material is comminuted. Grasses and leafy plants may be chopped into small pieces. Seed are typically ground or flaked. The plant material is typically exposed to hexane at an elevated temperature. The hexane, a highly flammable, colorless, volatile solvent that dissolves out the oil, typically leaves only a few weight percent of the oil in the residual plant material. The oil/solvent mixture may be heated to 212° F. the temperature at which hexane flashes off, and is then distilled to remove all traces of hexane. Alternatively, hexane may be removed by evaporation at reduced pressure. The resulting oil extract is suitable for use in the formulations of preferred embodiments.

Plant oils extracts for use in edible items or cosmetics typically undergo additional processing steps to remove impurities that may affect the appearance, shelf life, taste, and the like, to yield a refined oil. These impurities include may include phospholipids, mucilaginous gums, free fatty acids, color pigments and fine plant particles. Different methods are used to remove these by-products including water precipitation or precipitation with aqueous solutions of organic acids. Color compounds are typically removed by bleaching, wherein the oil is typically passed through an adsorbent such as diatomaceous clay. Deodorization may also be conducted, which typically involves the use of steam distillation. Such additional processing steps are generally unnecessary. However, oils subjected to such treatments may be suitable for use in the formulations of preferred embodiments.

Other preferred extraction processes include, but are not limited to, supercritical fluid extraction, typically with carbon dioxide. Other gases, such as helium, argon, xenon, and nitrogen may also be suitable for use as solvents in supercritical fluid extraction methods.

Any other suitable method may be used to obtain the desired oil extract fractions, including, but not limited to, mechanical pressing. Mechanical pressing, also known as expeller pressing, removes oil through the use of continuously driven screws that crush the seed or other oil-bearing material into a pulp from which the oil is expressed. Friction created in the process can generate temperatures between about 50° C. and 90° C., or external heat may be applied. Cold pressing generally refers to mechanical pressing conducted at a temperature of 40° C. or less with no external heat applied.

The yield of oil extract that may be obtained from a plant material may depend upon any number of factors, but primarily upon the oil content of the plant material. For example, a typical oil content of vetch (hexane extraction, dry basis) is approximately 4 to 5 wt. %, while that for barley is approximately 6 to 7.5 wt. %, and that for alfalfa is approximately 2 to 4.2 wt. %.

β-Carotene

The β-Carotene is another component of the formulations of preferred embodiments. The β-carotene may be added to the base formulation as a separate component, or may be present or naturally occurring in one of the other base components, such as, for example, one of the components of the oil extract from vetch. β-Carotene is a high molecular weight antioxidant. In plants, it functions as a scavenger of oxygen radicals and protects chlorophyll from oxidation. While not wishing to be limited to any particular mechanism, it is believed that the β-carotene in the formulations of preferred embodiments may scavenge oxygen radicals in the combustion process or may act as an oxygen solubilizer or oxygen getter for the available oxygen that is present in the air/fuel stream for combustion.

The β-carotene may be natural or synthetic. In a preferred embodiment, the β-carotene is provided in a form equivalent to vitamin A having a purity of 1.6 million units of vitamin A activity. Vitamin A of lesser purity may also be suitable for use, provided that the amount used is adjusted to yield an equivalent activity. For example, if the purity is 800,000 units of vitamin A activity, the amount used is doubled to yield the desired activity.

While β-carotene is preferred in many embodiments, in other embodiments it may be desirable to substitute, in whole or in part, another component for β-carotene, including, but not limited to, α-carotene, or additional carotenoids from algae xeaxabthin, crypotoxanthin, lycopene, lutein, broccoli concentrate, spinach concentrate, tomato concentrate, kale concentrate, cabbage concentrate, brussels sprouts concentrate and phospholipids, green tea extract, milk thistle extract, curcumin extract, quercetin, bromelain, cranberry and cranberry powder extract, pineapple extract, pineapple leaves extract, rosemary extract, grapeseed extract, ginkgo biloba extract, polyphenols, flavonoids, ginger root extract, hawthorn berry extract, bilberry extract, butylated hydroxytoluene (BHT), oil extract of marigolds, any and all oil extracts of carrots, fruits, vegetables, flowers, grasses, natural grains, leaves from trees, leaves from hedges, hay, any living plant or tree, and combinations or mixtures thereof.

Vegetable carotenoids of guaranteed potency are particularly preferred, including those containing lycopene, lutein, α-carotene, other carotenoids from carrots or algae, betatene, and natural carrot extract. While the vegetable carotenoids are particularly preferred as substitutes for β-carotene or in combination with β-carotene, other substances with antioxidant properties may also be suitable for use in the formulations of preferred embodiments, either as substitutes for β-carotene or additional components, including phenolic antioxidants, amine antioxidants, sulfurized phenolic compounds, organic phosphites, and the like, as enumerated elsewhere in this application. Preferably, the antioxidant is oil soluble. If the antioxidant is insoluble or only sparingly soluble in aqueous solution, it may be desirable to use a surfactant to improve its solubility.

Jojoba Oil

In a preferred embodiment, one of the components of the formulation is jojoba oil. It is a liquid that has antioxidant characteristics and is capable of withstanding very high temperatures without losing its antioxidant abilities. Jojoba oil is a liquid wax ester mixture extracted from ground or crushed seeds from shrubs native to Arizona, California and northern Mexico. The source of jojoba oil is the Simmondsia chinensis shrub, commonly called the jojoba plant. It is a woody evergreen shrub with thick, leathery, bluish-green leaves and dark brown, nutlike fruit. Jojoba oil may be extracted from the fruit by conventional pressing or solvent extraction methods. The oil is clear and golden in color. Jojoba oil is composed almost completely of wax esters of monounsaturated, straight-chain acids and alcohols with high molecular weights (C16–C26). Jojoba oil is typically defined as a liquid wax ester with the generic formula RCOOR", wherein RCO represents oleic acid (C18), eicosanoic acid (C20) and/or erucic acid (C22), and wherein —OR" represents eicosenyl alcohol (C20), docosenyl alcohol (C22) and/or tetrasenyl alcohol (C24) moieties. Pure esters or mixed esters having the formula RCOOR", wherein R is a C20–C22 alk(en)yl group and wherein R" is a C20–C22 alk(en)yl group, may be suitable substitutes, in part or in whole, for jojoba oil. Acids and alcohols including monounsaturated straight-chain alkenyl groups are most preferred.

While the jojoba oil is preferred in many embodiments, in other embodiments it may be desirable to substitute, in whole or in part, another component, including, but not limited to, oils that are known for their thermal stability, such as, peanut oil, cottonseed oil, rape seed oil, macadamia oil, avocado oil, palm oil, palm kernel oil, castor oil, all other vegetable and nut oils, all animal oils including mammal oils (e.g., whale oils) and fish oils, and combinations and mixtures thereof. In preferred embodiments, the oil may be alkoxylated, for example, methoxylated or ethoxylated. Alkoxylation is preferably conducted on medium chain oils, such as castor oil, macadamia nut oil, cottonseed oil, and the like. Alkoxylation may offer benefits in that it may permit coupling of oil/water mixtures in a fuel, resulting in a potential reduction in nitrogen oxides and/or particulate matter emissions upon combustion of the fuel.

In preferred embodiments, these other oils are substituted for jojoba oil on a 1:1 volume ratio basis, in either a partial substitution or complete substitution. In other embodiments it may be preferred to substitute the other oil for jojoba oil at a volume ration greater than or less than a 1:1 volume ratio. In a preferred embodiment, cottonseed oil, either purified or merely extracted or crushed from cottonseed, squalene, or squalane are substituted on a 1:1 volume ratio basis for a portion or an entire volume of jojoba oil.

While not wishing to be limited to any particular mechanism, it is believed that the jojoba oil acts to prevent or retard pre-oxidation of the oil extract and/or β-carotene components of the formulation prior to combustion by imparting thermal stability to the formulation. Jojoba oil generally reduces cetane in fuels, so in formulations wherein a higher cetane number is preferred, it is generally preferred to reduce the content of jojoba oil in the formulation.

Although jojoba oil is preferred for used in many of the formulations of the preferred embodiments, in certain formulations it may be preferred to substitute one or more different thermal stabilizers for jojoba oil, either in whole or in part. Suitable thermal stabilizers as known in the art include liquid mixtures of alkyl phenols, including 2-tert-butylphenol, 2,6-di-tert-butylphenol, 2-tert-butyl-4-n-butylphenol, 2,4,6-tri-tert-butylphenol, and 2,6-di-tert-butyl-4-n-butylphenol which are suited for use as stabilizers for middle distillate fuels (U.S. Pat. Nos. 5,076,814 and 5,024,775 to Hanlon, et al.). Other commercially available hindered phenolic antioxidants that also exhibit a thermal stability effect include 2,6-di-t-butyl-4-methylphenol; 2,6-di-t-butylphenol; 2,2'-methylene-bis(6-t-butyl-4-methylphenol); n-octadecyl 3-(3,5-di-t-butyl-4-hydroxyphenyl) propionate; 1,1,3-tris(3-t-butyl-6-methyl-4-hydroxyphenyl) butane; pentaerythrityl tetrakis[3-(3,5-di-t-butyl-4-hydroxyphenyl) propionate]; di-n-octadecyl(3,5-di-t-butyl-4hydroxybenzyl)phosphonate; 2,4,6-tris(3,5-di-t-butyl-4-hydroxybenzyl) mesitylene; and tris(3,5-di-t-butyl-4-hydroxybenzyl)isocyanurate (U.S. Pat. Nos. 4,007,157, 3,920,661).

Other thermal stabilizers include: pentaerythritol co-esters derived from pentaerythritol, (3-alkyl-4-hydroxyphenyl)-alkanoic acids and alkylthioalkanoic acids or lower alkyl esters of such acids which are useful as stabilizers of organic material normally susceptible to oxidative and/or thermal deterioration. (U.S. Pat. Nos. 4,806,675 and 4,734,519 to Dunski, et al.); the reaction product of malonic acid, dodecyl aldehyde and tallowamine (U.S. Pat. No. 4,670,021 to Nelson, et al.); hindered phenyl phosphites (U.S. Pat. No. 4,207,229 to Spivack); hindered piperidine carboxylic acids and metal salts thereof (U.S. Pat. Nos. 4,191,829 and 4,191,682 to Ramey, et al.); acylated derivatives of 2,6-dihydroxy-9-azabicyclo[3.3.1]nonane (U.S. Pat. No. 4,000,113 to Stephen); bicyclic hindered amines (U.S. Pat. No. 3,991,012 to Ramey, et al.); sulfur containing derivatives of dialkyl-4-hydroxyphenyltriazine (U.S. Pat. No. 3,941,745 to Dexter, et al.); bicyclic hindered amino acids and metal salts thereof (U.S. Pat. No. 4,051,102 to Ramey , et al.); trialkylsubstituted hydroxybenzyl malonates (U.S. Pat. No. 4,081,475 to Spivack); hindered piperidine carboxylic acids and metal salts thereof (U.S. Pat. Nos. 4,089,842 to Ramey, et al.); pyrrolidine dicarboxylic acids and esters (U.S. Pat. No. 4,093,586 to Stephen); metal salts of N,N-disubstituted β-alanines (U.S. Pat. No. 4,077,941 to Stephen , et al.); hydrocarbyl thioalkylene phosphites (U.S. Pat. No. 3,524,909); hydroxybenzyl thioalkylene phosphites (U.S. Pat. No. 3,655,833); and the like.

Certain compounds are capable of performing as both antioxidants and as thermal stabilizers. Therefore, in certain embodiments it may be preferred to prepare formulations containing a hydrophobic plant oil extract in combination with a single compound that provides both a thermal stability and antioxidant effect, rather than two different compounds, one providing thermal stability and the other antioxidant activity. Examples of compounds known in the art as providing some degree of both oxidation resistance and thermal stability include diphenylamines, dinaphthylamines, and phenylnaphthylamines, either substituted or unsubstituted, e.g., N,N'-diphenylphenylenediamine, p-octyldiphenylamine, p,p-dioctyldiphenylamine, N-phenyl-1-naphthylamine, N-phenyl-2-naphthylamine, N-(p-dodecyl)phenyl-2-naphthylamine, di-1-naphthylamine, and di-2naphthylamine; phenothazines such as N-alkylphenothiazines; imino(bisbenzyl); and hindered phenols such as 6-(t-butyl)phenol, 2,6-di-(t-butyl)phenol, 4-methyl-2,6-di-(t-butyl) phenol, 4,4'-methylenebis(-2,6-di-(t-butyl)phenol), and the like.

Certain lubricating fluid base stocks are known in the art to exhibit high thermal stability. Such base stocks may be capable of imparting thermal stability to the formulations of preferred embodiments, and as such may be substituted, in part or in whole, for jojoba oil. Suitable base stocks include polyalphaolefins, dibasic acid esters, polyol esters, alkylated aromatics, polyalkylene glycols, and phosphate esters.

Polyalphaolefins are hydrocarbon polymers that contain no sulfur, phosphorus, or metals. Polyalphaolefins have good thermal stability, but are typically used in conjunction with a suitable antioxidant. Dibasic acid esters also exhibit good thermal stability, but are usually also used in combination with additives for resistance to hydrolysis and oxidation.

Polyol esters include molecules containing two or more alcohol moieties, such as trimethylolpropane, neopentylglycol, and pentaerythritol esters. Synthetic polyol esters are the reaction product of a fatty acid derived from either animal or plant sources and a synthetic polyol. Polyol esters have excellent thermal stability and may resist hydrolysis and oxidation better than other base stocks. Naturally occurring triglycerides or vegetable oils are in the same chemical family as polyol esters. However, polyol esters tend to be more resistant to oxidation than such oils. The oxidation instabilities normally associated with vegetable oils are generally due to a high content of linoleic and linolenic fatty acids. Moreover, the degree of unsaturation (or double bonds) in the fatty acids in vegetable oils correlates with sensitivity to oxidation, with a greater number of double bonds resulting in a material more sensitive to and prone to rapid oxidation.

Trimethylolpropane esters may include mono, di, and tri esters. Neopentyl glycol esters may include mono and di esters. Pentaerythritol esters include mono, di, tri, and tetra esters. Dipentaerythritol esters may include up to six ester moieties. Preferred esters are typically of those of long chain monobasic fatty acids. Esters of C20 or higher acids are preferred, e.g., gondoic acid, eicosadienoic acid, eicosatrienoic acid, eicosatetraenoic acid, eicosapentanoic acid, arachidic acid, arachidonic acid, behenic acid, erucic acid, docosapentanoic acid, docosahexanoic acid, or ligniceric acid. However in certain embodiments, esters of C18 or lower acids may be preferred, e.g., butyric acid, caproic acid, caprylic acid, capric acid, lauric acid, myristoleic acid, myristic acid, pentadecanoic acid, palmitic acid, palmitoleic acid, hexadecadienoic acid, hexadecatienoic acid, hexadecatetraenoic acid, margaric acid, margroleic acid, stearic acid, linoleic acid, octadecatetraenoic acid, vaccenic acid, or linolenic acid. In certain embodiments, it may be preferred to esterify the pentaerythritol with a mixture of different acids.

Alkylated aromatics are formed by the reaction of olefins or alkyl halides with aromatic compounds, such as benzene. Thermal stability is similar to that of polyalphaolefins, and additives are typically used to provide oxidative stability. Polyalkylene glycols are polymers of alkylene oxides exhibiting good thermal stability, but are typically used in combination with additives to provide oxidation resistance. Phosphate esters are synthesized from phosphorus oxychloride and alcohols or phenols and also exhibit good thermal stability.

In certain embodiments, it may be preferred to prepare formulations containing jojoba oil in combination with other vegetable oils. For example, it has been reported that crude meadowfoam oil resists oxidative destruction nearly 18 times longer than the most common vegetable oil, namely, soybean oil. Meadowfoam oil may be added in small amounts to other oils, such as triolein oil, jojoba oil, and castor oil, to improve their oxidative stability. Crude meadowfoam oil stability could not be attributed to common antioxidants. One possible explanation for the oxidative stability of meadowfoam oil may be its unusual fatty acid composition. The main fatty acid from meadowfoam oil is 5-eicosenoic acid, which was found to be nearly 5 times more stable to oxidation than the most common fatty acid, oleic acid, and 16 times more stable than other monounsaturated fatty acids. See "Oxidative Stability Index of Vegetable Oils in Binary Mixtures with Meadowfoam Oil," Terry, et al., United States Department of Agriculture, Agricultural Research Service, 1997.

Ratios of Components and Concentrations in Additized Fuel

In preferred embodiments, the three components of the base formulation are present specified ratios. In determining the ratios of the components, factors taken into consideration may include elevation, base fuel purity, type of fuel (e.g., gasoline, diesel, residual fuel, two-cycle fuel, and the like), sulfur content, mercaptan content, olefin content, aromatic content and the engine or device using the fuel (e.g., gasoline powered engine, diesel engine, two-cycle engine, stationary boiler). For example, if a gasoline or diesel fuel is of a lower grade, such as one that has a high sulfur content (1 wt. % or more), a high olefin content (12 ppm or higher), or a high aromatics content (35 wt. % or higher) in gasoline or diesel, the ratios may be adjusted to compensate by providing additional oil extract and β-carotene (or other antioxidant).

In additive formulations and additized liquid or solid hydrocarbon fuels of preferred embodiments, the ratio of grams of oil extract of vetch to grams of β-carotene in the additive is generally from about 50:1 to about 1:0.05; typically from about 24:1 to about 1:0.1; preferably from about 22:1, 20:1, 15:1, 10:1 to about 1:0.2, 1:0.3, 1:0.4, 1:0.5, 1:0.6, 1:0.7, 1:0.8, or 1:0.9; and more preferably from about 9:1, 8:1, 7.5:1, 7:1, 6.5:1, 6:1, 5.5:1, 5:1, 4.5:1, 4:1, 3.5:1, 3:1, 2.5:1, 2:1, to about 1:1, 1:1.1, 1:1.2, 1:1.3, 1:1.4, 1:15, 1:1.6, 1:1.7, 1:1.8,or 1:1.9. The ratio of grams of oil extract of vetch to milliliters jojoba oil in the additive is generally from about 12:1 to about 1:0.05; typically from about 6:1 to about 1:0.2, 1:0.3, 1:0.4, 1:0.5, 1:0.6, 1:0.7, 1:0.8, or 1:0.9; and more preferably from about 5.5:1, 5:1, 4.5:1, 4:1, 3.5:1, 3:1, 2.5:1, 2:1, to about 1:1, 1:1.1, 1:1.2, 1:1.3, 1:1.4, 1:1.5, 1:1.6, 1:1.7, 1:1.8, or 1:1.9. The ratio of milliliters jojoba oil to grams of β-carotene in the additive is generally from about 12:1 to about 1:0.5; typically from about 6:1 to about 1:0.6, 1:0.7, 1:0.8, or 1:0.9; and more preferably from about 5.5:1, 5:1, 4.5:1, 4:1, 3.5:1, 3:1, 2.5:1, 2:1, to about 1:1, 1:1.1, 1:1.2, 1:1.3, 1:1.4, 1:1.5, 1:1.6, 1:1.7, 1:1.8, or 1:1.9.

It is generally preferred that the ratios of each component approach approximately 1:1:1, namely, that a balance point between the raw materials in the formulation is reached, however the total treat rate may be adjusted up or down depending upon various factors as described above.

Different ratios of the components of the additive formulation may be preferred for preparing additized gasoline for different regions or altitudes. When the gasoline is for use in the United States at altitudes below 762 meters, the ratio of grams of oil extract of vetch to grams of β-carotene in the additive is preferably from about 24.2:1; the ratio of grams of oil extract of vetch to milliliters jojoba oil in the additive is preferably from about 4:1; and the ratio of milliliters jojoba oil to grams of β-carotene is preferably from about 6:1.

When the gasoline is for use in the United States at altitudes from 762 meters to 1524 meters, the ratio of grams of oil extract of vetch to grams of β-carotene in the additive is preferably from about 7.3:1; the ratio of grams of oil extract of vetch to milliliters jojoba oil in the additive is preferably from about 2.9:1; and the ratio of milliliters jojoba oil to grams of β-carotene is preferably from about 2.5:1.

When the gasoline is for use in the United States at altitudes above 1524 meters, the ratio of grams of oil extract of vetch to grams of β-carotene in the additive is preferably from about 21.8:1; the ratio of grams of oil extract of vetch to milliliters jojoba oil in the additive is preferably from about 4:1; and the ratio of milliliters jojoba oil to grams of β-carotene is preferably from about 5.5:1.

When the gasoline is for use in the Mexico at altitudes below 762 meters, the ratio of grams of oil extract of vetch to grams of β-carotene in the additive is preferably from about 4.8:1; the ratio of grams of oil extract of vetch to milliliters jojoba oil in the additive is preferably from about 2.4:1; and the ratio of milliliters jojoba oil to grams of β-carotene is preferably from about 2:1.

When the gasoline is for use in the Mexico at altitudes from 762 meters to 1524 meters, the ratio of grams of oil extract of vetch to grams of β-carotene in the additive is preferably from about 1.2:1; the ratio of grams of oil extract of vetch to milliliters jojoba oil in the additive is preferably from about 1.0:1; and the ratio of milliliters jojoba oil to grams of β-carotene is preferably from about 1.3:1.

When the gasoline is for use in the Mexico at altitudes above 1524 meters, the ratio of grams of oil extract of vetch to grams of β-carotene in the additive is preferably from about 3.5:1; the ratio of grams of oil extract of vetch to milliliters jojoba oil in the additive is preferably from about 2:1; and the ratio of milliliters jojoba oil to grams of β-carotene is preferably from about 1.7:1.

Different ratios of the components of the additive formulation may also be preferred for different regions and altitudes when the additized fuel is diesel fuel. When the diesel fuel is for use in the United States at altitudes below 762 meters, the ratio of grams of oil extract of vetch to grams of β-carotene in the additive is preferably from about 8.1:1; the ratio of grams of oil extract of vetch to milliliters jojoba oil in the additive is preferably from about 3:1; and the ratio of milliliters jojoba oil to grams of β-carotene is preferably from about 2.7:1.

When the diesel fuel is for use in the United States at altitudes from 762 meters to 1524 meters, the ratio of grams of oil extract of vetch to grams of β-carotene in the additive is preferably from about 6.1:1; the ratio of grams of oil extract of vetch to milliliters jojoba oil in the additive is preferably from about 2.7:1; and the ratio of milliliters jojoba oil to grams of β-carotene is preferably from about 2.3:1.

When the diesel fuel is for use in the United States at altitudes above 1524 meters, the ratio of grams of oil extract of vetch to grams of β-carotene in the additive is preferably from about 4.8:1; the ratio of grams of oil extract of vetch to milliliters jojoba oil in the additive is preferably from about 2.4:1; and the ratio of milliliters jojoba oil to grams of β-carotene is preferably from about 2:1. Alternatively, the ratios may be adjusted down to lower values, namely, a ratio of grams of oil extract of vetch to grams of β-carotene in the additive of about 3.5:1; a ratio of grams of oil extract of vetch to milliliters jojoba oil in the additive of about 2:1; and a ratio of milliliters jojoba oil to grams of β-carotene of about 1.7:1.

When the diesel fuel is for use in the Mexico at altitudes below 762 meters, the ratio of grams of oil extract of vetch to grams of β-carotene in the additive is preferably from about 4.8:1; the ratio of grams of oil extract of vetch to milliliters jojoba oil in the additive is preferably from about 2.4:1; and the ratio of milliliters jojoba oil to grams of β-carotene is preferably from about 2:1.

When the diesel fuel is for use in the Mexico at altitudes from 762 meters to 1524 meters, the ratio of grams of oil extract of vetch to grams of β-carotene in the additive is preferably from about 6.1:1; the ratio of grams of oil extract of vetch to milliliters jojoba oil in the additive is preferably from about 1.7:1; and the ratio of milliliters jojoba oil to grams of β-carotene is preferably from about 2.3:1.

When the diesel fuel is for use in the Mexico at altitudes above 1524 meters, the ratio of grams of oil extract of vetch to grams of β-carotene in the additive is preferably from about 4:1; the ratio of grams of oil extract of vetch to milliliters jojoba oil in the additive is preferably from about 2.2:1; and the ratio of milliliters jojoba oil to grams of β-carotene is preferably from about 1.8:1.

When the additive formulation is to be used in resid fuels, e.g., in the United States, Mexico, or other regions of the world, the ratio of grams of oil extract of vetch to grams of β-carotene in the additive is preferably from about 1:0.6; the ratio of grams of oil extract of vetch to milliliters jojoba oil in the additive is preferably from about 1:0.6; and the ratio of milliliters jojoba oil to grams of β-carotene is preferably from about 1:1. It is generally preferred to use a greater proportion of jojoba oil and β-carotene and a smaller proportion of oil extract of vetch present in resid formulations than is preferred in gasoline and diesel fuel formulations. This is because resid fuels are generally combusted at a higher air to fuel ratio, generally resulting in higher combustion temperatures.

The additive formulation may also be used to prepare two-cycle fuels with reduced emissions. In two-cycle fuels, a reduced proportion of oil extract of vetch compared to jojoba oil and β-carotene is generally preferred. As a general trend, the lower the proportion of oil extract of vetch, the lower the smoke levels observed for the fuel. Alternatively, the concentration of the opacity from a two-cycle engine is reduced as the amount of β-carotene is increased. The relative smoke levels observed for selected ratios are as follows (oil extract of vetch:β-carotene/oil extract of vetch-:jojoba oil/jojoba oil:β-carotene): 2.1/1.5/1.4>6.0/2.7/2.2>1.0/0.8/1.2>0.510.511.1>0.3/0.3/1.1>0.1/0.1/1.0. It is generally observed that vetch extract, alfalfa extract, cottonseed oil, and chlorophyll reduce nitrogen oxides in two-cycle fuels.

When the hydrocarbon fuel to be additized is coal, either in solid form or as a suspension in water or another liquid, the ratio of grams of oil extract of vetch to grams of β-carotene in the additive is preferably about 5:4; the ratio of grams of oil extract of vetch to milliliters jojoba oil in the additive is preferably about 2.5:1; and the ratio of milliliters jojoba oil to grams of β-carotene is preferably about 1:2.

Other Additives

The additive packages and formulated fuels compositions of preferred embodiments may contain additives other than the ones described above. These additives may include, but are not limited to, one or more octane improvers, detergents, antioxidants, demulsifiers, corrosion inhibitors and/or metal deactivators, diluents, cold flow improvers, thermal stabilizers, and the like, as described below.

Octane Improvers—Compounds of this type are useful for providing combined benefits to gasoline-based fuels. These compounds have the ability of effectively raising the octane quality of the fuel. In addition, these compounds effectively reduce undesirable tailpipe emissions from the engine. A class of suitable octane improvers includes the cyclopentadienyl manganese tricarbonyl compounds. Preferred are the cyclopentadienyl manganese tricarbonyls that are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, and the like. Preparation of such compounds is described in the literature, for example, U.S. Pat. No. 2,818,417.

Cetane Improvers—If the fuel composition is a diesel fuel, it may preferably contain a cetane improver or ignition accelerator. The ignition accelerator is. preferably an organic nitrate different from and in addition to the nitrate or nitrate source described above. Preferred organic nitrates are substituted or unsubstituted alkyl or cycloalkyl nitrates having up to about 10 carbon atoms, preferably from 2 to 10 carbon atoms. The alkyl group may be either linear or branched. Specific examples of nitrate compounds suitable for use in preferred embodiments include, but are not limited to the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, 2-ethylhexyl nitrate, n-heptyl nitrate, sec-heptyl nitrate, n-octyl nitrate, sec-octyl nitrate, n-nonyl nitrate, n-decyl nitrate, n-dodecyl nitrate, cyclopentylnitrate, cyclohexylnitrate, methylcyclohexyl nitrate, isopropylcyclohexyl nitrate, and the esters of alkoxy substituted aliphatic alcohols, such as 1-methoxypropyl-2-nitrate, 1-ethoxpropyl-2 nitrate, 1-isopropoxy-butyl nitrate, 1-ethoxylbutyl nitrate and the like. Preferred alkyl nitrates are ethyl nitrate, propyl nitrate, amyl nitrates, and hexyl nitrates. Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates include n-hexyl nitrate, 2-ethylhexyl nitrate, 4-methyl-n-pentyl nitrate, and the like. Preparation of the nitrate esters may be accomplished by any of the commonly used methods: such as, for example, esterification of the appropriate alcohol, or reaction of a suitable alkyl halide with silver nitrate. Another additive suitable for use in improving cetane and/or reducing particulate emissions is di-t-butyl peroxide.

Ignition Accelerators—Conventional ignition accelerators may also be used in the preferred embodiments, such as hydrogen peroxide, benzoyl peroxide, di-tert-butyl peroxide, and the like. Moreover, certain inorganic and organic chlorides and bromides, such as, for example, aluminum chloride, ethyl chloride or bromide may find use in the preferred embodiments as primers when used in combination with the other ignition accelerators.

Detergent Additives—Carburetor deposits may form in the throttle body and plate, idle air circuit, and in the metering orifices and jets. These deposits are a combination of contaminants from dust and engine exhaust, held together by gums formed from unsaturated hydrocarbons in the fuel. They can alter the air/fuel ratio, cause rough idling, increased fuel consumption, and increased exhaust emissions. Carburetor detergents can prevent deposits from forming and remove deposits already formed. Detergents used for this application are amines in the 20–60 ppm dosage range.

Fuel injectors are very sensitive to deposits that can reduce fuel flow and alter the injector spray pattern. These deposits can make vehicles difficult to start, cause severe driveability problems, and increase fuel consumption and exhaust emissions. Fuel injector deposits are formed at higher temperatures than carburetor deposits and arc therefore more difficult to deal with. The amines used for carburetor deposits are somewhat effective but are typically used at roughly the 100 ppm dosage level. At this level, the amine detergent can actually cause the formation of inlet manifold and valve deposits. Polymeric dispersants with higher thermal stability than the amine detergents have been used to overcome this problem. These are used at dosages in the range of 20 to 600 ppm. These same additives are also effective for inlet manifold and valve deposit control. Inlet manifold and valve deposits have the same effect on driveability, fuel consumption, and exhaust emissions as carburetor and engine deposits. The effect of detergent and dispersant additives on engines with existing deposits may require several tanks of gasoline, especially if the additives are used at a low dosage rate.

Combustion chamber deposits can cause an increase in the octane number requirement for vehicles as they accumulate miles. These deposits accumulate in the end-gas zone and injection port area. They are thermal insulators and so can become very hot during engine operation. The metallic surfaces conduct heat away and remain relatively cool. The hot deposits can cause pre-ignition and misfire leading to the need for a higher-octane fuel. Polyetheramine and other proprietary additives are known to reduce the magnitude of combustion chamber deposits. Reduction in the amount of combustion chamber deposits has been shown to reduce $NO_x$ emissions.

Any of a number of different types of suitable gasoline detergent additives can be included in both diesel and gasoline fuel compositions of various embodiments. These detergents include succinimide detergent/dispersants, long-chain aliphatic polyamines, long-chain Mannich bases, and carbamate detergents. Desirable succinimide detergent/dispersants for use in gasolines are prepared by a process that includes reacting an ethylene polyamine such as diethylene triamine or triethylene tetramine with at least one acyclic hydrocarbyl substituted succinic acylating agent. The substituent of such acylating agent is characterized by containing an average of about 50 to about 100 (preferably about 50 to about 90 and more preferably about 64 to about 80) carbon atoms. Additionally, the acylating agent has an acid number in the range of about 0.7 to about 1.3 (for example, in the range of 0.9 to 1.3, or in the range of 0.7 to 1.1), more preferably in the range of 0.8 to 1.0 or in the range of 1.0 to 1.2, and most preferably about 0.9. The detergent/dispersant contains in its molecular structure in chemically combined form an average of from about 1.5 to about 2.2 (preferably from 1.7 to 1.9 or from 1.9 to 2.1, more preferably from 1.8 to 2.0, and most preferably about 1.8) moles of the acylating agent per mole of the polyamine. The polyamine can be a pure compound or a technical grade of ethylene polyamines that typically are composed of linear, branched and cyclic species.

The acyclic hydrocarbyl substituent of the detergent/dispersant is preferably an alkyl or alkenyl group having the requisite number of carbon atoms as specified above. Alkenyl substituents derived from poly-olefin homopolymers or copolymers, of appropriate molecular weight (for example, propene homopolymers, butene homopolymers, $C_3$ and $C_4$ olefin copolymers, and the like) are suitable. Most preferably, the substituent is a polyisobutenyl group formed from polyisobutene having a number average molecular weight (as determined by gel permeation chromatography) in the range of 700 to 1200, preferably 900 to 1100, most preferably 940 to 1000. The established manufacturers of such polymeric materials are able to adequately identify the number average molecular weights of their own polymeric materials. Thus in the usual case the nominal number average molecular weight given by the manufacturer of the material can be relied upon with considerable confidence.

Acyclic hydrocarbyl-substituted succinic acid acylating agents and methods for their preparation and use in the formation of succinimide are well known to those skilled in the art and are extensively reported in the literature. See, for example, U.S. Pat. No. 3,018,247.

Use of fuel-soluble long chain aliphatic polyamines as induction cleanliness additives in distillate fuels is described, for example, in U.S. Pat. No. 3,438,757.

Use in gasoline of fuel-soluble Mannich base additives formed from a long chain alkyl phenol, formaldehyde (or a formaldehyde precursor thereof), and a polyamine to control induction system deposit formation in internal combustion engines is described, for example, in U.S. Pat. No. 4,231,759.

Carbamate fuel detergents are compositions which contain polyether and amine groups joined by a carbamate linkage. Typical compounds of this type are described in U.S. Pat. No. 4,270,930. A preferred material of this type is commercially available from Chevron Oronite Company LLC of Houston, Tex. as OGA-480™ additive.

Driveability Additives—These include anti-knock, anti-run-on, anti-pre-ignition, and anti-misfire additives that directly effect the combustion process. Anti-knock additives include lead alkyls that are no longer used in the United States. These and other metallic anti-knock additives are typically used at dosages of roughly 0.2 g metal/liter of fuel (or about 0.1 wt % or 1000 ppm). A typical octane number enhancement at this dosage level is 3 units for both Research Octane Number (RON) and Motor Octane Number (MON). A number of organic compounds are also known to have anti-knock activity. These include aromatic amines, alcohols, and ethers that can be employed at dosages in the 1000 ppm range. These additives work by transferring hydrogen to quench reactive radicals. Oxygenates such as methanol and MTBE also increase octane number but these are used at such high dosages that they are not really additives but blend components. Pre-ignition is generally caused by the presence of combustion chamber deposits and is treated using combustion chamber detergents and by raising octane number.

Antiwear Agents—The gasoline and diesel fuel compositions of various embodiments advantageously contain one or more antiwear agents. Preferred antiwear agents include long chain primary amines incorporating an alkyl or alkenyl radical having 8 to 50 carbon atoms. The amine to be employed may be a single amine or may consist of mixtures of such amines. Examples of long chain primary amines which can be used in the preferred embodiments are 2-ethylhexyl amine, n-octyl amine, n-decyl amine, dodecyl amine, oleyl amine, linolylamine, stearyl amine, eicosyl amine, triacontyl amine, pentacontyl amine and the like. A particularly effective amine is oleyl amine obtainable from Akzo Nobel Surface Chemistry LLC of Chicago, Ill. under the name ARMEEN® O or ARMEEN® OD. Other suitable amines which are generally mixtures of aliphatic amines include ARMEEN® T and ARMEEN® TD, the distilled form of ARMEEN® T which contains a mixture of 0–2% of tetradecyl amine, 24% to 30% of hexadecyl amine, 25% to 28% of octadecyl amine and 45% to 46% of octadecenyl amine. ARMEEN® T and ARMEEN® TD are derived from tallow fatty acids. Lauryl amine is also suitable, as is ARMEEN® 12D obtainable from the supplier indicated above. This product is about 0–2% of decylamine, 90% to 95% dodecylamine, 0–3% of tetradecylamine and 0–1% of octadecenylamine. Amines of the types indicated to be useful are well known in the art and may be prepared from fatty acids by converting the acid or mixture of acids to its ammonium soap, converting the soap to the corresponding amide by means of heat, further converting the amide to the corresponding nitrile and hydrogenating the nitrile to produce the amine. In addition to the various amines described, the mixture of amines derived from soya fatty acids also falls within the class of amines above described and is suitable for use according to this invention. It is noted that all of the amines described above as being useful are straight chain, aliphatic primary amines. Those amines having 16 to 18 carbon atoms per molecule and being saturated or unsaturated are particularly preferred.

Other preferred antiwear agents include dimerized unsaturated fatty acids, preferably dimers of a comparatively long chain fatty acid, for example one containing from 8 to 30 carbon atoms, and may be pure, or substantially pure, dimers. Alternatively, and preferably, the material sold commercially and known as "dimer acid" may be used. This latter material is prepared by dimerizing unsaturated fatty acid and consists of a mixture of monomer, dimer and trimer of the acid. A particularly preferred dimer acid is the dimer of linoleic acid.

Antioxidants—Various compounds known for use as oxidation inhibitors can be utilized in fuel formulations of various embodiments. These include phenolic antioxidants, amine antioxidants, sulfurized phenolic compounds, and organic phosphites,. among others. For best results, the antioxidant includes predominately or entirely either (1) a hindered phenol antioxidant such as 2,6-di-tert-butylphenol, 4-methyl-2,6-di-tert-butylphenol, 2,4-dimethyl-6-tert-butylphenol, 4,4'-methylenebis(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred are combinations of tertiary butyl phenols, such as 2,6-di-tert-butylphenol, 2,4,6-tri-tert-butylphenol and o-tert-butylphenol. Also useful are N,N'-di-lower-alkyl phenylenediamines, such as N,N'-di-sec-butyl-p-phenylenediamine, and its analogs, as well as combinations of such phenylenediamines and such tertiary butyl phenols.

Demulsifiers—Demulsifiers are molecules that aid the separation of oil from water usually at very low concentrations. They prevent formation of a water and oil mixture. A wide variety of demulsifiers are available for use in the fuel formulations of various embodiments, including, for example, organic sulfonates, polyoxyalkylene glycols, oxyalkylated phenolic resins, and like materials. Particularly preferred are mixtures of alkylaryl sulfonates, polyoxyalkylene glycols and oxyalkylated alkylphenolic resins, such as are available commercially from Baker Petrolite Corporation of Sugar Land, Tex. under the TOLAD® trademark. Other known demulsifiers can also be used.

Corrosion Inhibitors—A variety of corrosion inhibitors are available for use in the fuel formulations of various embodiments. Use can be made of dimer and trimer acids, such as are produced from tall oil fatty acids, oleic acid, linoleic acid, or the like. Products of this type are currently available from various commercial sources, such as, for example, the dimer and trimer acids sold under the EMPOL® trademark by Cognis Corporation of Cincinnati, Ohio. Other useful types of corrosion inhibitors are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols.

Also useful are the aminosuccinic acids or derivatives. Preferably a dialkyl ester of an aminosuccinic acid is used containing an alkyl group containing 15–20 carbon atoms or an acyl group which is derived from a saturated or unsaturated carboxylic acid containing 2–10 carbon atoms. Most preferred is a dialkylester of an aminosuccinic acid.

Metal Deactivators—If desired, the fuel compositions may contain a conventional type of metal deactivator of the type having the ability to form complexes with heavy metals such as copper and the like. Typically, the metal deactivators used are gasoline soluble N,N'-disalicylidene-1,2-alkanediamines or N,N'-disalicylidene-1,2-cycloalkanediamines, or mixtures thereof. Examples include N,N'-disalicylidene-1,2-ethanediamine, N,N'-disalicylidene-1,2-propanediamine, N,N'-disalicylidene-1,2-cyclohexanediamine, and N,N"-disalicylidene-N'-methyl-dipropylene-triamine.

The various additives that can be included in the diesel and gasoline compositions of this invention are used in conventional amounts. The amounts used in any particular case are sufficient to provide the desired functional property to the fuel composition, and such amounts are well known to those skilled in the art.

Thermal Stabilizers—Thermal stabilizers such as Octel Starreon high temperature fuel oil stabilizer FOA-81™ for gasoline, jet, and diesel fuel, or other such additives may also be added to the fuel formulation.

Carrier fluids—Substances suitable for use as carrier fluids include, but are not limited to, mineral oils, vegetable oils, animal oils, and synthetic oils. Suitable mineral oils may be primarily paraffinic, naphthenic, or aromatic in composition. Animal oils include tallow and lard. Vegetable oils may include, but are not limited to, rapeseed oil, soybean oil, peanut oil, corn oil, sunflower oil, cottonseed oil, coconut oil, olive oil, wheat germ oil, flaxseed oil, almond oil, safflower oil, castor oil, and the like. Synthetic oils may include, but are not limited to, alkyl benzenes, polybutylenes, polyisobutylenes, polyalphaolefins, polyol esters, monoesters, diesters (adipates, sebacates, dodecanedioates, phthalates, dimerates), and triesters.

Solvents—Solvents suitable for use in conjunction with the formulations of preferred embodiments are miscible and compatible with one or more components of the formulation. Preferred solvents include the aromatic solvents, such as benzene, toluene, o-xylene, m-xylene, p-xylene, and the like, as well as nonpolar solvents such as cyclohexanes, hexanes, heptanes, octanes, nonanes, and the like. Suitable solvents may also include the fuel to be additized, e.g., gasoline, Diesel 1, Diesel 2, and the like. Depending upon the material to be solvated, other liquids may also be suitable for use as solvents, such as oxygenates, carrier fluids, or even additives as enumerated herein.

Oxygenates—Oxygenates are added to gasoline to improve octane number and to reduce emissions of CO. These include various alcohols and ethers that are typically blended with gasoline to produce an oxygen content of up to about 10 volume percent. The CO emissions benefit appears to be a function of fuel oxygen level and not of oxygenate chemical structure. Because oxygenates have a lower heating value than gasoline, volumetric fuel economy (miles per gallon) is lower for fuels containing these components. However, at typical blend levels the effect is so small that only very precise measurements can detect it. Oxygenates are not known to effect emissions of $NO_x$ or hydrocarbon.

In certain embodiments, it may be preferred to add one or more oxygenates to the fuel. Oxygenates are hydrocarbons that contain one or more oxygen atoms. The primary oxygenates are alcohols and ethers, including: methanol, fuel ethanol, methyl tertiary butyl ether (MTBE), ethyl tertiary butyl ether (ETBE), and tertiary amyl methyl ether (TAME).

Additive Concentrates

The emission control/fuel economy additive package can be added to the base fuel directly. Alternatively, the additive formulation may be provided in the form of an additive package that may be used to prepare an additized fuel. Optionally, various additives described above may also be present in the concentrate.

Additive Effects on Emissions and Fuel Economy

Gasoline additives can clearly have an effect on emissions and fuel economy at dosages as low as 20 to 60 ppm. Additives that remove existing fuel system or combustion chamber deposits have an increasing effect over time and, upon removal of the additive from the fuel, performance should slowly deteriorate back to the baseline level. Driveability additives have an immediate effect and are used at roughly 1000 ppm. The effect of oxygenates is also immediate but blend levels are much higher than for the other additive classes.

Base Fuels

Gasolines

The gasolines utilized in the practice of various embodiments can be traditional blends or mixtures of hydrocarbons in the gasoline boiling range, or they can contain oxygenated blending components such as alcohols and/or ethers having suitable boiling temperatures and appropriate fuel solubility, such as methanol, ethanol, methyl tert-butyl ether (MTBE), ethyl tert-butyl ether (ETBE), tert-amyl methyl ether (TAME), and mixed oxygen-containing products formed by "oxygenating" gasolines and/or olefinic hydrocarbons falling in the gasoline boiling range. Thus various embodiments involve the use of gasolines, including the so-called reformulated gasolines which are designed to satisfy various governmental regulations concerning composition of the base fuel itself, components used in the fuel, performance criteria, toxicological considerations and/or environmental considerations. The amounts of oxygenated components, detergents, antioxidants, demulsifiers, and the like that are used in the fuels can thus be varied to satisfy any applicable government regulations.

Aviation gasoline is especially for aviation piston engines, with an octane number suited to the engine, a freezing point of −60° C., and a distillation range usually within the limits of 30° C. and 180° C.

Gasolines suitable for used in preferred embodiments also include those used to fuel two-cycle (2T) engines. In two-cycle engines, lubrication oil is added to the combustion chamber and admixed with gasoline. Combustion results in emissions of unburned fuel and black smoke. Certain two-cycle engines may be so inefficient that 2 hours of running such an engine under load may produce the same amount of pollution as a gasoline-powered car equipped with a typical emission control system that is driven 130,000 miles. In a typical two-cycle engine vehicle, 25 to 30% of the fuel leaves the tailpipe unburned. In California alone there are approximately 500,000 two-cycle engines, which produce the equivalent of the emissions of 4,000,000 million gasoline powered cars. In Malaysia and throughout much of Asia, China and India the problem is much more severe. Malaysia has 4,000,000 two-cycle engines, which produce pollution equivalent to that from 32,000,000 automobiles.

Diesel Fuels

The diesel fuels utilized in the preferred embodiments include that portion of crude oil that distills out within the temperature range of approximately 150° C. to 370° C. (698° F.), which is higher than the boiling range of gasoline. Diesel fuel is ignited in an internal combustion engine cylinder by the heat of air under high compression—in contrast to motor gasoline, which is ignited by an electrical spark. Because of the mode of ignition, a high cetane number is required in a good diesel fuel. Diesel fuel is close in boiling range and composition to the lighter heating oils. There are two grades of diesel fuel, established by the ASTM: Diesel 1 and Diesel 2. Diesel 1 is a kerosene-type fuel, lighter, more volatile, and cleaner burning than Diesel 2, and is used in engine applications where there are frequent changes in speed and load: Diesel 2 is used in industrial and heavy mobile service.

Suitable diesel fuels may include both high and low sulfur fuels. Low sulfur fuels generally include those containing 500 ppm (on a weight basis) or less sulfur, and may contain as little as 100, 95, 90, 85, 80, 75, 70, 65, 60, 55, 50, 45, 40, 35, 30, 25, 20, 15, 20, or 5 ppm or less sulfur, or even 0 ppm sulfur, for example, in the case of synthetic diesel fuels. High sulfur diesel fuels typically include those containing more than 500 ppm sulfur, for example, as much as 1, 2, 3, 4, or 5 wt. % sulfur or more.

Fuels that boil in a range of 150° C. to 330° C. work best in diesel engines because they are completely consumed during combustion, with no waste of fuel or excess emissions. Paraffins, which offer the best cetane rating, are preferred for diesel blending. The higher the paraffin content of a fuel, the more easily it burns, providing quicker warm-ups and complete combustion. Heavier crude components that boil at higher ranges, although less desirable, may also be used. Naphthenes are the next lightest components and aromatics are the heaviest fractions found in diesel. Using these heavier components helps minimize diesel fuel waxiness. At low temperatures, paraffins tend to solidify, plugging fuel filters.

In addition to Diesel 1 and Diesel 2 fuels, other fuels capable of combusting in a diesel engine may also be used as base fuels in various embodiments. Such fuels may include, but are not limited to, those based on coal dust emulsions and vegetable oil. The vegetable oil based diesel fuels are commercially available and are marketed under the name "bio-diesel." They contain a blend of methyl esters of fatty acids of vegetable origin and are often used as an additive to conventional diesel fuels.

Fuel Oils

Fuel oils are complex and variable mixtures of alkanes and alkenes, cycloalkanes and aromatic hydrocarbons, containing low percentages of sulfur, nitrogen, and oxygen compounds. Kerosene fuel oils are manufactured from straight-run petroleum distillates from the boiling range of kerosene. Other distillate fuel oils contain straight-run middle distillate, often blended with straight-run gas oil, light vacuum distillates, and light cracked distillates. The main components of residual fuel oils are the heavy residues from distillation and cracking operations. Fuel oils are used mainly in industrial and domestic heating, as well as in the production of steam and electricity in power plants.

Gas oils are obtained from the lowest fraction from atmospheric distillation of crude oil, while heavy gas oils are obtained by vacuum redistillation of the residual from atmospheric distillation. Gas oil distills between 180° C. and 380° C. and is available in several grades, including diesel oil for diesel compression ignition, light heating oil, and other gas oil including heavy gas oils which distill between 380° C. and 540° C. Heavy fuel oil residual is made up of distillation residue.

In certain applications, an emulsion of the fuel oil in water may be combusted. The additive formulations of preferred embodiments may be used to reduce the emissions produced from burning such fuels.

Residual fuels are typically pre-heated to 116° C. (240° F.) prior to combustion. This elevated temperature converts the fuel from a solid to a more liquid state and reduces the viscosity. This reduction in viscosity allows the fuel to be properly atomized for combustion. The additive formulations of certain embodiments may be sensitive to such elevated temperatures, and exposure to such elevated temperatures for extended periods of time may result in a deterioration in their effectiveness in reducing emissions. To minimize the exposure time of the additive formulation in the residual fuel to elevated temperatures prior to combustion, it is generally preferred to use a Metered Injection Pumping System (MIPS), illustrated in FIG. 1, to additize the fuel. A MIPS system is able to sense residual fuel flow to the combustion chamber and make adjustments to additization rates automatically so as to ensure a constant level of additive in the fuel. A MIPS is connected to the residual fuel after the recirculation of the fuel, typically after the re-circulating valve. As a result of this connection, the only fuel being additized is the fuel entering into the combustion chamber of the boiler. Typically the fuel is recirculated from the holding tank. The residual fuel is heated and maintained at a predetermined temperature of approximately 240° F. This temperature is generally necessary for proper atomization of such fuel, which is typically a solid at ambient temperatures.

In the MIPS system illustrated in FIG. 1, the fuel is recirculated in a heavy insulated 10 cm (4 inch) black pipe above ground. Above ground pipes are preferred to provide easy accessibility for external heating. A one way valve is placed in the fuel line approximately 1.2 to 1.8 m (4 to 6 feet) from the value to the combustion chamber. The pressure of the residual oil is usually about 103 to about 172 kPa (about 15 to about 25 psi). The MIPS is hooked-up to the fuel line after recirculation but just prior to combustion. The MIPS is on a flat square steel platform approximately 0.9 m by 0.9 m (3 feet by 3 feet). The residual fuel enters the MIPS through a splice in the fuel line pipe connection. Once entering this pipe, the fuel passes through an extremely accurate fuel oil meter with a pulse signal head, which generates an electrical signal. This signal is sent to the prominent diaphragm positive placement injection pump that is calibrated to supply a predetermined amount of additive to the residual fuel. The additive is atomized, typically under a pressure of 1034 kPa (150 psi), into the residual fuel as it enters the motionless mixer, a 1.9 cm by 23 cm (¾ inch by 9 inch) long pulsation dampener, which contains a series of flights which, in turn, spin the fuel 360 degrees several times. A manual calibration tube is placed on the MIPS platform for accuracy and allows an on site calibration. In line fuel filters are used to filter the additive from the holding tank to the MIPS accumulator. The pump is positive placement so as to provide a continuous supply of additive. Once the fuel is treated with additive and is mixed, it is sent directly to the atomization nozzles and into the combustion zone of the boiler. In operation, the residual fuel flows through the fuel meter, which automatically sends a signal to the pump. The signal establishes the amount of additive that is dispensed into the residual fuel. The signal also allows the residual fuel to flow at a rate of 30 liters to 757 liters per hour (8 gallons to 200 gallons per hour) while the pump automatically dispenses a calibrated predetermined amount of additive. The complete process takes less than 15 seconds, a time sufficiently short such that the residual fuel does not substantially cool and the formulation of preferred embodiments does not substantially pre-oxidize.

Coal-based Fuels

The additive formulations of preferred embodiments may be used in conjunction coal or coal-in-water emulsions. The additive may be applied to the coal or added to the emulsion using techniques well known in the art. For example, it is preferred to spray the additive formulation of preferred embodiments onto pulverized coal prior to combustion. When the coal is in the form of an emulsion in water, the additive formulation may be added directly to the emulsion.

Other Fuels

The additive formulations of preferred embodiments are suitable for use with other materials that upon combustion yield nitrogen oxides, carbon monoxide, particulates, and other undesirable combustion products. For example, the additive may be incorporated into, e.g., charcoal briquettes, wood-containing fuels such as Pres-to-Logs®, and waste to be burned in incinerators, including large municipal waste combustors, small municipal waste combustors, hospital/medical/infectious waste incinerators, commercial and industrial solid waste incineration units, hazardous waste incinerators, manufacturing waste incinerators, or industrial boilers and furnaces that burn waste.

EXAMPLES

Oil Extraction from Barley Grass grams of dry, ground barley grass were extracted into a volume of n-hexane. After the extraction was completed, the extract was distilled to remove the n-hexane. After the n-hexane was distilled, the temperature of the extract was raised to 101° C. and maintained at that temperature for 30 minutes to remove any water present in the extract. The extracted oil was transferred to a sample bottle and kept in a vacuum oven at 50° C. for 8 hours to remove any residual water or solvent present in the extract. The extract was then weighed and the percent oil in the sample (on a dry basis) was measured.

The grass subjected to the extraction procedure described above included two batches, Grass A and Grass B. Grass A was supplied in the form of a dried and ground material. Grass B was supplied in raw form, and required drying and grinding prior to extraction.

The effect of extraction time was investigated for Grass A. 20 grams of the dried grass was extracted with 125 ml of n-hexane at a temperature of 70° C. for 2.0, 4.0, 6.0, and 8 hours. The results, provided in the following Table, suggest that an extraction time of approximately 6 hours is generally sufficient to provide a satisfactory yield of oil extract from dried barley grass.

TABLE 2

| Extraction Time (hours) | Oil Weight (g per 20 g sample) | % Oil (Dry Basis) |
|---|---|---|
| 2.0 | 0.1829 | 0.942 |
| 4.0 | 0.2522 | 1.299 |
| 6.0 | 0.4400 | 2.266 |
| 8.0 | 0.3880 | 1.998 |

A sample of Grass B was dried and ground. The sieve test results for the ground sample of Grass B was as follows:

TABLE 3

| Retained by Mesh No. | Weight | Percentage |
|---|---|---|
| 10 | 5.10 | 2.47 |
| 14 | 62.14 | 30.05 |
| 16 | 72.40 | 35.00 |
| 18 | 45.83 | 22.16 |
| >18 | 21.37 | 10.33 |
| Total | 206.83 | 100.00 |

The effects of extraction temperature, time, and n-hexane volume were investigated, as well as differences between ground and unground barley grass. The results suggest that higher oil yields are obtained for ground grass, and that extraction times of from 1 to 4 hours were sufficient to provide satisfactory oil extract yields. As the volume of n-hexane used in the extraction was reduced from 250 to 200 ml, the resulting oil extract yield was observed to drop substantially, however, a reduction from 200 to 125 ml did not have a substantial effect on oil extract yield. A drop in temperature from 78° C. to 60° C. produced a substantial drop in oil extract yield.

TABLE 4

| Experiment Number | Temp. (° C.) | n-Hexane (ml) | Extraction Time (hr) | Oil Weight (g) | % Oil (Dry Basis) |
|---|---|---|---|---|---|
| 1 (not ground) | 78 | 250 | 4.0 | 0.125 | 0.676 |
| 2 | 78 | 250 | 1.0 | 0.708 | 3.540 |
| 3 | 78 | 250 | 3.0 | 0.718 | 3.590 |
| 4 | 78 | 250 | 4.0 | 0.704 | 3.520 |
| 5 | 78 | 200 | 4.0 | 0.589 | 2.945 |
| 6 | 78 | 200 | 2.0 | 0.551 | 2.755 |
| 7 | 78 | 125 | 4.0 | 0.591 | 2.955 |
| 8 | 60 | 250 | 4.0 | 0.539 | 2.695 |

The extraction data indicate that under similar extraction conditions, Grass B gave a better oil yield than Grass A. While not wishing to be bound to any explanation, it is possible that growing conditions or other factors may result in different oil yields. The ratio of grass to solvent appears to have a substantial effect on the amount of oil extracted. A ratio of 250 ml of n-hexane per 20 g of grass is expected to produce satisfactory oil extract yields. At this ratio, the extraction time did not have a significant effect on the yield of oil extract. Particle size of the grass had a large effect on oil yields, with ground grass yielding more oil than unground grass. An extraction temperature of 78° C. provided a satisfactory yield of oil extract. However, a temperature of 60° C. did not. The boiling point of n-hexane is 68° C., which suggests that extraction temperatures above the boiling point of n-hexane may produce satisfactory oil extract yields.

A large-scale extraction was run on two lots of barley grass. One lot consisted of 1.8 kg dry material and the other lot consisted of 5.5 kg wet material. Both lots were flaked through Ferrell-Ross flaking rolls with the air gap set at 3.0 mm, and 6.8 kg of the flaked material was sent to a steam jacketed pilot plant stainless steel extractor vessel for a single wash. 102 liters of commercial hexane was used as the solvent. The extraction was conducted for 6 hours at a temperature of 49–51° C. After the extraction was completed, the solvent and material remained in the reactor at ambient temperature for a few days prior to recovery of the extract. The extract was recovered in a thin film evaporator to yield 454.8 grams of oil extract (a yield of approximately 6.7 wt. %).

Gasoline—OR-1

Small Batch Manufacturing—Toluene (200 ml, industrial grade) was placed in a 400 ml glass Erlenmeyer flask. A nitrogen "blanket" was placed over the toluene by allowing nitrogen gas to flow into the space above the toluene in the flask. 4 ml jojoba oil and 4 g of β-carotene were added to the toluene and a solution prepared. The solution, at a temperature between ambient but below approximately 32° C. was stirred for approximately 10 to 20 minutes. The extent of solvation of the jojoba oil and β-carotene in the toluene was determined by shining a light at an angle through the solution so as to highlight any undissolved particles floating in the solution. After the jojoba oil and β-carotene were fully solvated,the solution of jojoba oil and β-carotene in toluene was poured into a 5000 ml Erlenmeyer flask containing 3000 ml of No. 1 diesel fuel. The flask containing the solution of jojoba oil in toluene was rinsed with excess No. 1 diesel fuel, and the rinsings were added to the contents of the 5000 ml flask. Additional No. 1 diesel was then added to the flask to yield a total of 3785 ml of solution. The solution was heated and stirred to thoroughly ensure all components were mixed. The additive package, labeled "Small Batch Additive C" was then stored in a 1 gallon metal container with nitrogen in the headspace prior to use.

200 ml toluene was placed in a 400 ml glass Erlenmeyer flask. A nitrogen "blanket" was placed over the toluene as described above. 19.36 g of oil extract from vetch and 4 ml of jojoba oil were added to the toluene and a solution prepared by heating to a temperature of approximately 38° C. to 43° C. and stirring the mixture for approximately 20 to 30 minutes. The extent of solvation of the oil extract of vetch and jojoba oil in the toluene was determined by shining a light on the solution to detect any undissolved particles in the solution. After the oil extract of vetch and jojoba oil were fully solvated, the solution was poured into a 5000 ml Erlenmeyer flask containing 3000 ml of No. 1 diesel fuel. The flask containing the solution of oil extract of vetch and jojoba oil in toluene was rinsed with excess No. 1 diesel fuel, and the rinsings were added to the contents of the 5000 ml flask. Additional No. 1 diesel was then added to the flask to yield a total of 3785 ml of solution. The solution was heated and stirred to thoroughly ensure all components were mixed. The additive, labeled "Small Batch Additive A" was then stored in a 1 gallon metal container with nitrogen in the headspace prior to use.

Small Batch Additives A and C are then combined in a regular unleaded gasoline at a predetermined ratio. The amounts below correspond to the amount of each additive present in 3785 ml (one gallon) of additized gasoline.

For the United States, the ratios in Table 5 are preferred, depending upon the elevation at which the fuel is to be combusted:

TABLE 5

| United States | | |
|---|---|---|
| Altitude | Additive A | Additive C |
| Below 762 m (2500 ft.) | 2.5 ml | 0.5 ml |
| 762 m to 1524 m (2500 ft. to 5000 ft.) | 1.2 ml | 0.8 ml |
| Above 1524 m (5000 ft.) | 3.6 ml | 0.8 ml |

For Mexico, where high mercaptan levels in gasoline are a concern, the ratios in Table 6 are preferred, depending upon the elevation at which the fuel is to be combusted:

TABLE 6

| Mexico | | |
|---|---|---|
| Altitude | Additive A | Additive C |
| Below 762 m (2500 ft.) | 2.5 ml | 4.5 ml |
| 762 m to 1524 m (2500 ft. to 5000 ft.) | 1.2 ml | 4.8 ml |
| Above 1524 m (5000 ft.) | 3.6 ml | 5.0 ml |

Although the above additive levels may be preferred for certain embodiments, in other embodiments it may be preferred to have other additive levels. For example, Small Batch Additive A may be present at about 0.5 ml or less up to about 10 ml or more per 3785 ml of additized gasoline, preferably at 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3.0, 3.1, 3.2, 3.3, 3.4, 3.5, 3.6, 4, 4.5, 5, 6, 7, 8, or 9 ml per 3785 ml of additized gasoline, and Small Batch Additive C may be present at about 0.5 ml or less up to about 10 ml or more per 3785 ml of additized gasoline, preferably at 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3.0, 3.1, 3.2, 3.3, 3.4, 3.5, 3.6, 4, 4.5, 5, 6, 7, 8, or 9 ml per 3785 ml of additized gasoline.

Gasoline—OR-1

Large Batch Manufacturing—Commercial Applications—1600 ml toluene was placed in a 2000 ml glass Erlenmeyer flask. A nitrogen "blanket" was placed over the toluene as described above. 32 ml jojoba oil and 32 g of β-carotene were added to the toluene and a solution prepared by heating and stirring the mixture as described above (namely, stirring for 10 to 20 minutes at a temperature of from ambient to below approximately 32° C.). The extent of solvation of the jojoba oil and β-carotene in the toluene was determined as described above. After the jojoba oil and β-carotene were fully solvated, the solution of jojoba oil and β-carotene in toluene was poured into a 5000 ml Erlenmeyer flask containing 2000 ml of No. 1 diesel fuel. The flask containing the solution of jojoba oil in toluene was rinsed with excess No. 1 diesel fuel, and the rinsings were added to the contents of the 5000 ml flask. Additional No. 1 diesel was then added to the flask to yield a total of 3785 ml of solution. The solution was heated and stirred to thoroughly ensure all components were mixed. The additive package, labeled "Large Batch Additive C" was then stored in a 1 gallon metal container with nitrogen in the headspace prior to use.

1600 ml toluene was placed in a 2000 ml glass Erlenmeyer flask. A nitrogen "blanket" was placed over the toluene as described above. 154.88 g of oil extract from vetch and 32 ml of jojoba oil were added to the toluene and a solution prepared by heating and stirring the mixture as described above (namely, stirring for 30 to 30 minutes at a temperature of approximately 38° C. to 43° C.). The extent of solvation of the oil extract of vetch and jojoba oil in the toluene was determined by shining a light on the solution to detect any undissolved particles in the solution. After the oil extract of vetch and jojoba oil were fully solvated, the solution was poured into a 5000 ml Erlenmeyer flask containing 2000 ml of No. 1 diesel fuel. The flask containing the solution of oil extract of vetch and jojoba oil in toluene was rinsed with excess No. 1 diesel fuel, and the rinsings were added to the contents of the 5000 ml flask. Additional No. 1 diesel was then added to the flask to yield a total of 3785 ml of solution. The solution was heated and stirred to thoroughly ensure all components were mixed. The additive, labeled "Large Batch Additive A" was then stored in a 1 gallon metal container with nitrogen in the headspace prior to use.

Large Batch Additives A and C are then combined in a regular unleaded gasoline at a predetermined ratio. The amounts below correspond to the amount of each additive present in 3785 ml (one gallon) of additized gasoline.

For the United States, the ratios in Table 7 are preferred, depending upon the elevation at which the fuel is to be combusted:

TABLE 7

| United States | | |
|---|---|---|
| Altitude | Additive A | Additive C |
| Below 762 m (2500 ft.) | 0.3125 ml | 0.0625 ml |
| 762 m to 1524 m (2500 ft. to 5000 ft.) | 0.4 ml | 0.1 ml |
| Above 1524 m (5000 ft.) | 0.45 ml | 0.1 ml |

For Mexico, where high mercaptan levels in gasoline are a concern, the ratios in Table 8 are preferred, depending upon the elevation at which the fuel is to be combusted:

TABLE 8

| Mexico | | |
|---|---|---|
| Altitude | Additive A | Additive C |
| Below 762 m (2500 ft.) | 0.3125 ml | 0.5625 ml |
| 762 m to 1524 m (2500 ft. to 5000 ft.) | 0.4 ml | 0.6 ml |
| Above 1524 m (5000 ft.) | 0.45 ml | 0.625 ml |

Although the above additive levels may be preferred for certain embodiments, in other embodiments it may be preferred to have other additive levels. For example, Large Batch Additive A may be present at about 0.1 ml or less up to about 1 ml or more per 3785 ml of additized gasoline, preferably at 0.15, 0.2, 0.25, 0.3, 0.35, 0.4, 0.45, 0.5, 0.55, 0.6, 0.65, 0.7, 0.75, 0.8, 0.85, 0.9, or 0.95 ml per 3785 ml of additized gasoline, and Large Batch Additive C may be present at about 0.02 ml or less up to about 1 ml or more per 3785 ml of additized gasoline, preferably at 0.03, 0.04, 0.05, 0.06, 0.07, 0.08, 0.09, 0.1, 0.15, 0.2, 0.25, 0.3, 0.35, 0.4, 0.45, 0.5, 0.55, 0.6, 0.65, 0.7, 0.75, 0.8, 0.85, 0.9, or 0.95 ml per 3785 ml of additized gasoline.

Figure 2:
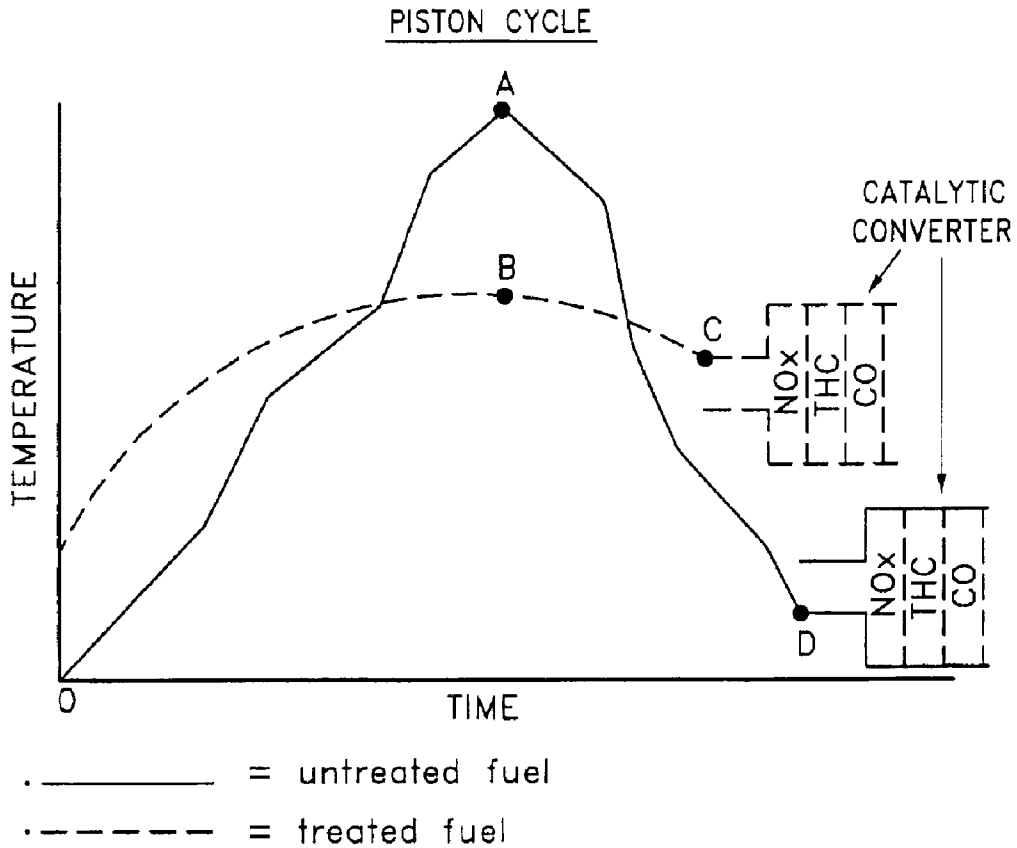
FIG. 2 provides a hypothetical temperature versus time curve for the piston cycle of a gasoline-powered engine operating on untreated fuel and fuel treated with the OR-1 additive.

While not wishing to be bound by any theory, it is believed that the fuel additive OR-1 allows a more complete combustion of gasoline by eliminating quenching, spiking, and/or inconsistencies in the flame profile, in other words, by creating a smoother burn. FIG. 2 illustrates a hypothetical temperature versus time curve for the piston cycle of treated and untreated fuel. The difference between point A and point B corresponds to $NO_x$ reduction. The treated, or "smoother" flame hits the catalytic converter at a higher temperature and in a shorter amount of time, referred to as the catalyst light-off time (point C). This is believed to create an additional $NO_x$ reduction and also to create a HC and CO reduction as well. When introducing higher temperatures at faster time cycles, it is believed that OR-1 keeps the catalytic converter in more of a "green state," burning off gums, resins, and carbon deposits, hence the reduction in significant emissions observed for use of the additive. Increased fuel economy is believed to result from an overall more efficient burn in the combustion chamber.

Diesel—OR-2

Small Batch Manufacturing—Small Batch Additive A and Small Batch Additive C are prepared as described above, and then combined in a Number 2 low Sulfur Diesel Fuel at a predetermined ratio. The amounts below correspond to the amount of each additive present in 3785 ml (one gallon) of additized diesel fuel.

For the United States, the ratios in Table 9 are preferred, depending upon the elevation at which the fuel is to be combusted:

TABLE 9

| United States | | |
|---|---|---|
| Altitude | Additive A | Additive C |
| Below 762 m (2500 ft.) | 2.5 ml | 1.5 ml |
| 762 m to 1524 m (2500 ft. to 5000 ft.) | 2.5 ml | 2.0 ml |
| Above 1524 m (5000 ft.) | 2.5 ml | 2.5–3.0 ml |

For Mexico, the ratios in Table 10 are preferred, depending upon the elevation at which the fuel is to be combusted:

TABLE 10

| Mexico | | |
|---|---|---|
| Altitude | Additive A | Additive C |
| Below 762 m (2500 ft.) | 2.5 ml | 1.2 ml |
| 762 m to 1524 m (2500 ft. to 5000 ft.) | 2.5 ml | 2.0 ml |
| Above 1524 m (5000 ft.) | 2.5 ml | 3.0 ml |

Although the above additive levels may be preferred for certain embodiments, in other embodiments it may be preferred to have other additive levels. For example, Small Batch Additive A may be present at about 0.5 ml or less up to about 10 ml or more per 3785 ml of additized diesel fuel, preferably at 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3.0, 3.1, 3.2, 3.3, 3.4, 3.5, 3.6, 4, 4.5, 5, 6, 7, 8, or 9 ml per 3785 ml of additized diesel fuel, and Small Batch Additive C may be present at about 0.5 ml or less up to about 10 ml or more per 3785 ml of additized diesel fuel, preferably at 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3.0, 3.1, 3.2, 3.3, 3.4, 3.5, 3.6, 4, 4.5, 5, 6, 7, 8, or 9 ml per 3785 ml of additized diesel fuel.

Diesel—OR-2

Large Batch Manufacturing—Commercial Applications—Large Batch Additive A and Large Batch Additive C are prepared as described above, and then combined in a Number 2 Low Sulfur Diesel Fuel at a predetermined ratio. The amounts below correspond to the amount of each additive present in 3785 ml (one gallon) of additized diesel fuel.

For the United States, the ratios in Table 11 are preferred, depending upon the elevation at which the fuel is to be combusted:

TABLE 11

| United States | | |
|---|---|---|
| Altitude | Additive A | Additive C |
| Below 762 m (2500 ft.) | 0.3125 ml | 0.15 ml |
| 762 m to 1524 m (2500 ft. to 5000 ft.) | 0.3125 ml | 0.25 ml |
| Above 1524 m (5000 ft.) | 0.3125 ml | 0.375 ml |

For Mexico, the ratios in Table 12 are preferred, depending upon the elevation at which the fuel is to be combusted:

TABLE 12

| Mexico | | |
|---|---|---|
| Altitude | Additive A | Additive C |
| Below 762 m (2500 ft.) | 0.3125 ml | 0.15 ml |
| 762 m to 1524 m (2500 ft. to 5000 ft.) | 0.3125 ml | 0.25 ml |
| Above 1524 m (5000 ft.) | 0.3125 ml | 0.375 ml |

Although the above additive levels may be preferred for certain embodiments, in other embodiments it may be preferred to have other additive levels. For example, Large Batch Additive A may be present at about 0.1 ml or less up to about 1 ml or more per 3785 ml of additized diesel fuel, preferably at 0.15, 0.2, 0.25, 0.3, 0.35, 0.4, 0.45, 0.5, 0.55, 0.6, 0.65, 0.7, 0.75, 0.8, 0.85, 0.9, or 0.95 ml per 3785 ml of additized diesel fuel, and Large Batch Additive C may be present at about 0.05 ml or less up to about 1 ml or more per 3785 ml of additized diesel fuel, preferably at 0.06, 0.07, 0.08, 0.09, 0.1, 0.15, 0.2, 0.25, 0.3, 0.35, 0.4, 0.45, 0.5, 0.55, 0.6, 0.65, 0.7, 0.75, 0.8, 0.85, 0.9, or 0.95 ml per 3785 ml of additized diesel fuel.

Residual Fuel—OR-3

Small Batch Manufacturing—Fuel Economy—Small Batch Additive C was prepared as described above and was added to a High Residual or Bunker C fuel as a fuel economy additive.

For Mexico, 4.5 ml of Small Batch Additive C is preferably present in 3785 ml (one gallon) of additized High Residual or Bunker C fuel. However, for other countries or in various other resid fuel formulations, the additive may be present at about 0.1 ml or less up to about 100 ml or more, preferably at 0.05, 1, 1.5, 2, 2.5, 3, 3.5, 4, 4.5, 5, 6, 7, 8, 9, 10, 15, 20, 30, 40, or 50 ml per 3785 ml of additized resid fuel. Moreover, it may be preferred in certain embodiments to include as additional additives one or more plant oil extracts such as oil extract of vetch and/or thermal stabilizers such as jojoba oil, or to use as a resid fuel additive an additive combination suitable for use in gasoline, diesel, or other hydrocarbon fuels as described in the preferred embodiments herein.

Small Batch Manufacturing—Fuel Economy and Reduced Emissions—200 ml toluene was placed in a 400 ml glass Erlenmeyer flask. A nitrogen "blanket" was placed over the toluene as described above. 8 ml of jojoba oil and 4 g β-carotene were added to the toluene and a solution prepared by heating and stirring for 10 to 20 minutes at a temperature of from ambient to below approximately 32° C. The extent of salvation was determined by shining a light on the solution to detect any undissolved particles in the solution. After the jojoba oil and p-carotene were fully solvated, the solution was poured into a 5000 ml Erlenmeyer flask containing 3000 ml of No. 2 diesel fuel. The flask containing the solution of jojoba oil and β-carotene in toluene was rinsed with excess No. 2 diesel fuel, and the rinsings were added to the contents of the 5000 ml flask. 19.36 g oil extract of vetch was added to the flask and a solution prepared by heating and stirring the mixture. Additional No. 2 diesel was then added to the flask to yield a total of 3785 ml of solution. The solution was heated and stirred to thoroughly ensure all components were mixed. The additive, labeled "Small Batch Additive CA" was then stored in a 1 gallon metal container with nitrogen in the headspace prior to use.

Small Batch Additive CA is combined in a High Residual or Bunker C fuel at a predetermined ratio. In various resid fuel formulations, the additive may be present at about 0.1 ml or less up to about 100 ml or more, preferably at 0.5, 1, 1.5, 2, 2.5, 3, 3.5, 4, 4.5, 5, 6, 7, 8, 9, 10, 15, 20, 30, 40, or 50 ml per 3785 ml of additized resid fuel.

Residual Fuel—OR-3

Large Batch Manufacturing—Commercial Applications—Fuel Economy—Large Batch Additive C is prepared as described above, except that No. 2 Diesel fuel is substituted for No. 1 Diesel fuel. The additive is then combined in a High Residual or Bunker C fuel at a predetermined ratio. In the United States, preferably 2 to 4 ml of additive is present per 3785 ml (1 gal.) of fuel. In Mexico, preferably 0.5625 to 4 ml of additive is present per 3785 ml (1 gal.) of fuel. However, in other countries or in various other resid fuel formulations, the additive may be present at about 0.1 ml or less up to about 100 ml or more, preferably at 0.5, 1, 1.5, 2, 2.5, 3, 3.5, 4, 4.5, 5, 6, 7, 8, 9, 10, 15, 20, 30, 40, or 50 ml per 3785 ml of additized resid fuel. Moreover, it may be preferred in certain embodiments to include as additional additives one or more plant oil extracts such as oil extract of vetch and/or thermal stabilizers such as jojoba oil, or to use as a resid fuel additive an additive combination suitable for use in gasoline, diesel, or other hydrocarbon fuels as described in the preferred embodiments herein.

Large Batch Manufacturing—Fuel Economy and Reduced Emissions—1600 ml toluene was placed in a 2000 ml glass Erlenmeyer flask. A nitrogen "blanket" was placed over the toluene as described above. 32 ml of jojoba oil and 32 g β-carotene were added to the toluene and a solution prepared by heating and stirring for 10 to 20 minutes at a temperature of from ambient to below approximately 32° C. The extent of solvation of the oil extract of vetch and jojoba oil in the toluene was determined by shining a light on the solution to detect any undissolved particles in the solution. After the oil extract of vetch and jojoba oil were fully solvated, the solution was poured into a 5000 ml Erlenmeyer flask containing 2000 ml of No. 2 diesel fuel. The flask containing the solution of jojoba oil and β-carotene in toluene was rinsed with excess No. 2 diesel fuel, and the rinsings were added to the contents of the 5000 ml flask. 154.88 g of oil extract from vetch was added to the flask and a solution prepared by heating and stirring the mixture. Additional No. 2 diesel was then added to the flask to yield a total of 3785 ml of solution. The solution was heated and stirred to thoroughly ensure all components were mixed. The additive, labeled "Large Batch Additive CA" was then stored in a 1 gallon metal container with nitrogen in the headspace prior to use.

Large Batch Additive CA is combined in a High Residual or Bunker C fuel at a predetermined ratio. In the United States, preferably 2 to 4 ml of additive is present per 3785 ml (1 gal.) of fuel. In Mexico, preferably 0.5625 to 4 ml of additive is present per 3785 ml (1 gal.) of fuel. However, in other countries or in various other resid fuel formulations, the additive may be present at about 0.1 ml or less up to about 100 ml or more, preferably at 0.2, 0.3, 0.4, 0.5, 0.6, 0.7, 0.8, 0.9, 1, 1.5, 2, 2.5, 3, 3.5, 4, 4.5, 5, 6, 7, 8, 9, 10, 15, 20, 30, 40, or 50 ml per 3785 ml of additized resid fuel.

Additives for Two-cycle Engines—OR-2T

Several tests were conducted in Malaysia on the combustion in a two-cycle engine of a fuel containing a formulation of a preferred embodiment. The tests were performed to assess the effects of an OR-2T additive, described below, in comparative analysis testing between unadditized and additized Petronas 2T oil (referred to in the following table as "2T").

OR-2T was added into selected 2XT Sprinta JASO FC equivalent 2T oil in various proportions according to blending done by a standard protocol of adding incremental small amounts of OR-2T additive to the 2T oil. The final ratio of the 2XT Sprinta JASO FC plus OR-2T additive in relation to the gasoline fuel was 1:20. This ratio was maintained throughout the test program. However, the proportion of the OR-2T additive added to the 2XT Sprinta JASO FC was varied.

The test equipment included a Hartridge Model 4 smoke meter from Lucas Assembly and test Systems, England, equipped with automatic printout, and a Yamaha RT600A 49.9 $cm^3$ two-cycle test engine. The gasoline fuel tested was Petronas Primas PX2 and the 2T Engine oils included Sprinta 2Y9(FB) and Sprinta 2XT(FC).

Measurement of the smoke level was carried out using the Hartridge Model-4, with an integrated internal light source and smoke column; averaging once between 100–110° C. and another between 110–120° C. The results were reported in Hartridge Smoke level Units (HSU) ranging from 0 to 100 HSU per loading cycle. A series of smoke level readings were conducted initially to obtain a good repeatability for the baseline reading using the Primas PX2 and the Sprinta 2XT Racing oil. The candidate (OR-2T additized 2XT Sprinta engine oil) were evaluated in accordance to the specified procedure to obtain smoke level readings. The smoke level in HSU was recorded and tabulated to the candidate used in the testing. Petronas performed all testing at their research facility located in Shah Alam, Malaysia.

The OR-2T additive for two-cycle engines was able to achieve a 50/o reduction in the smoke from this two-cycle engine smoke test. The additive was added to the oil, mixed into the oil, and then the oil was poured directly into the gasoline fuel tank. The average reduction was well over 40%, in some cases as great as a 50 to 55% reduction in smoke.

The OR-2T formula for this two-cycle additive was prepared from Small Batch Additive A and Small Batch Additive C. Reductions in smoke levels observed are reported in Table 13.

TABLE 13

| Formulation | % change in smoke levels |
|---|---|
| Unadditized base fuel (smoke point of 90.85 to 92.3) | — |
| A 0.28 ml + C 0.65 ml in a gallon of 2T at a ratio of 1:20 | −8% |
| A 1.5 ml + C 1.22 ml in a gallon of 2T at a ratio of 1:20 | −22% |
| A 0.28 ml + C 1.42 ml in a gallon of 2T at a ratio of 1:20 | −30% |

TABLE 13-continued

| Formulation | % change in smoke levels |
|---|---|
| A 1.1 ml + C 10 ml in a gallon of 2T at a ratio of 1:20 | −31% |
| A 1.1 ml + C 20 ml in a gallon of 2T at a ratio of 1:20 | −52% |
| A 0.6 ml + C 20 ml in a gallon of 2T at a ratio of 1:20 | −48% |

Although the above additive levels may be preferred for certain embodiments, in other embodiments it may be preferred to have other additive levels. For example, Small Batch Additive A may be present at about 0.05 ml or less up to about 100 ml or more per 3785 ml of additized two-cycle oil, preferably at 0.2, 0.3, 0.4, 0.5, 0.6, 0.7, 0.8, 0.9, 1, 1.5, 2, 2.5, 3, 3.5, 4, 4.5, 5, 6, 7, 8, 9, 10, 15, 20, 30, 40, or 50 ml per 3785 ml of additized 2T fuel, and Small Batch Additive C may be present at about 0.05 ml or less up to about 100 ml or more per 3785 ml of additized two-cycle fuel, preferably at 0.2, 0.3, 0.4, 0.5, 0.6, 0.7, 0.8, 0.9, 1, 1.5, 2, 2.5, 3, 3.5, 4, 4.5, 5, 6, 7, 8, 9, 10, 15, 20, 30, 40, or 50 ml per 3785 ml of additized 2T oil. The additized 2T oil is typically added to a base gasoline at a treat rate of about 1:10 (on a weight basis) to 1:40 (on a weight basis), preferably from about 1:11, 1:12, 1:13, 1:14, 1:15, 1:16, 1:17, 1:18, or 1:19 (on a weight basis) to about 1:21, 1:22, 1:23, 1:24, 1:25, 1:26, 1:27, 1:28, 1:29, 1:30, 1:35, or 1:40 (on a weight basis). In certain embodiments, however, higher or lower ratios may be preferred.

Cetane Improver

A composition and method for increasing the amount of cetane in fuel is provided. In one embodiment, the cetane improver comprises β-carotene that was prepared under an inert atmosphere. Unexpectedly, it was discovered that β-carotene, which was dissolved in an inert atmosphere, raised the level of cetane in No. 2 diesel fuel more effectively and maintained the raised cetane level longer than β-carotene prepared by conventional methods. In preferred embodiments, a cetane improver is prepared by mixing β-carotene with a toluene carrier under an inert atmosphere, and adding an alkyl nitrate, for example, 2-ethylhexyl nitrate. The preferred cetane improver prepared by the methods described herein increased the level of cetane in No. 2 diesel fuel in a synergistic fashion.

β-Carotene is present as a cetane improver in preferred embodiments. The β-carotene may be added to the fuel formulation as an isolated component or may be present or naturally occurring in another component, such as, for example, a plant oil extract. The β-carotene may be the sole additive to the fuel, or may be present as part of a fuel additive package. β-Carotene is a high molecular weight antioxidant. In plants, it functions as a scavenger of oxygen radicals and protects chlorophyll from oxidation.

The β-carotene may be natural or synthetic. In a preferred embodiment, the β-carotene is provided in a form equivalent to vitamin A having a purity of 1.6 million units of vitamin A activity. Vitamin A of lesser purity may also be suitable for use, provided that the amount used is adjusted to yield an equivalent activity. For example, if the purity is 800,000 units of vitamin A activity, the amount used is doubled to yield the desired activity.

Precursors or derivatives of β-carotene, for example, vitamin A, may be suitable for use in preferred embodiments. While not wishing to be limited to any particular mechanism, it is believed that the β-carotene, or a precursor or derivative of a carotene or carotenoid, in the formulations of preferred embodiments may scavenge oxygen radicals in the combustion process or may act as an oxygen solubilizer or oxygen getter for the available oxygen that is present in the air/fuel stream for combustion.

While β-carotene is preferred in many embodiments, in other embodiments it may be desirable to substitute another carotene or carotenoid, or precursor or derivative of another carotene or carotenoid, for example, α-carotene or carotenoids as described below, for β-carotene. Alternatively, another component may supplement the β-carotene, including, but not limited to, a-carotene, or additional carotenoids from algae xeaxabthin, crypotoxanthin, lycopene, lutein, broccoli concentrate, spinach concentrate, tomato concentrate, kale concentrate, cabbage concentrate, brussels sprouts concentrate and phospholipids, green tea extract, milk thistle extract, curcumin extract, quercetin, bromelain, cranberry and cranberry powder extract, pineapple extract, pineapple leaves extract, rosemary extract, grapeseed extract, ginkgo biloba extract, polyphenols, flavonoids, ginger root extract, hawthorn berry extract, bilberry extract, butylated hydroxytoluene (BHT), oil extract of marigolds, any and all oil extracts of carrots, fruits, vegetables, flowers, grasses, natural grains, leaves from trees, leaves from hedges, hay, any living plant or tree, and combinations or mixtures thereof.

Vegetable carotenoids of guaranteed potency are particularly preferred, including those containing lycopene, lutein, α-carotene, other carotenoids from carrots or algae, betatene, and natural carrot extract. In certain particularly preferred embodiments, a substitute for β-carotene is present in an amount sufficient to yield an equivalent vitamin A activity as for a preferred quantity of β-carotene. However, in other embodiments vitamin A activity may not be a preferred method for determining the quantity of substitute, or the substitute may not have an equivalent vitamin A activity.

In addition to adding β-carotene in a liquid form to a fuel formulation, β-carotene (or another carotene or carotenoid, or a precursor or derivative of a carotene or carotenoid) may also be added in solid form, for example, in dehydrated form, or in the form of an encapsulated liquid or solid. The preservation and storage of solutions or suspensions of β-carotene or other plant-based materials carries enormous benefits, such as reduced weight and storage space, and increased stability and resistance to oxidation. β-Carotene in dehydrated form may be prepared by methods including freeze-drying, vacuum or air-drying, lyophilization, spray-drying, fluidized bed drying, and other preservation and dehydration methods as are known in the art. β-Carotene in dehydrated form may be added to fuel in the dehydrated form, or may be added as a reconstituted liquid in an appropriate solvent. In a preferred embodiment, a solid containing β-carotene is added to the fuel to be additized. Suitable solid forms include, but are not limited to, tablets, granules, powders, encapsulated solids and/or encapsulated liquids, and the like. Additional components may also be present in the solid form. Any suitable encapsulating material may be used, preferably a polymeric or other material that is soluble in the fuel to be additized. The encapsulating material dissolves in the fuel, releasing the encapsulated material. The tablet preferably dissolves in the fuel or a diluent over an acceptable period of time. Dissolving aids may be included in the tablet, e.g., small granules or particles of active ingredient may be present in a matrix with high solubility in the fuel. A combination of solid and liquid dosing methods may be utilized, and the solid may be added to the fuel or a diluent at any preferred time.

In a preferred embodiment, the cetane improver can be formulated by the following method. Under an inert atmosphere, (e.g., nitrogen, helium, or argon) three grams of β-carotene (1.6 million International units of vitamin A activity per gram) are dissolved in 200 ml of a liquid hydrocarbon carrier comprising toluene. It is preferred to dissolve the β-carotene with heating and stirring. β-Carotene dissolved or otherwise prepared under an inert atmosphere is referred to as "non-oxygenated β-carotene." Substitutes or supplements to β-carotene, including other carotenes or carotenoids or precursors or derivatives of carotenes or carotenoids, are referred to as "non-oxygenated carotenes or carotenoids or precursors or derivatives of carotenes or carotenoids." Next, approximately 946 milliliters of a 100% solution of 2-ethylhexyl nitrate is added to the mixture and toluene is added so as to obtain a total volume of 3.785 liters.

The following components may be used in combination with β-carotene in cetane improvers of preferred embodiments: butylated hydroxytoluene, lycopene, lutein, all types of carotenoids, oil extract from carrots, beets, hops, grapes, marigolds, fruits, vegetables, palm oil, palm kernel oil, palm tree oil, bell pepper, cottonseed oil, rice bran oil, any plant that is naturally orange, red, purple, or yellow in color that is growing in nature, or any other material that may be a natural oxygen scavenger but yet remains organic in nature. In certain embodiments, it may be preferred to substitute one or more of these components in whole or in part for the β-carotene.

The oil extracted from the following products may also be used in combination with β-carotene: α-carotene, and additional carotenoids from algae xeaxabthin, crypotoxanthin, lycopene, lutein, broccoli concentrate, spinach concentrate, tomato concentrate, kale concentrate, cabbage concentrate, Brussels sprouts concentrate and phospholipids. In addition, the oil extracts from green tea extract, milk thistle extract, curcumin extract, quercetin, bromelain, cranberry and cranberry powder extract, pineapple extract. pineapple leaves extract, rosemary extract, grapeseed extract, ginkgo biloba extract, polyphenols, flavonoids, ginger root extract, hawthorn berry extract, bilberry extract, butylated hydroxytoluene, oil extract of marigolds, oil of hops, oil extract of jojoba, any and all oil extract of carrots, fruits, vegetables, flowers, grasses, natural grains, leaves from trees, leaves from hedges, hay, feed stocks for man and animal, and weeds, the oil extract of any living plant, or the oil extract of any fresh water or salt water fish, such as shark, including but not limited to squalene, squalane, all fresh and salt water fish oils, and fish oil extracts, or the oil extract of animals, such as whale.

In certain embodiments, the cetane improving carotene or carotenoid, or a precursor or derivative of a carotene or carotenoid is present in combination with one or more conventional cetane improvers, such as are described above. When an additional cetane improving additive is present, 2-ethylhexyl nitrate is especially preferred. However, it should be understood that while pure 2-ethylhexyl nitrate is desired, other alkyl nitrates or other grades of 2-ethylhexyl nitrate are also suitable. Further, one of skill will appreciate that other alkyl nitrates or conventional cetane improvers or ignition accelerators, as described above, perform similarly to 2-ethylhexyl nitrate and can be substituted accordingly. Desirably, many different formulations of cetane improver may be made, each having a different alkyl nitrate or more than one alkyl nitrate and/or proportions thereof relative to the β-carotene. Certain such formulations were evaluated for the ability to raise cetane levels in No. 2 diesel fuel according to the methods described below. In the embodiment described above, it is desirable to add the ingredients in the order described above. However, in other embodiments, variations in the order of addition can be made.

The cetane improver prepared as described above is one embodiment of a "concentrated cetane improver." To improve the cetane level in No. 2 diesel fuel, approximately 0.1 ml–35 ml of the concentrated cetane improver is added per one gallon of No. 2 diesel fuel. Preferably, the amount of concentrated cetane improver added to a gallon of No. 2 diesel fuel is in the range from about 0.3 ml to about 30 ml, more desirably, from about 0.5 ml to about 25 ml, still more preferably, from about 0.75 ml to about 20 ml, even more preferably, from about 1 ml to about 15 ml, and most preferably, from about 2, 3, 4, or 5 ml to about 6, 7, 8, 9, 10, 11, or 12 ml.

Cetane testing was performed by independent petroleum laboratories, each of which was CARB, EPA, and ASTM Certified. The procedure for testing Cetane is ASTM D-613, a published procedure that measures the ignition point of No. 2 diesel fuel. The test data, provided in Tables 14–23, verify that the cetane improver described herein synergistically improves the level of cetane in No. 2 diesel fuel. Additive OR-CT was prepared which contained 395.8 parts by weight toluene to 660.6 parts by weight of 2-ethylhexyl nitrate to 0.53 parts by weight of β-carotene. Various samples of No. 2 diesel fuel were treated to contain 1057 ppm of additive OR-CT (referred to as a "2+2" fuel). An additized fuel referred to as "1+0.5" in the following tables corresponds to a fuel treated with 264 ppm OR-CT and 132 ppm 2-ethylhexyl nitrate. Additized fuel referred to as "4+4" contains 1057 ppm OR-CT and 1057 ppm 2-ethylhexyl nitrate, and additized fuel referred to as "8+8" contains 2114 ppm OR-CT and 2114 ppm 2-ethylhexyl nitrate.

TABLE 14

| Formulation | Cetane Number | Change over Baseline |
|---|---|---|
| Baseline fuel - No. 2 Diesel | 44.8 | — |
| No. 2 diesel with 8 ml 100% 2-ethylhexyl nitrate added | 51.8 | +7 |
| No. 2 diesel "8 + 8" | 54.4 | +9.6 |

TABLE 15

| Formulation | Cetane Number | Change over Baseline |
|---|---|---|
| Baseline fuel - No. 2 Diesel + 2-ethylhexyl nitrate pretreat | 42.5 | — |
| No. 2 diesel + 2-ethylhexyl nitrate pretreat "4 + 4" | 44.6 | +2.1 |

TABLE 16

| Formulation | Cetane Number | Change over Baseline |
|---|---|---|
| Baseline fuel - No. 2 Diesel | 37.0 | — |
| No. 2 diesel with 8 ml 100% 2-ethylhexyl nitrate added | 41.8 | +4.8 |
| No. 2 diesel "4 + 4" | 41.9 | +4.9 |
| No. 2 diesel "8 + 8" | 43.3 | +6.3 |

TABLE 17

| Formulation | Cetane Number | Change over Baseline |
|---|---|---|
| Baseline fuel - No. 2 Diesel | 32.7 | — |
| No. 2 diesel with 8 ml 100% 2-ethylhexyl nitrate added | 39.4 | +6.7 |
| No. 2 diesel "4 + 4" | 37.3 | +4.6 |
| No. 2 diesel "8 + 8" | 41.4 | +8.7 |

TABLE 18

| Formulation | Cetane Number | Change over Baseline |
|---|---|---|
| Baseline fuel - No. 2 Diesel | 40.6 | — |
| No. 2 diesel with 8 ml 100% 2-ethylhexyl nitrate added | 46.0 | +5.4 |
| No. 2 diesel "2 + 2" | 42.6 | +2.0 |
| No. 2 diesel "4 + 4" | 45.6 | +5.0 |

TABLE 19

| Formulation | Cetane Number | Change over Baseline |
|---|---|---|
| Baseline fuel - No. 2 Diesel | 34.9 | — |
| No. 2 diesel with 1.5 ml 100% 2-ethylhexyl nitrate added | 39.9 | +5.0 |
| No. 2 diesel with "1 + 0.5" | 38.8 | +3.9 |

TABLE 20

| Formulation | Cetane Number | Change over Baseline |
|---|---|---|
| Baseline fuel - No. 2 Diesel | 36.4 | — |
| No. 2 diesel with 4 ml 100% 2-ethylhexyl nitrate added | 40.3 | +3.9 |
| No. 2 diesel "2 + 2" | 40.7 | +4.3 |

TABLE 21

| Formulation | Cetane Number | Change over Baseline |
|---|---|---|
| Baseline fuel - No. 2 Diesel | 42.2 | — |
| No. 2 diesel "4 + 4" | 50.7 | +8.5 |
| No. 2 diesel "8 + 8" | 60.0 | +17.3 |
| Baseline fuel - No. 2 Diesel | 47.8 | — |
| No. 2 diesel "4 + 4" | 57.4 | +9.6 |
| No. 2 diesel "8 + 8" | 62.5 | +14.7 |
| Baseline fuel - No. 2 Diesel | 51.3 | — |
| No. 2 diesel "4 + 4" | 61.0 | +9.7 |
| No. 2 diesel "8 + 8" | 70.5 | +19.2 |
| Baseline fuel - No. 2 Diesel | 22.9 | — |
| No. 2 diesel "4 + 4" | 31.6 | +8.7 |
| No. 2 diesel "8 + 8" | 36.6 | +13.7 |
| Baseline fuel - No. 2 Diesel | 31.8 | — |
| No. 2 diesel "4 + 4" | 39.1 | +7.3 |
| No. 2 diesel "8 + 8" | 42.1 | +10.3 |
| Baseline fuel - No. 2 Diesel | 38.0 | — |
| No. 2 diesel "4 + 4" | 48.5 | +10.5 |
| No. 2 diesel "8 + 8" | 51.1 | +13.1 |

TABLE 21-continued

| Formulation | Cetane Number | Change over Baseline |
|---|---|---|
| Baseline fuel - No. 2 Diesel | 49.2 | — |
| No. 2 diesel "4 + 4" | 54.6 | +5.4 |
| No. 2 diesel "8 + 8" | 62.5 | +13.3 |

TABLE 22

| Formulation | Cetane Number | Change over Baseline | Difference over 2-Ethylhexyl Nitrate |
|---|---|---|---|
| Baseline fuel - No. 2 Diesel | 42.7 | — | — |
| No. 2 diesel "2 + 2" | 47.6 | +4.9 | +0.3 |
| No. 2 diesel with 2 ml 100% 2-ethylhexyl nitrate only | 47.3 | +4.6 | — |
| Baseline fuel - No. 2 Diesel | 47.8 | — | — |
| No. 2 diesel "2 + 2" | 53.6 | +5.8 | +2.3 |
| No. 2 diesel with 2 ml 100% 2-ethylhexyl nitrate only | 51.3 | +3.5 | — |
| Baseline fuel - No. 2 Diesel | 50.0 | — | — |
| No. 2 diesel "2 + 2" | 55.8 | +5.3 | +2.3 |
| No. 2 diesel with 2.5 ml 100% 2-ethylhexyl nitrate only | 53.5 | +3.0 | — |
| Baseline fuel - No. 2 Diesel | 23.5 | — | — |
| No. 2 diesel "2 + 2" | 31.8 | +8.3 | +2.2 |
| No. 2 diesel with 2.5 ml 100% 2-ethylhexyl nitrate only | 29.6 | +6.1 | — |
| Baseline fuel - No. 2 Diesel | 32.4 | — | — |
| No. 2 diesel "2 + 2" | 37.9 | +5.5 | +1.2 |
| No. 2 diesel with 2.5 ml 100% 2-ethylhexyl nitrate only | 36.7 | +4.3 | — |
| Baseline fuel - No. 2 Diesel | 38.9 | — | — |
| No. 2 diesel "2 + 2" | 42.0 | +3.1 | +1.8 |
| No. 2 diesel with 2.5 ml 100% 2-ethylhexyl nitrate only | 40.2 | +1.3 | — |
| Baseline fuel - No. 2 Diesel | 49.5 | — | — |
| No. 2 diesel "2 + 2" | 51.7 | +2.2 | −0.1 |
| No. 2 diesel with 2.5 ml 100% 2-ethylhexyl nitrate only | 51.8 | +2.3 | — |

TABLE 23

| Formulation | Cetane Number |
|---|---|
| Baseline fuel - No. 2 Diesel | 40.5 |
| No. 2 diesel with 1057[1] ppm 2-EHN[6] only | 44.98 |
| No. 2 diesel with 1057[1] ppm OR-CT[3] only | 43.04 |
| No. 2 diesel with 528.5[2] ppm 2-EHN[6] + 528.5[2] ppm OR-CT[3] mixed | 45.39(+0.41) |
| Baseline fuel No. 2 Diesel | 46.8 |
| No. 2 diesel fuel with 1057[1] ppm 2-EHN[6] only | 52.75 |
| No. 2 diesel fuel with 1057[1] ppm OR-CT[3] only | 50.81 |
| No. 2 diesel fuel with 528.5[2] ppm 2-EHN[6] + 528.5[2] ppm OR-CT[3] mixed | 54.02(1.27) |
| Baseline fuel No. 2 diesel | 48.79 |
| No. 2 diesel fuel with 1057[1] ppm 2-EHN[6] only | 53.18 |
| No. 2 diesel fuel with 1057[1] ppm OR-CT[3] only | 51.13 |
| No. 2 diesel fuel with 528.5[2] ppm 2-EHN[6] + 528.5[2] ppm OR-CT[3] mixed | 54.52(+1.34) |
| Baseline fuel No. 2 diesel | 40.5 |
| No. 2 diesel fuel with 300[4] ppm 2-EHN[6] only | 43.02 |
| No. 2 diesel fuel with 300[4] ppm OR-CT[3] only | 41.48 |
| No. 2 diesel fuel with 150[5] ppm 2-EHN[6] + 150[3] ppm OR-CT[3] mixed | 43.34(+0.32) |

[1]= 4 milliliters per gallon
[2]= 2 milliliters per gallon
[3]= $1 \times 10^6$ IU β-carotene
[4]= 1.14 milliliters per gallon
[5]= 0.57 milliliters per gallon
[6]= 2-ethylhexyl nitrate It has been observed that cetane may be synergistically improved by combining di-tert-butyl peroxide with β-carotene in a cetane improver. An unexpected reduction in particulate matter (PM) was also observed.

It may be preferred in certain embodiments of the cetane improver to include as additional additives one or more plant oil extracts such as oil extract of vetch and/or thermal stabilizers such as jojoba oil, or to use as a cetane improving fuel additive an additive combination suitable for use in gasoline, diesel, or other hydrocarbon fuels as described in the preferred embodiments herein.

Additive for Coal

A solution consisting of the following components was made in the laboratory and applied to Coal received from China. 12 grams of 30% β-carotene in peanut oil was dissolved in 100 milliliters of toluene. In this same solution was dissolved 5 grams of oil extract of vetch and 2 milliliters of jojoba oil. Toluene was added to yield 4000 milliliters of solution. Six samples were prepared. Three samples contained additized coal (Samples 4, 5, and 6). An additional three samples consisted of unadditized coal (Samples 1, 2, and 3). The coal tested was from two different places in China. Samples 1, 2, 4, and 5 originated from the Wan Li coalfields and samples 3 and 6 originated from the Wu Da coalfields in Inner Mongolia. The samples as received were mixed as thoroughly as possible by hand and then 100 grams of this coal material were separated from the mixed coal amount as a representative sample. Those representative samples were then spray treated at a treat rate corresponding to approximately 3.8 to 11.4 liters of the above-described liquid mixture per 1000 kg of coal. These samples were then forwarded to Commercial Testing Laboratories in San Pedro, Calif. for a short proximate analysis test procedure. The test is an ASTM procedure for identifying the physical characteristics of coal. The testing was performed on both an "as received" basis and a "dry" basis. Table 24 provides test results, including percent moisture, percent ash, percent sulfur, and energy content in Btu/lb.

TABLE 24

| | Parameter | As Received | Dry Basis |
|---|---|---|---|
| Sample 1-baseline (Wan Li) | % Moisture | 31.06 | — |
| | % Ash | 10.57 | 15.33 |
| | Btu/lb. | 7519 | 10907 |
| | % Sulfur | 1.49 | 2.16 |
| Sample 2-baseline (Wan Li) | % Moisture | 3.34 | — |
| | % Ash | 17.48 | 18.08 |
| | Btu/lb. | 11685 | 12089 |
| | % Sulfur | 3.97 | 4.11 |
| Sample 3-baseline (Wu Da) | % Moisture | 31.12 | — |
| | % Ash | 10.52 | 15.27 |
| | Btu/lb. | 7555 | 10968 |
| | % Sulfur | 1.65 | 2.39 |
| Sample 4-treated (Wan Li) | % Moisture | 33.91 | — |
| | % Ash | 9.46 | 14.31 |
| | Btu/lb. | 11034 | 16696 |
| | % Sulfur | 0.68 | 1.03 |
| Sample 5-treated (Wan Li) | % Moisture | 16.89 | — |
| | % Ash | 13.94 | 16.77 |
| | Btu/lb. | 14123 | 16993 |
| | % Sulfur | 2.58 | 3.11 |
| Sample 6-treated (Wu Da) | % Moisture | 35.85 | — |
| | % Ash | 8.54 | 13.31 |
| | Btu/lb. | 10879 | 16958 |
| | % Sulfur | 0.49 | 0.76 |

Although the above additive levels may be preferred for certain embodiments, in other embodiments it may be preferred to have other additive levels. For example, the additive may be present at about 1 ml or less up to about 20 liters or more per 1000 kg of unadditized coal, preferably at about 2 ml, 2.5 ml, 3 ml, 3.5 ml, 4 ml, 4.5 ml, 5 ml, 6 ml, 7 ml, 8 ml, 9 ml, 10 ml, 11 ml, 12 ml, 13 ml, 14 ml, 15 ml, 20 ml, 30 ml, 40 ml, 50 ml, 100 ml, 200 ml, 300 ml, 400 ml, 500 ml, 600 ml, 700 ml, 800 ml, 900 ml, 1 liter, 2 liters, 3 liters, 4 liters, 5 liters, 6 liters, 7 liters, 8 liters, 9 liters, 10 liters, 11 liters, 12 liters, 13 liters, 14 liters, 15 liters, 16 liters, 17 liters, 18 liters, or 19 liters per 1000 kg of unadditized coal.

Jet Fuel Smoke Point Improvement

The following formulation of β-carotene, when added to or mixed with a suitable carrier, can be added to or mixed with jet fuel to increase the smoke point number of the fuel, as measured by the ASTM D-1322 smoke point test. A common concern with jet fuel is that a particular batch may be out of compliance with the stringent jet fuel specifications. By adding β-carotene to the jet fuel, the smoke point of the jet fuel may be improved without the need for additional refinery processing.

The β-carotene is preferably added to the fuel in the form of an additive mixture containing 4 grams of synthetic β-carotene or 10 grams of natural β-carotene, 3000 ml jet fuel, and sufficient toluene to yield 3785 ml additive mixture. The additive mixture is typically prepared by mixing β-carotene in a suitable volume of toluene or another carrier fluid under an inert atmosphere, such as a nitrogen atmosphere, then adding the β-carotene mixture to a base jet fuel. It is preferred that the additive mixture of β-carotene be maintained under inert atmosphere until use.

The additive mixture is typically added to the jet fuel at a treat rate of 2 ml to 6 ml per 3785 ml jet fuel. Typical increases in smoke point observed are from approximately 2 millimeters when using 2 ml additive per 3785 ml jet fuel to 6 millimeters when using 6 ml additive per 3785 ml jet fuel.

Smoke point is one of the major ASTM test procedures utilized by refineries to determine if the jet fuel meets specification. The addition of the additive to the jet fuel increases the smoke point of the jet fuel such that it meets specification. This allows the jet fuel to pass a final inspection without first undergoing more severe refinery processing, such as processing to remove aromatics from the jet fuel, thereby allowing the refinery to produce jet fuel in compliance with ASTM regulations in a cost effective manner when the smoke point exceeds tolerance. The alternative is for the refinery to send the Jet back into processing, a more expensive alternative.

The following ASTM D-1322 smoke point test results were obtained for neat standard jet fuel and the same fuel treated with the additive mixture described above at various treat rates. Substantial increases in smoke point were observed for the treated jet fuels. Test results suggest that a maximum increase in smoke point may be obtained at a treat rate of 6 ml per 3785 ml treated jet fuel, with no substantial additional increase in smoke point observed at higher treat rates.

TABLE 25

| Base Fuel | Treat Rate (per 3785 ml additized fuel) | Smoke Point | Change Over Baseline |
|---|---|---|---|
| A | 0 | 20.0 mm | — |
| A | 1 ml | 23.5 mm | +3.5 |
| B | 0 | 19.5 mm | — |
| B | 1 ml | 21.0 mm | +1.5 |
| C | 0 | 20.0 mm | — |
| C | 0 | 20.0 mm | — |
| D | 4 ml | 24.5 mm | +4.5 |
| D | 6 ml | 25.0 mm | +5.0 |
| E | 4 ml | 24.5 mm | +4.5 |
| E | 6 ml | 25.0 mm | +5.0 |
| F | 0 | 20.0 mm | — |
| F | 0 | 20.0 mm | — |
| G | 8 ml | 25.0 mm | +5.0 |
| G | 8 ml | 25.0 mm | +5.0 |
| H | 8 ml | 25.0 mm | +5.0 |
| H | 8 ml | 25.0 mm | +5.0 |

While the above additive levels may be preferred for certain jet fuel formulations, in various other jet fuel formulations other additive levels may be preferred, for example, the additive may be present at about 0.1 ml or less up to about 20 ml or more, preferably at about 0.5, 1, 1.5, 2, 2.5, 3, 3.5, 4, 4.5, 5, 6, 7, 8, 9, 10, 11, 12, 13, 14, 15, 16, 17, 18, or 19 ml per 3785 ml of additized jet fuel. Moreover, it may be preferred in certain embodiments to include as additional additives one or more plant oil extracts such as oil extract of vetch and/or thermal stabilizers such as jojoba oil, or to use as a jet fuel additive an additive combination suitable for use in gasoline, diesel, or other hydrocarbon fuels as described in the preferred embodiments herein.

Emissions Testing—Gasoline Vehicles

Figure 3:
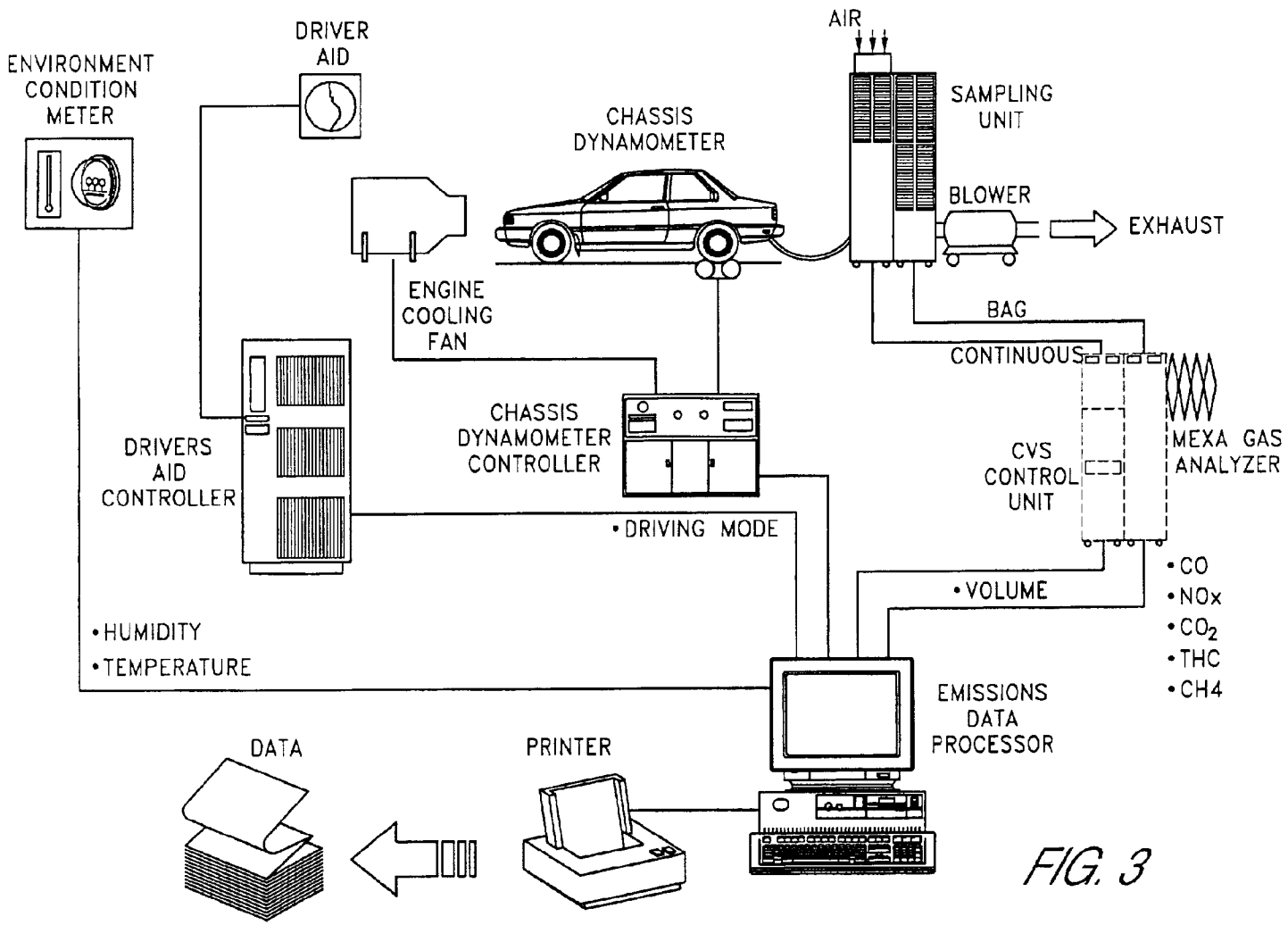
FIG. 3 provides a schematic illustrating the layout of the Vehicle Emissions Testing Laboratory located in Section 27, Selangor Darul Ehsan, Shah Alam, Malaysia.

"Cold-Start and Hot-Start" emissions tests of a European CEC-RF-08-A-85 Reference fuel (both additized and unadditized) using two different models of PROTON WIRA vehicles were conducted. The tests were conducted for Malaysia Canada Development Corporation Sdn. Bhd. (MCDC) with close supervision by Standards and Industrial Research Institute of Malaysia (SIRIM). The tests were conducted at the PETRONAS Research & Scientific Services Sdn. Bhd. (PRSS) Vehicle Emissions Testing Laboratory located in Section 27, Selangor Darul Ehsan, Shah Alam, Malaysia. A schematic illustrating the layout of the vehicle emissions testing equipment is provided in FIG. 3.

The test vehicles included two different models of PROTON WIRA, namely PROTON WIRA 1.6XLi Aeroback-Multipoint injection (Automatic) and PROTON WIRA 1.6XLi Sedan-Multipoint injection equipped with catalytic converter (Automatic) gasoline vehicles. Each test vehicle was tested at cold and hot starting using untreated and treated reference fuel. The baseline emissions of each vehicle were established based on the untreated reference fuel emissions measurement.

The testing program for the emissions evaluation was carried out according to the following test modes provided in Table 26.

TABLE 26

| TEST VEHICLE | TEST MODES |
|---|---|
| Test vehicle 1 (Multipoint injection) | Cold-start emissions test using untreated Reference fuel<br>Cold-start emissions test using Reference fuel treated with CEM Catalyst Fuel System. |
| Test vehicle 2 (Multipoint injection equipped with catalytic converter) | Hot-start emissions test using untreated Reference fuel.<br>Hot-start emissions test using Reference fuel treated with CEM Catalyst Fuel System. |

Figure 4:
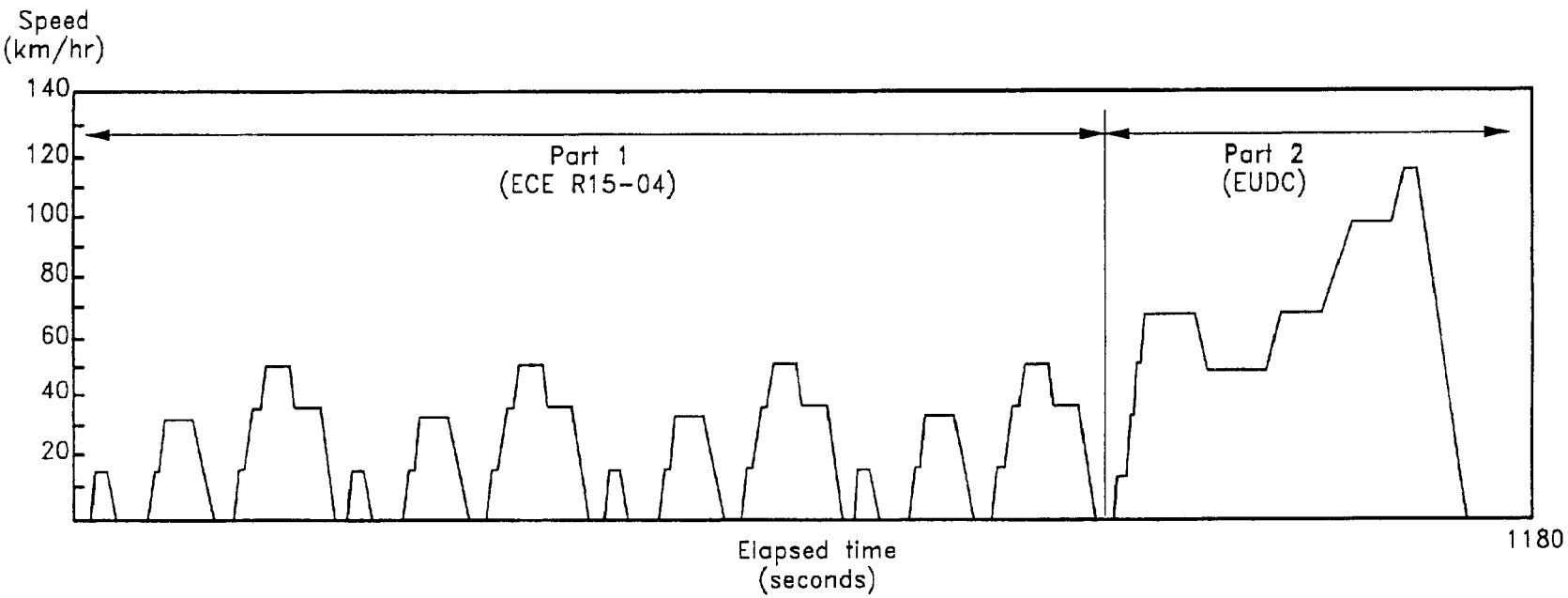
FIG. 4 provides a diagram illustrating the European Emissions Standard ECE R15-04 plus EUDC Emissions Test Cycle.
Figure 5:
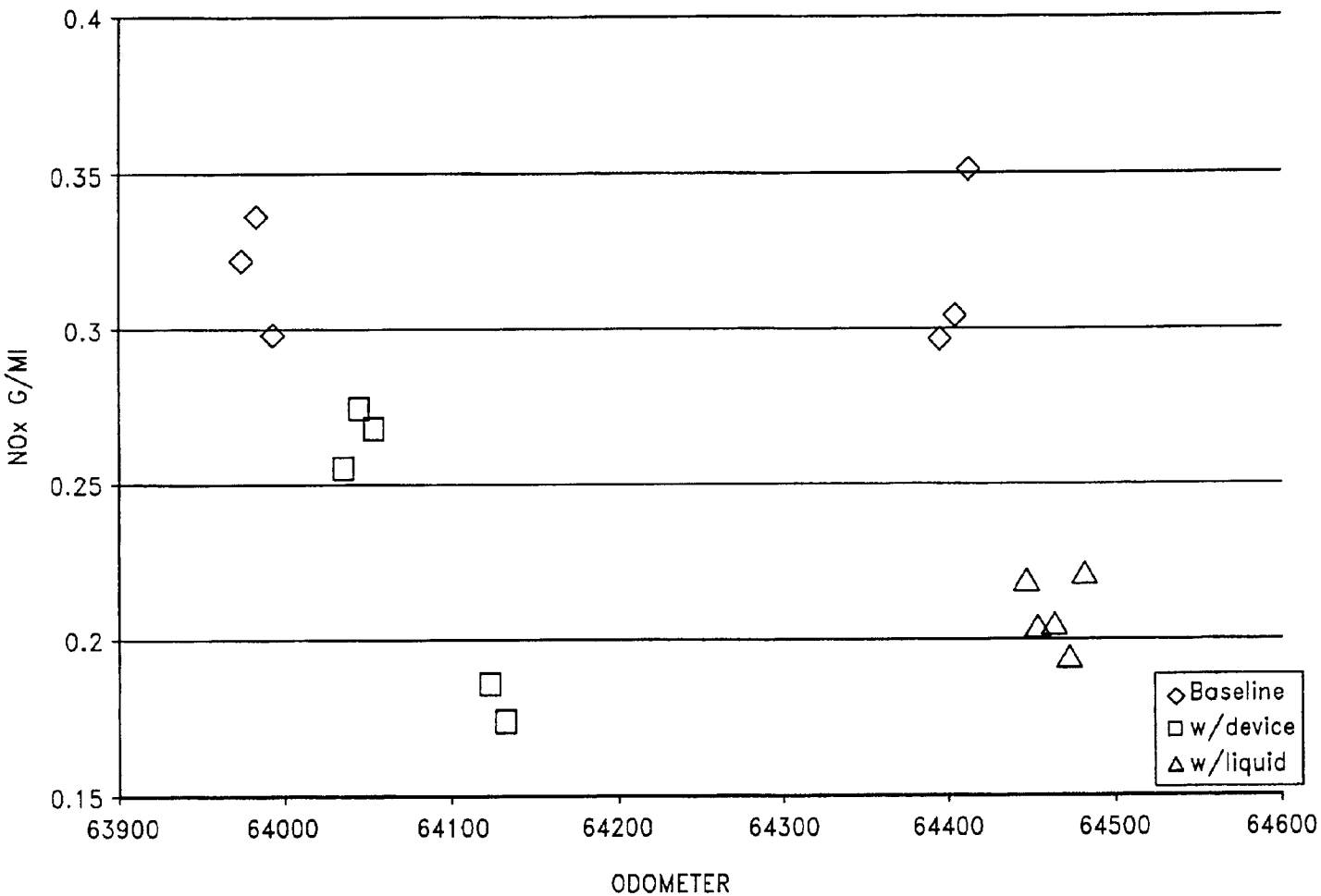
FIG. 5 provides $NO_x$ emissions as a function of odometer miles for a Ford Taurus.
Figure 6:
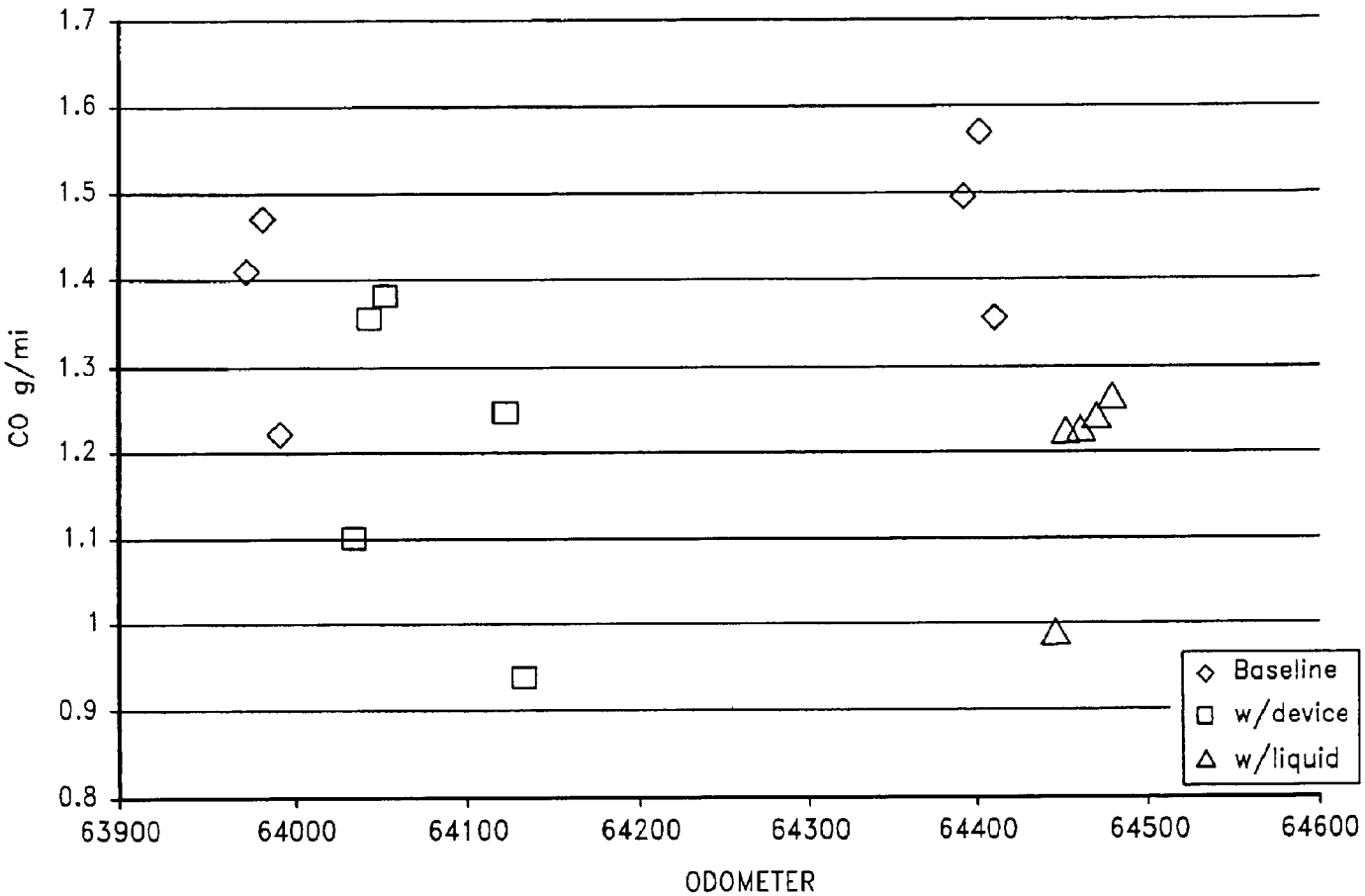
FIG. 6 provides CO emissions as a function of odometer miles for a Ford Taurus.
Figure 7:
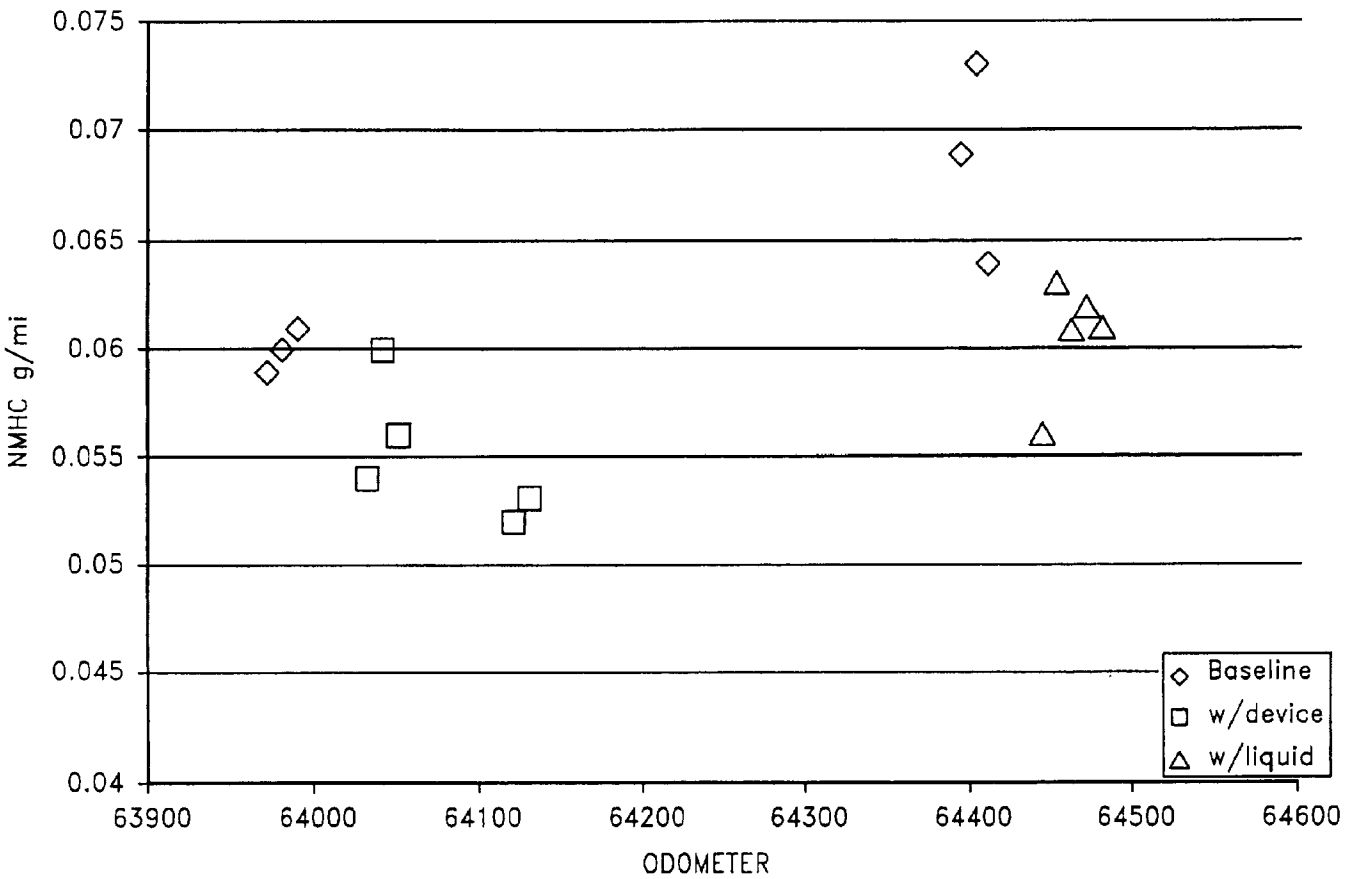
FIG. 7 provides NMHC emissions as a function of odometer miles for a Ford Taurus.
Figure 8:
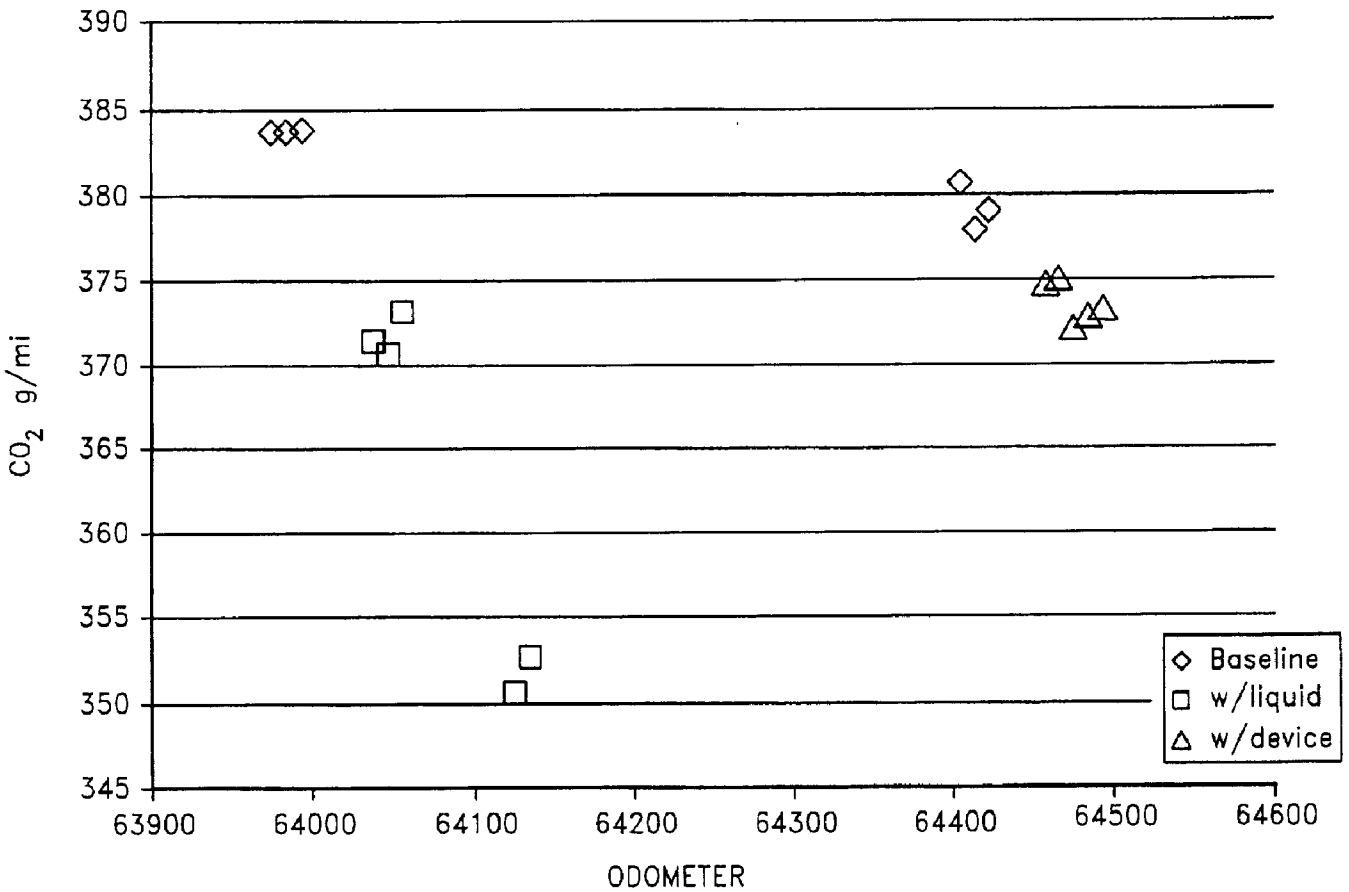
FIG. 8 provides $CO_2$ emissions as a function of odometer miles for a Ford Taurus.
Figure 9:
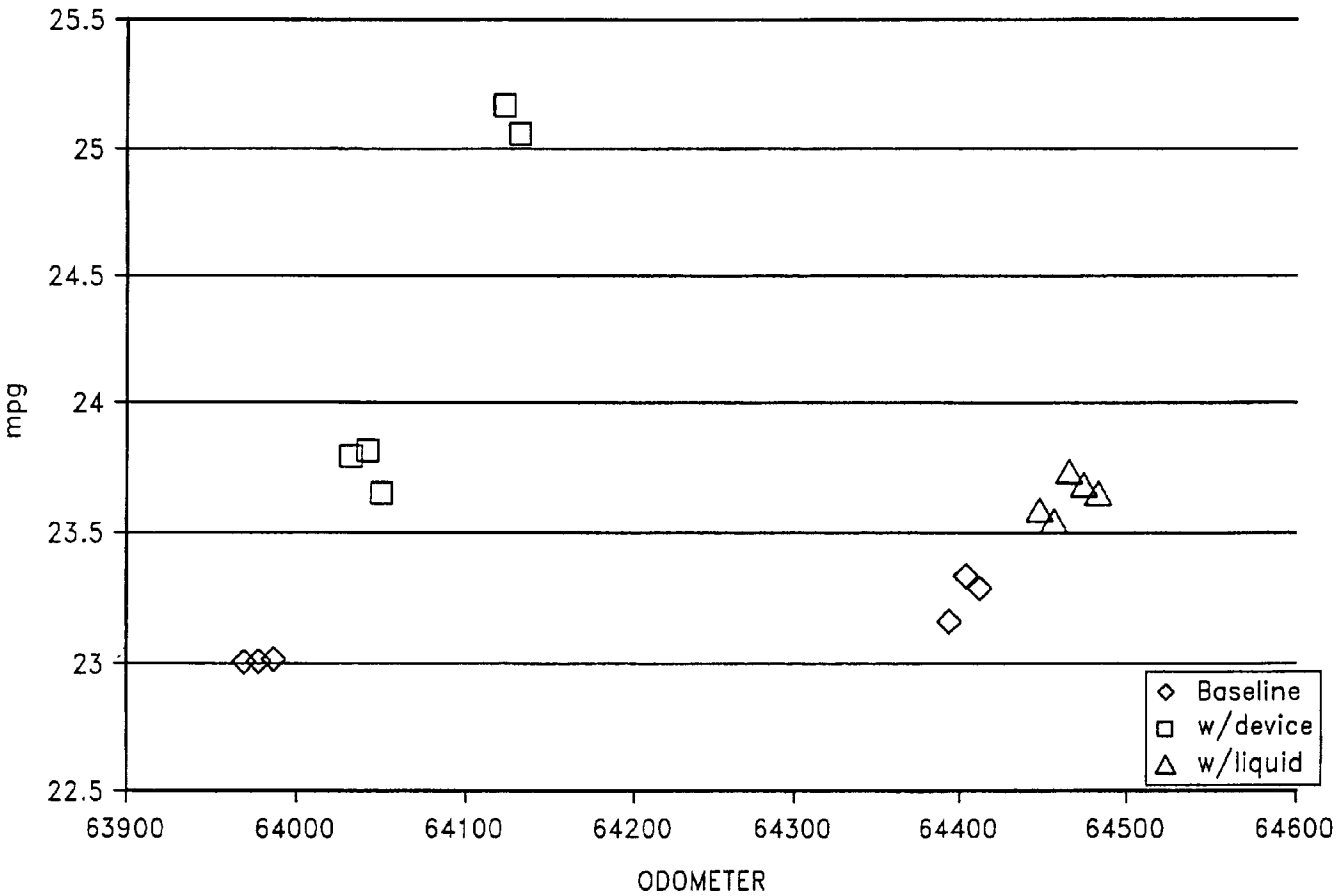
FIG. 9 provides mpg fuel economy as a function of odometer miles for a Ford Taurus.
Figure 10:
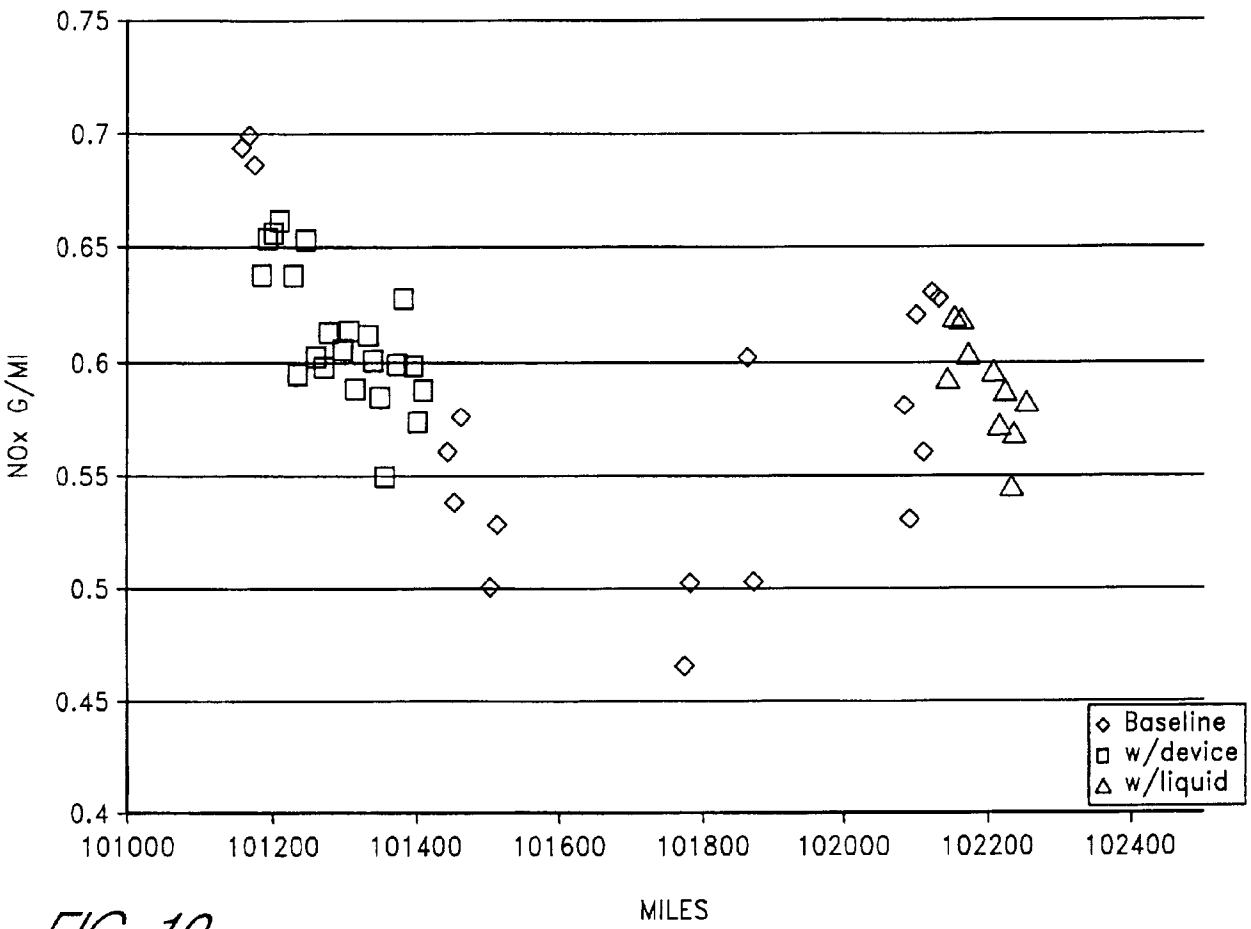
FIG. 10 provides $NO_x$ emissions as a function of odometer miles for a Honda Accord.
Figure 11:
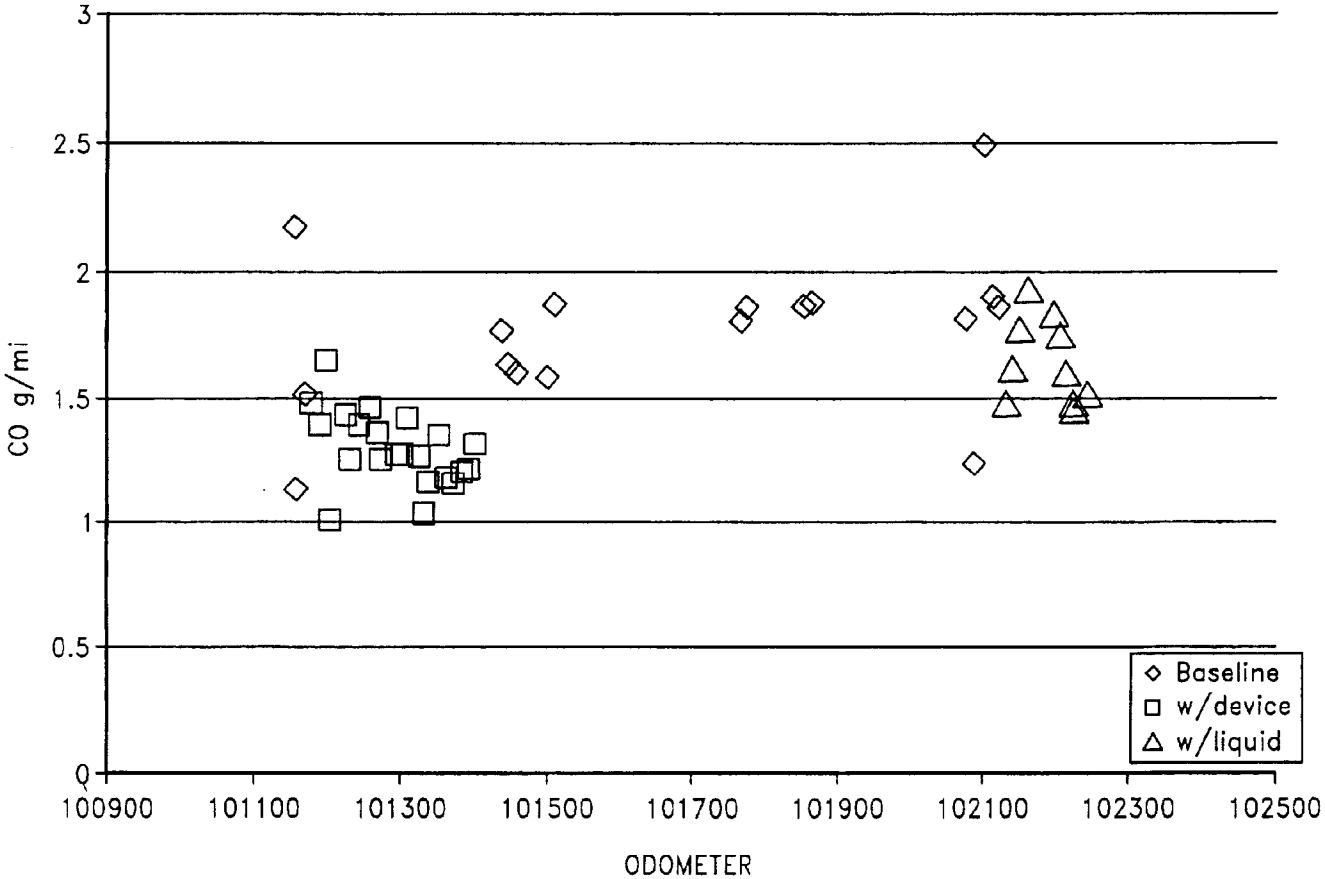
FIG. 11 provides CO emissions as a function of odometer miles for a Honda Accord.
Figure 12:
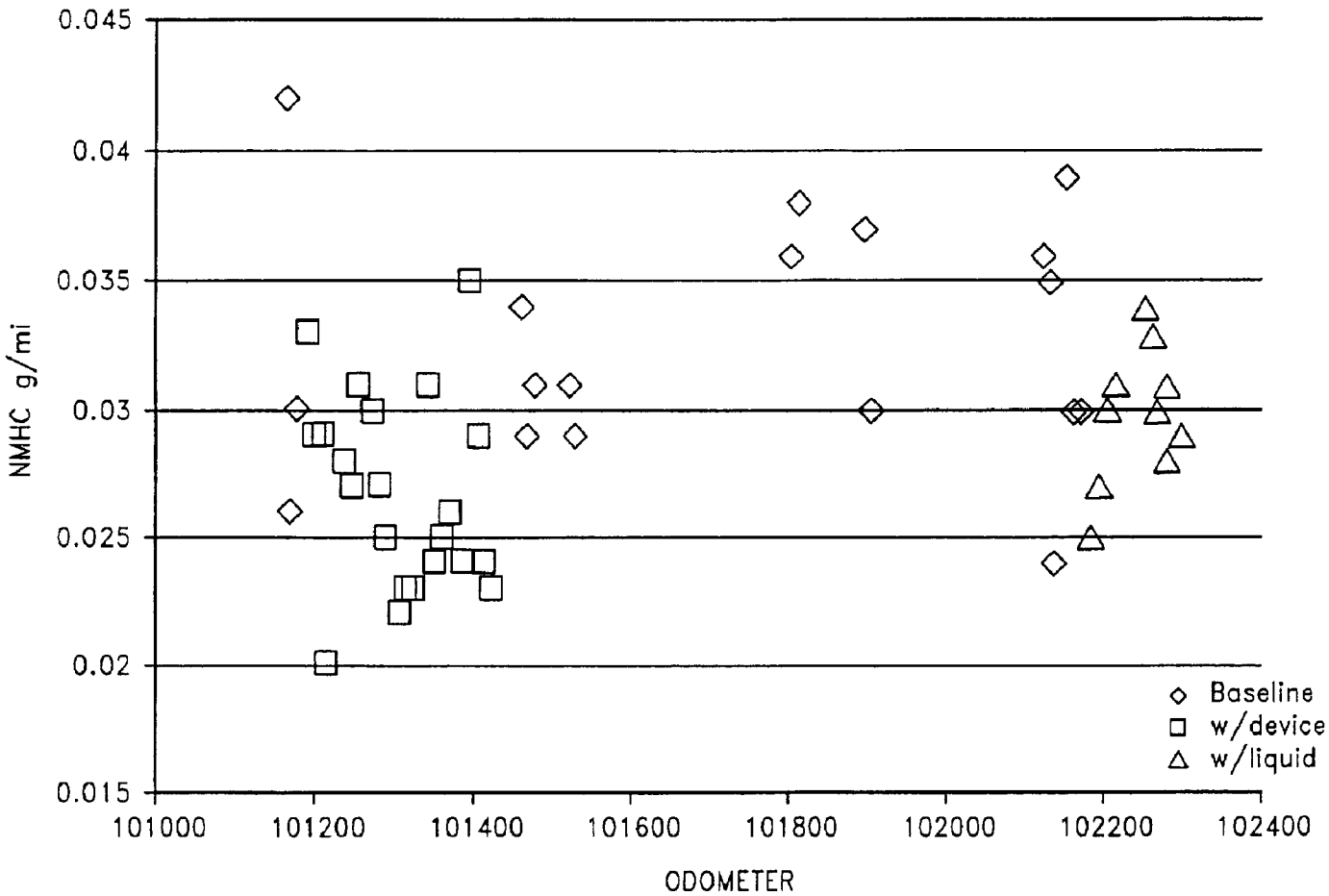
FIG. 12 provides NMHC emissions as a function of odometer miles for a Honda Accord.
Figure 13:
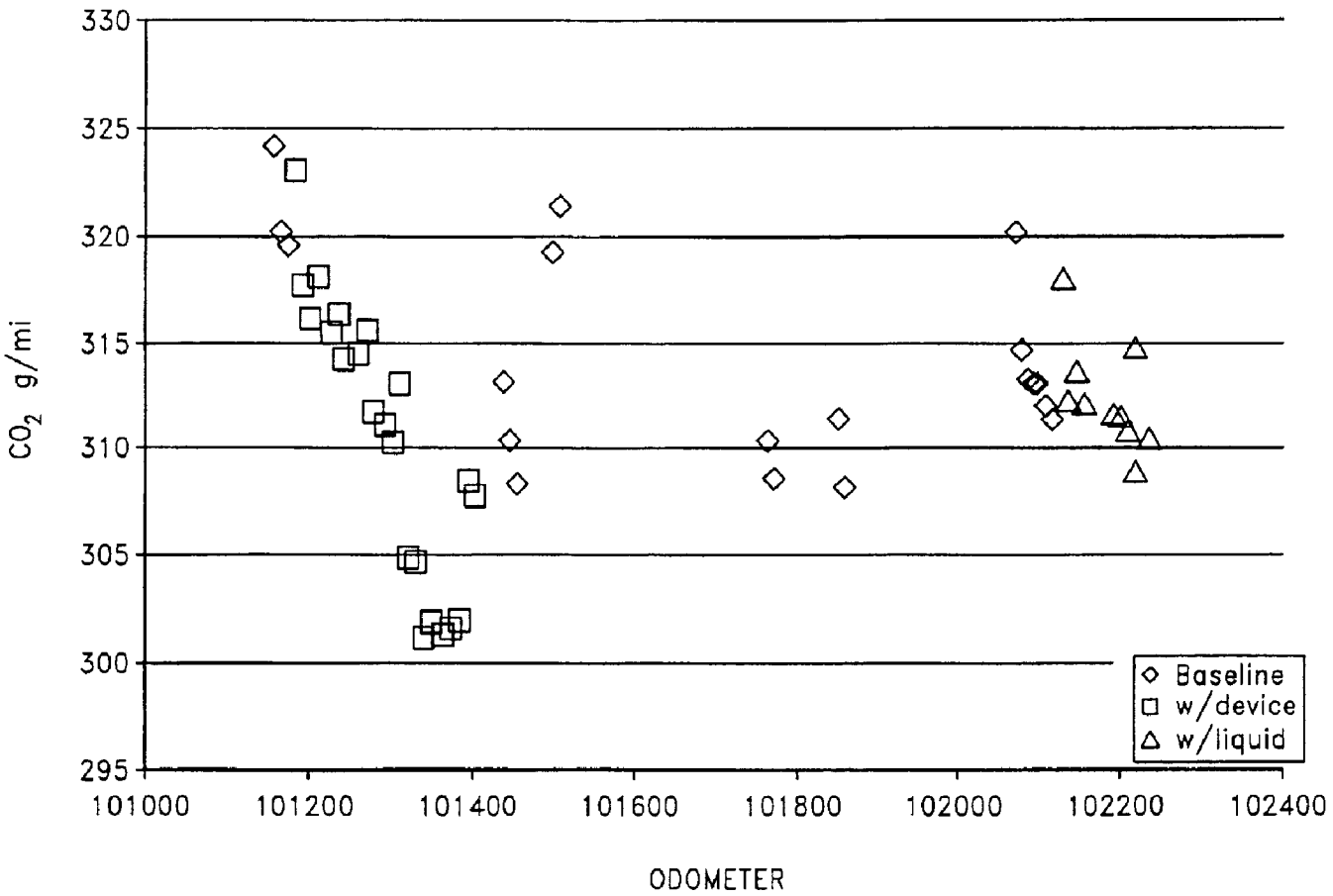
FIG. 13 provides $CO_2$ emissions as a function of odometer miles for a Honda Accord.
Figure 14:
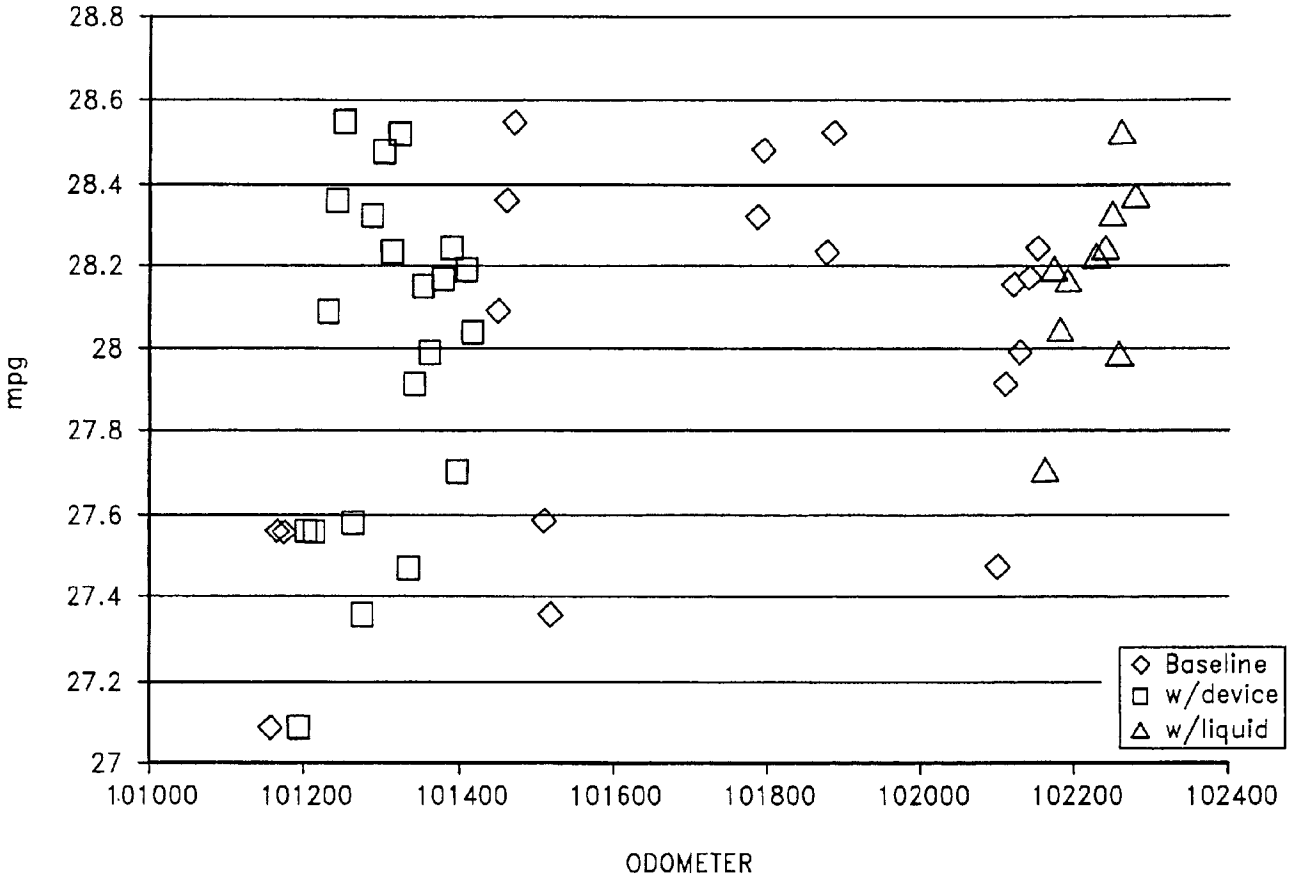
FIG. 14 provides mpg fuel economy as a function of odometer miles for a Honda Accord.
Figure 15:
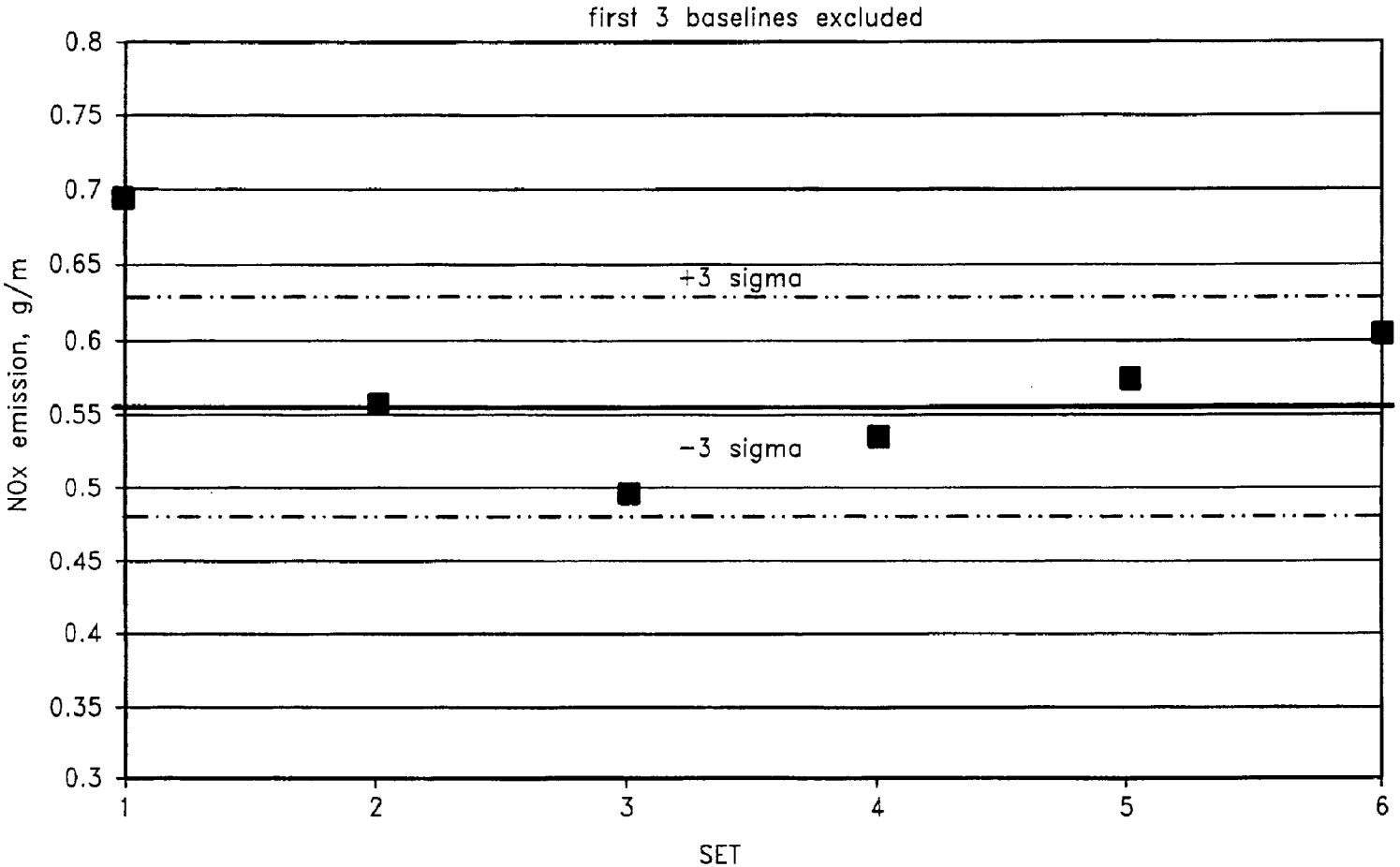
FIG. 15 provides a Shewhart Control Plot for $NO_x$ in the Honda Accord with the first three baselines excluded.
Figure 16:
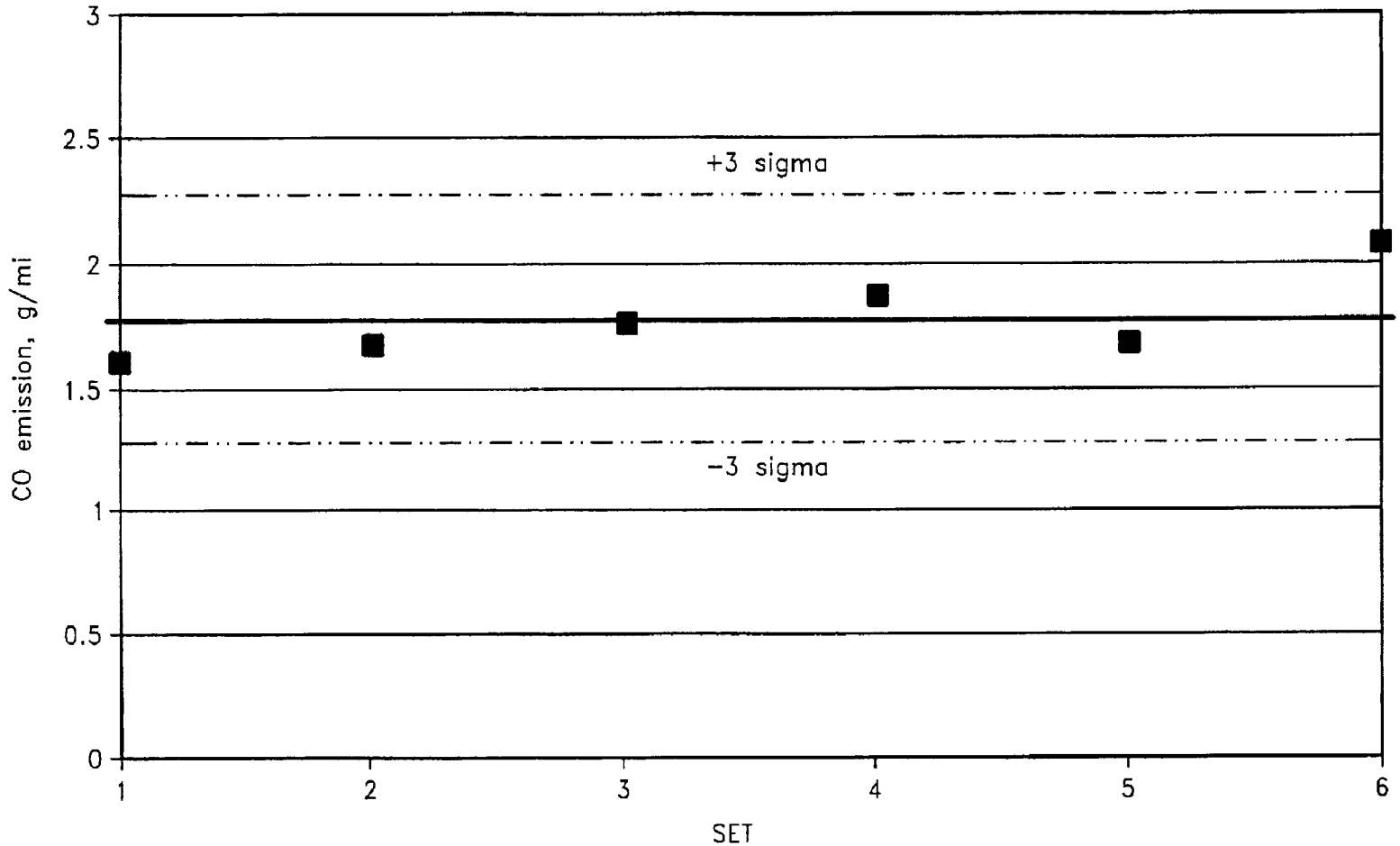
FIG. 16 provides a Shewhart Control Plot for CO in the Honda Accord with the first three baselines excluded.
Figure 17:
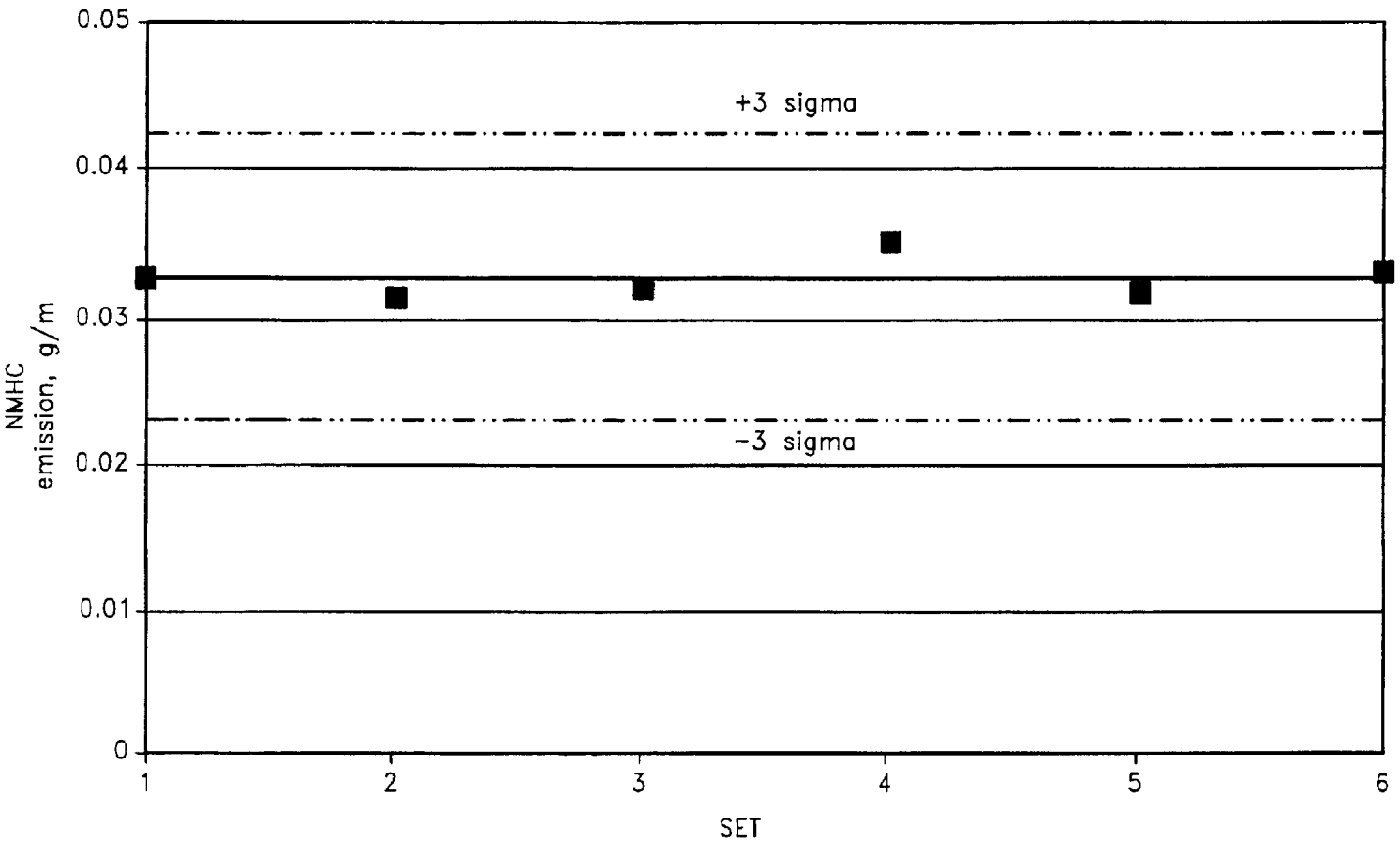
FIG. 17 provides a Shewhart Control Plot for NMHC in the Honda Accord with the first three baselines excluded.
Figure 18:
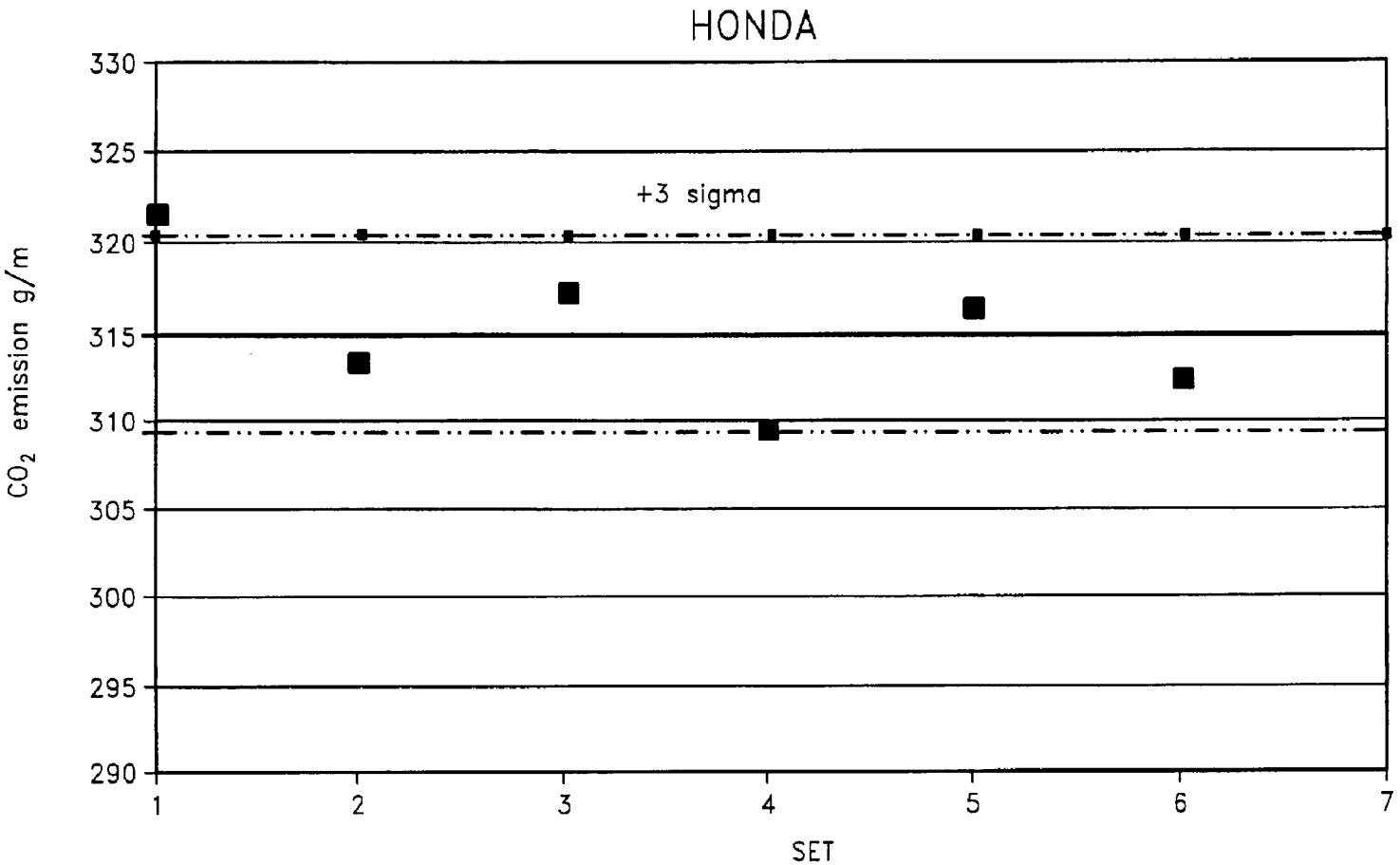
FIG. 18 provides a Shewhart Control Plot for $CO_2$ in the Honda Accord with the first three baselines excluded.
Figure 19:
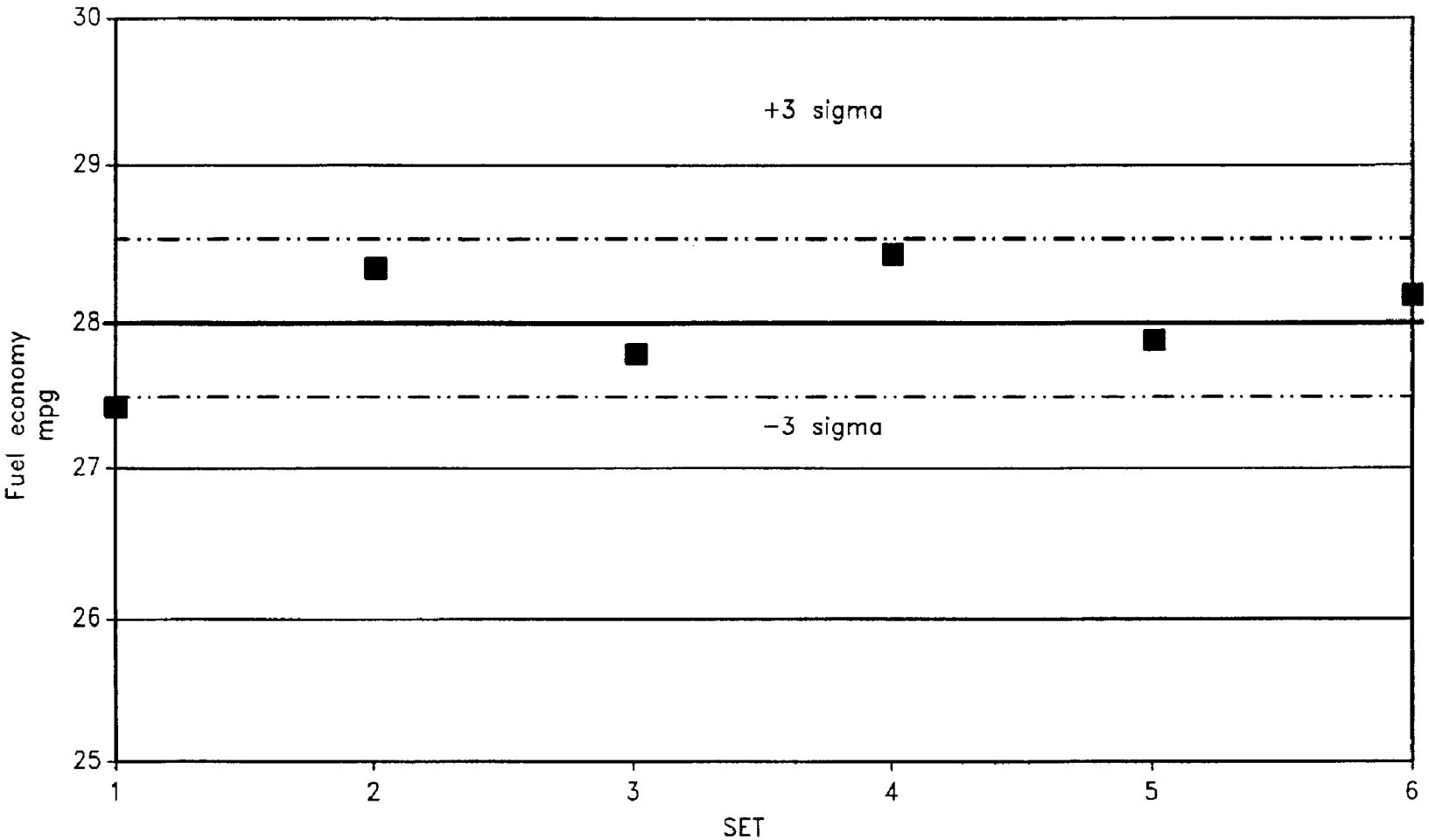
FIG. 19 provides a Shewhart Control Plot for mpg fuel economy in the Honda Accord with the first three baselines excluded.

In the testing program, the latest European Emissions Standard ECE R15-04 plus EUDC test cycle were used to establish the mass of each exhaust component emitted during the test. The ECE R15-04 plus EUDC test cycle were used in the evaluation since there is an indication by the Malaysian government to adopt the European Emissions Standard for Malaysia. A diagram illustrating the European Emissions Standard ECE R15-04 plus EUDC Emissions Test Cycle is provided in FIG. 4.

The European Emissions Standard test cycle is made up of two parts. Part One is define as an Urban test cycle, which represent city-center driving, whereas Part Two of the emissions test cycle is known as the Extra-urban driving cycle. The total cumulative time and vehicle travelling distance for complete Part One and Part Two test cycles were 1,180 seconds and 1 1,007 km, respectively.

The vehicle emissions test procedures were divided into three distinct segments. Each test vehicle was subjected to the following sequence:

Pre-Condition Checks—Prior to emissions testing, the pre-condition checks and their "state of tune" of the test vehicle were assessed. The ignition system (spark plugs, high-tension leads, and the like), ignition timing, engine cooling system and air filter cleaner element conditions were checked and replaced when necessary. This was done in order to ensure that the vehicle was in good conditions and meet the requirements of the engine manufacturer. The results of the Pre-Condition Checks of the two vehicles are as shown in Table 27 below.

TABLE 27

Engine Pre-Condition Checks

| | | Vehicle 1 | Vehicle 2 |
|---|---|---|---|
| 1. | BATTERY/STARTER | | |
| 1.1 | Battery voltage | Pass | Pass |
| 1.2 | Cranking volts | Pass | Pass |
| 1.3 | Cranking speed | Pass | Pass |
| 2. | COIL/LEADS/PLUGS | | |
| 2.1 | Spark plugs | Pass | Pass |
| 2.2 | High tension lead resistance condition | Pass | Pass |
| 3. | FUEL INJECTION | | |
| 3.1 | Air filter check | Pass | Pass |

TABLE 27-continued

Engine Pre-Condition Checks

| | | Vehicle 1 | Vehicle 2 |
|---|---|---|---|
| 3.2 | Fuel filter check | Pass | Pass |
| 3.3 | Injectors condition | Pass | Pass |
| 3.4 | Injectors operation | Pass | Pass |
| 3.5 | Throttle shaft | Pass | Pass |
| 4. | DISTRIBUTOR | | |
| 4.1 | Static timing | Pass | Pass |
| 4.2 | Rotor condition | Pass | Pass |
| 4.3 | Cap condition | Pass | Pass |
| 4.4 | Electronic ignition condition | Pass | Pass |
| 4.5 | Vacuum advance operation | Pass | Pass |
| 5. | ENGINE COOLING SYSTEM | Pass | Pass |
| | REMARKS | GOOD CONDITION | GOOD CONDITION |

Soaking of Test Vehicle—The test vehicle was then allowed to soak in a test laboratory for at least six hours at a test temperature of 20 to 30° C. This was done in the preparation of a so-called "cold-start" test.

Exhaust Emissions Tests—The test vehicle was then started and allowed to idle for 40 seconds. The vehicle was then driven in accordance to ECE R15-04 plus EUDC on the chassis dynamometer which has been pre-set to a "fixed load curve" to produce level road load conditions (simulating the wind resistance, frictional forces, etc. as experienced by the car on the road). During the test period, the diluted exhaust gas was continuously sampled at a constant rate. This diluted exhaust sample and a concurrent sample of the dilution air were collected into sampling bags for the subsequent analysis at an analytical bench.

In addition, the hot-start emissions test was also conducted (engine at normal operating temperature during starting) upon completion of cold-start emissions test. The measured emissions included carbon monoxide (g/km); carbon dioxide (g/cm); total hydrocarbon (g/km); and oxides of nitrogen (g/km).

The vehicle exhaust gas emissions test was conducted in a Vehicle Emissions Testing Laboratory. The laboratory contained the following equipment:

HORIBA MEXA 9000 SERIES Exhaust Gas Analyzers and Sampling System—This equipment was used to sample and measure the levels of exhaust gases emitted from the test vehicles. The system is designed to accommodate the necessary analyzers for measuring the total hydrocarbons (THC), carbon monoxide (CO), carbon dioxide ($CO_2$), and oxides of nitrogen ($NO_x$). The THC was analyzed by flame ionization detector (FID), CO and $CO_2$, by non-dispersive infrared (NDIR) analyzer, and $NO_x$ by chemiluminescent (CL) analyzer.

SYSTEM III CLAYTON DC80 Chassis Dynamometer—The chassis dynamometer was used to simulate road load driving condition by setting the appropriate inertia and load for the test vehicle reference weight. This simulation equivalent inertia weight method is permitted by the Regulation ECE-15.

The properties of the Standard European Reference Fuel CEC-RF-08-A-85 used as a baseline fuel in the testing is provided in the following table.

TABLE 28

Specifications of the European CEC-08-A-85 Reference Fuel.

| NO. | PROPERTIES | ASTM METHOD | FUEL SAMPLE | CEC-08-A-86 REFERENCE FUEL SPECIFICATION Minimum | Maximum |
|---|---|---|---|---|---|
| 1 | Research Octane Number (RON) | D 2699 | 97.8 | 95.0 | |
| 2 | Motor Octane Number (MON) | D 2700 | 87.4 | 85.0 | |
| 3 | Density at 15° C., kg/m$^3$ | D 1298 | 752.2 | 748.0 | 762.0 |
| 4 | Reid Vapor Pressure, bar | D 323 | 0.63 | 0.56 | 0.64 |
| 5 | Distillation: | D 86 | | | |
| | Initial boiling point, ° C. | | 31 | 24 | 40 |
| | 10% vol. point, ° C. | | 43 | 42 | 58 |
| | 50% vol. point, ° C. | | 106 | 90 | 110 |
| | 90% vol. point, ° C. | | 260 | 155 | 180 |
| | Final boiling point, ° C. | | 202 | 190 | 215 |
| 6 | Residue, % vol. | D 86 | 0.5 | | 2.0 |
| 7 | Hydrocarbon analysis: | by PONA | | | |
| | Olefin, % vol. | | 5.5 | | 20 |
| | Aromatic, % vol. | | 34.3 | | 45 |
| | Saturates, % vol. | | 60.2 | balance | |
| 8 | Oxidation Stability, min | D 525 | >1000 | 480 | |
| 9 | Existent Gum, mg/100 ml | D 381 | 0.2 | | 4.0 |
| 10 | Sulfur Content, % wt. | D 1266 | 0.0080 | | 0.04 |
| 11 | Copper Corrosion at 50° C. | D 130 | 1 a | | 1 |
| 12 | Lead Content, g/l | D 3237 | <0.0025 | | 0.0050 |
| 13 | Phosphorous Content, g/l | D 3231 | <0.0002 | | 0.0013 |

The additive formulations tested included the OR-1 Mexico low altitude formulation described above, additionally containing 2 milliliters of polyisobutylene per gallon of gasoline treated. Details of the test vehicles used in the ram are provided in Table 29.

TABLE 29

| NO. | SPECIFICATIONS | VEHICLE 1 | VEHICLE 2 |
|---|---|---|---|
| 1 | Model | PROTON WIRA | PROTON WIRA |
| 2 | Vehicle Type | Hatch-back | Sedan |
| 3 | Chassis No. | PL1C98LRRSB762361 | M-1_003F3 |
| 4 | Registration No. | WDY 9438 | W 1267 A |
| 5 | Drive Wheels | Front | Front |
| 6 | Engine | | |
| | Engine Model | 4G92 | 4G92 |
| | Engine No. | 4G29P CW 8386 | 4 G 92 AM9953 |

TABLE 29-continued

| NO. | SPECIFICATIONS | VEHICLE 1 | VEHICLE 2 |
|---|---|---|---|
| | Type | 4-cylinder-in-line | 4-cylinder-in-line |
| | Capacity | 1600 c.c. | 1600 c.c. |
| | Fuel System | Injection | Injection - cat. con. |
| | Ignition System | Electronic | Electronic |
| 7 | Transmission | | |
| | Gearbox Type | Automatic | Automatic |
| | No. of Gear Ratio | Five | Five |

Cold-Start Emissions Test Results are provided in Table 30.

TABLE 30

| TEST VEHICLE | TEST FUEL | ODOMETER (km) | EXHAUST GAS EMISSIONS (g/km) CO | $CO_2$ | THC | $NO_x$ |
|---|---|---|---|---|---|---|
| Vehicle 1 | Baseline | 31414 | 1.90 | 159 | 1.180 | 3.221 |
| | CEM Catalyst 1 | 31437 | 1.48 | 154 | 1.133 | 3.089 |
| | Percentage | Different | −22.11 | −3.14 | −3.98 | −4.10 |

TABLE 30-continued

| | | | EXHAUST GAS EMISSIONS (g/km) | | | |
|---|---|---|---|---|---|---|
| TEST VEHICLE | TEST FUEL | ODOMETER (km) | CO | $CO_2$ | THC | $NO_x$ |
| Vehicle 2 | Baseline | 94687 | 3.73 | 163 | 0.773 | 1.390 |
| | CEM Catalyst | 94698 | 3.23 | 163 | 0.778 | 1.368 |
| | Percentage Different | | −13.40 | n/c | n/c | −1.58 |

Hot-Start Emissions Test results are provided in Table 31.

TABLE 31

| | | | EXHAUST GAS EMISSIONS (g/km) | | | |
|---|---|---|---|---|---|---|
| TEST VEHICLE | TEST FUEL | ODOMETER (km) | CO | $CO_2$ | THC | $NO_x$ |
| Vehicle 1 | Baseline | 31459 | 1.39 | 145 | 1.058 | 3.230 |
| | CEM Catalyst | 31448 | 1.10 | 142 | 1.022 | 2.917 |
| | Percentage | Different | −20.86 | −2.07 | −3.40 | −9.69 |
| Vehicle 2 | Baseline | 94735 | 3.93 | 144 | 0.615 | 1.322 |
| | CEM Catalyst | 94724 | 1.81 | 146 | 0.403 | 1.026 |
| | Percentage | Different | −53.94 | +1.39 | −34.47 | −22.39 |

The emissions data gathered were obtained on European CEC-RF-08-A-85 Reference Fuel tested using only one PROTON WIRA 1.6XLi Aeroback-Multipoint injection (Automatic) and PROTON WIRA 1.6XLi Sedan-Multipoint injection equipped with catalytic converter (Automatic). The overall emissions results show that there was a reduction in both the cold-start and hot-start emissions of the vehicles. For both vehicles, emissions reductions ranging up to 22% for CO, 3% for $CO_2$, 4% for THC, and 4% for $NO_x$ were observed in cold-start emissions testing whereas for the hot-start, reductions ranging up to 54% for CO, 2% for $CO_2$, 34% for THC, and 22% for $NO_x$, were recorded. No change in $CO_2$ emissions was observed at the cold-start of PROTON WIRA 1.6XLi Multipoint injection fitted with a catalytic converter. However, there was a slight increased of $CO_2$ (1.4%) during the hot-start. On the multipoint injection vehicle, no change in $CO_2$ emissions was observed either at the cold or hot-start.

Emissions testing—Gasoline Vehicles

The Colorado School of Mines/Colorado Institute for Fuels and High Altitude Engine Research validated test results and confirmed performance levels for a fuel additive device and liquid fuel additive as described above.

The analysis was based on the results of approximately sixty Hot 505 runs, conducted on a 1989 Honda Accord and a 1990 Ford Taurus, at Environmental Testing Corporation in Orange, California. The Honda had approximately 101,000 odometer miles at the start of the testing and had a carburetor fuel system. The Ford had approximately 64,000 odometer miles at the start of the testing and had a port fuel injection fuel system. Results for emissions of $NO_x$, CO, $CO_2$, non-methane hydrocarbon (NMHC), as well as fuel economy in miles per gallon (mpg) were analyzed.

Emissions and fuel economy testing was performed at Environmental Testing Corporation (ETC) in Orange, Calif. The data set consists of a series of emissions and fuel economy results from the Hot 505 Phase of the Federal Test Procedure. The Hot 505 test is so called because it lasts exactly 505 seconds, and is performed on a vehicle at peak operating temperature with the catalytic converter operating at optimum. Immediately prior to the test, the vehicle was run at 50 mph for 5 minutes, brought to a stop, and idled for 20 seconds. Samples were continuously acquired through a constant volume sampler, and stored in a tedlar bag for analysis immediately at the end of the test. Five gas analyzers were used to determine the concentration of the sample: total hydrocarbon (THC), carbon monoxide (CO), oxides of nitrogen ($NO_x$), carbon dioxide ($CO_2$), and methane ($CH_4$). The fuel economy, or miles per gallon (mpg), is calculated from the concentration of $CO_2$. The concentration of regulated emission of non-methane hydrocarbon (NMHC) is calculated by difference from the concentration of THC and $CH_4$. Calibrations on all instruments, using the same set of 1% NIST traceable span gases, were performed every 30 days as well as weekly diagnostic tests. All reported emissions values were good to within an accuracy of ±5%.

All the tests were performed with the same chassis dynamometer and the same emission system, which was set up the same way for each run as prescribed by CARB and EPA (as described in the Code of Federal Regulations or CFR) procedures. This included checking the tire pressure of the car and all appropriate settings of the emission system. A control vehicle was not used to verify that there was no drift in the measurements. No precautions were taken to randomize the tests, in part because it was believed that the additive may have a "memory." That is, the effect of the additive may be observed for some time after removal of the device from the vehicle or additive from the fuel. No observations on ping, knock, misfire, and the like, either with or without the device installed, were recorded.

The Base Fuel—The base fuel used was indolene from the same lot. The octane number of the indolene used in this study was 92.1 ([R+M]/2). The fuel in the vehicle was replaced with fresh indolene after each series. ETC took custody of all the cars used throughout this set of tests, and had responsibility for installing the devices and adding the liquid additive. The same driver was used in every test. The only driver change occurred when the vehicle was driven for mileage accumulation to remove any additive "memory" and return to baseline (so-called "deconditioning"). Mileage accumulation utilized a predetermined route. No maintenance, including oil changes, was performed on the vehicles during the test program.

The Fuel Additive Device—In certain tests the base fuel was additized using a fuel additive device. The device is manufactured much like an in-line fuel filter. The housing is built of stainless steel with a small mesh wire cage fitted just inside the middle of the device. Different raw material are loaded into the wire cage, the cage is fitted inside of a stainless steel housing, and then a cap is electron beam welded to the housing to form one unit. The fuel additive device is then placed into the fuel line after the gasoline tank but before the fuel rail or carburetor, and immediately before the fuel filter. The flow pattern of gasoline is from the tank through the fuel additive device, through the fuel filter, into the fuel rail or carburetor, and then the fuel is atomized into the combustion chamber. Each time fuel passes through the device, a tiny amount of raw materials solubilize into the fuel.

The amount of mileage that may be accumulated on a vehicle before exhausting the raw materials in the fuel additive device may be calculated based on the gross amount of raw material loaded into the fuel additive device. For example, a fuel additive device with 54 grams of total raw material is typically able to last 10,000 miles when retrofitted onto a carburetor gasoline motor vehicle. When a fuel additive device containing 54 grams of raw material is retrofitted onto a fuel-injected car with recirculation of the fuel, the fuel additive device will typically last for over 6,000 miles.

The amount of mileage that may be accumulated before the additive is exhausted may be determined by a number of factors, including, but not limited to, the number of holes dilled into the stem pipe or the middle pipe that extends the length of the device. The middle pipe is approximately 8.7 cm long with a 1.3 cm outside, diameter. Each pipe is drilled with one or more holes having a diameter of 0.08 cm. Fuel additive devices were tested with one hole, two holes, three holes, and more (up to nine holes total) in the middle pipe. The preferred combination of emission reduction, improved fuel economy, and accumulated miles was observed for two or three holes having a diameter of 0.08 cm drilled into the pipe. All of the holes are preferably drilled into only one side of the pipe and open only from that side of the pipe to the middle of the pipe. Table 32 provides a description of each of the fuel additive devices tested.

TABLE 32

| Device # | Weight (g) | Additive |
|---|---|---|
| 1 | 25 grams | Oil extracted vetch |
| | 0.55 grams | Butylated hydroxytoluene (BHT) |
| | 0.75 grams | Curcumin |
| 2 | 25 grams | Oil extracted hops |
| | 1.0 grams | Vegetable Carotenoids (VC) (a mixture of α-carotene, additional carotenoids from *D. salina* algae: xeaxanthin, cyptoxanthin, lycopene and lutein. lutein from marigolds, lycopene from tomatoes, broccoli concentrate, spinach concentrate, tomato concentrate, kale powder, cabbage powders and Brussels sprouts powder). |
| | 1.0 grams | BHT |
| 3 | 25 grams | Oil extracted hops |
| | 1.5 grams | VC |
| | 1.0 grams | BHT |
| 4 | 25 grams | Oil extracted hops |
| | 1.5 grams | VC |
| | 1.5 grams | BHT |
| 5 | 25 grams | Oil extracted hops |
| | 2.0 grams | VC |
| | 1.5 grams | BHT |

TABLE 32-continued

| Device # | Weight (g) | Additive |
|---|---|---|
| 6 | 25 grams | Oil extracted vetch |
| | 2.0 grams | VC |
| | 2.0 grams | BHT |
| 7 | 25 grams | Oil extracted vetch |
| | 2.0 grams | VC |
| | 2.0 grams | BHT |
| | 1.0 gram | Curcumin |

The Liquid Fuel Additive—The liquid fuel additive included 4 grams of β-carotene, 2 grams of BHT, 6 milliliters of jojoba oil, and 19.21 grams of oil extracted vetch and/or oil extracted hops. The components were dissolved in toluene to provide 3785 milliliters of concentrated solution. 4 milliliters of this concentrated solution were added to the base fuel.

The Test Procedure—The test procedure was generally follows: initial testing to measure and verify repeatability of baseline emissions and fuel economy, installation of the fuel additive device; on road conditioning of approximately 30 miles before dynamometer testing; a series of independent Hot 505 test runs; removal of the fuel additive device from the vehicle, removal of the fuel from the fuel tank and replacement with fresh fuel; on road mileage accumulation of approximately 50 to 200 miles for deconditioning; and testing to verify that emissions and fuel economy had returned to baseline.

The additive (either in the fuel additive device or in the liquid additive) for each test was of the same formulation and from the same batch. The fuel additive device changes for the solid additive were mechanical in nature and only affected the dosage rate, not the composition of the additive. Other testing indicated that a single vehicle equipped with an additive delivery device consumed 41 g of solid additive over 1000 miles of driving at a fuel economy of 15.4 mpg. Based on these data, the dosage of additive in the fuel by the fuel additive device to that vehicle was estimated to average approximately 250 ppm. Based on this data, it can be concluded that the additive concentration in the tests reported was in the 100–1000 ppm range. The liquid additive was added at a level of 6 ml for each gallon of gasoline, or approximately 15 ppm.

Data were analyzed for a 1990 Ford Taurus (3.0 liter, fuel injected, 64,000 miles) and a 1989 Honda Accord (2.0 liter, engine carburetor, 101,000 miles). The Hot 505 test results are presented as a function of odometer mileage. Runs were conducted without the fuel additive device, with the fuel additive device installed, and with the liquid fuel additive as noted. Results for NMHC, CO, NO, and fuel economy are also provided.

Results for 1990 Ford Taurus—FIGS. 5 through 9 present results for $NO_x$, CO, NMHC, $CO_2$, (g/mi.) and fuel economy (mpg), respectively, as a function of odometer mileage. Three baseline runs were performed, followed by five runs with the additive delivery device installed, roughly 250 miles of "deconditioning" without the device, three additional baselines, then five runs using the liquid fuel additive. The Ford Taurus data suggests that both the device and the liquid fuel additive reduce pollutant emissions and increase fuel economy. Runs with the device suggest an increase in the effect with mileage. The Ford Taurus had a common rail fuel injection system. Thus, additive put into the fuel by the additive delivery device was recirculated back to the fuel tank. It is therefore possible that the additive concentration in the fuel continuously increased during the test sequence for this vehicle.

Results for 1989 Honda Accord—FIGS. 10 through 14 present results for $NO_x$, CO, NMHC, $CO_2$, (g/mi.) and fuel economy (mpg), respectively, as a function of odometer mileage. Three baseline runs were conducted, followed by a series of runs with the fuel additive device installed. In these runs, different devices were employed every few runs. The device numbers refer to the different fuel additive devices in Table 32. Following a sequence with the fuel additive device, five baseline runs were conducted followed by roughly 200 miles of deconditioning, then five baseline runs, roughly 200 miles of additional deconditioning, six additional baseline runs, then a series of runs with the liquid fuel additive. The data suggest a reduction in $NO_x$, emissions relative to the first set of baseline runs but not relative to all of the baseline runs taken together. Emissions of other pollutants do not appear to decrease for the device. Emissions of $NO_x$, however, apparently continued to decrease after removal of the device. The liquid additive did not appear to have a significant effect. Emissions from the Honda Accord appear to be much more variable than those from the Ford Taurus.

The test data was subject to statistical analysis to determine whether effects observed were statistically significant The approach to analyzing the test results taken was to assume that all baseline runs were true baselines and that all runs with the fuel additive device or liquid additive were representative of the effect. This assumes that the variation in baseline runs was random and simply a measurement of experimental error. This same assumption applies both to runs with the fuel additive device and the liquid additive. So-called "memory" effects, described above, were assumed to be unimportant.

In this approach, all baseline run emissions and fuel economy values were averaged and compared to averages obtained with the fuel additive device or liquid additive. These averages were compared for the Ford and Honda in Tables 33 and 34, respectively. Also reported with the average values is the percent change for operating with the fuel additive device or liquid additive relative to the baseline. The data were used to statistically test the hypothesis that there was no difference between emissions and fuel economy for the baseline runs and runs with the device or additive (the null hypothesis). The tables report the results of this test as a probability that the null hypothesis is true, or P-value. A small P-value indicates that the null hypothesis should be rejected and that there was a significant effect.

Examination of the results indicates that, under the assumptions of this analysis, there is little probability that the null hypothesis of no effect is true for the device. Thus, the device appears to result in reduced emissions of CO, $CO_2$, and NMHC, and improved fuel economy for both vehicles. For $NO_x$, the effect of the device was different with a decrease in the Ford but an increase in emissions for the Honda. For the fuel additive in the Ford Taurus there appears to be a real effect. For the fuel additive in the Honda, there is a significant probability that the liquid fuel additive had no effect. It is important to note that we have no information that allows us to conclusively assign the changes observed to the fuel additive. Insufficient tests were conducted and insufficient control data are available to allow a conclusion regarding cause and effect.

TABLE 33

Ford Basic Statistical Analysis

| | $NO_x$, g/mi. | CO, g/mi. | NMHC, g/mi. | $CO_2$, g/mi. | Mpg |
|---|---|---|---|---|---|
| baseline average | 0.318 | 1.418 | 0.064 | 381.4 | 23.13 |
| baseline standard deviation | 0.022 | 0.122 | 0.006 | 2.6 | 0.15 |
| w/device average | 0.231 | 1.201 | 0.055 | 363.6 | 24.30 |
| w/device standard deviation | 0.048 | 0.186 | 0.003 | 11.1 | 0.75 |
| w/device % change | −27.3 | −15.3 | −14.1 | −4.7% | +5.0 |
| P-value | 0.003 | 0.04 | 0.009 | 0.004 | 0.005 |
| Estimated Minimum Effect | −12.2% | −2.2% | −9.4% | −1.8% | +1.8% |
| w/liquid average | 0.208 | 1.191 | 0.061 | 373.4 | 23.65 |
| w/liquid standard deviation | 0.010 | 0.112 | 0.003 | 1.3 | 0.08 |
| w/liquid % change | −34.6 | −16.0 | −4.7 | 2.1% | 2.2 |
| P-value | <0.001 | <0.001 | 0.21 | <0.001 | <0.001 |

TABLE 34

Honda Basic Statistical Analysis

| | $NO_x$, g/mi. | CO, g/mi. | NMHC, g/mi. | $CO_2$, g/mi. | Mpg |
|---|---|---|---|---|---|
| baseline average | 0.577 | 1.776 | 0.033 | 314.4 | 27.98 |
| baseline standard deviation | 0.070 | 0.309 | 0.005 | 5.1 | 0.44 |
| w/device average | 0.610 | 1.293 | 0.027 | 310.5 | 28.41 |
| w/device standard deviation | 0.029 | 0.151 | 0.004 | 6.6 | 0.61 |
| w/device % change | +5.7 | −27.2 | −18.2 | −1.2% | +1.5 |
| P-value | 0.049 | <0.001 | <0.001 | <0.001 | 0.017 |
| Estimated Minimum Effect | +0.7% | −18.7% | −6.0% | 0 | 0 |
| w/liquid average | 0.588 | 1.640 | 0.030 | 312.4 | 28.17 |
| w/liquid standard deviation | 0.023 | 0.165 | 0.003 | 2.6 | 0.23 |
| w/liquid % change | 1.9 | −7.6 | −9.1 | 25.2% | 0.7 |
| P-value | 0.65 | 0.21 | 0.099 | 0.006 | 0.21 |

The analysis above is based on the assumption that variation in the baseline runs is random. That is, there is no "memory" effect and when the device or liquid additive is removed the engine quickly returns to baseline performance. To test this assumption, we have performed a Shewhart control plot statistical test for randomness, or equivalently, a test to see if the baseline runs are all sampled from the same population. The results are provided in FIGS. 15 through 19. Insufficient data are available for the Ford Taurus to perform this test so it was performed on the Honda Accord only. Points which fall within the dashed lines in the plots (3 standard deviations or 3 sigma) have a greater than 99% probability of having been sampled from the same population.

For $NO_x$ the initial baseline point is outside the three-sigma lines and the data are not randomly distributed around the average. Based on the Shewhart control plot, the $NO_x$ baseline points collected prior to testing with the device were excluded from the statistical analysis. For CO, NMHC, and fuel economy, the data are consistent with the three-sigma criterion and show a random variation about the mean. It can therefore be concluded that all baseline runs are from the same population and there is no "memory" of the device or additive. Based on all of the data, we suspect an error in the $NO_x$ measurements rather than "memory" of the device in the engine. The statistical analysis shown in Table 35 for the Honda $NO_x$, was repeated without the first three baseline runs and results are reported in Table 35. Rejection of these three points has no effect on the overall conclusions of the analysis.

TABLE 35

Honda $NO_x$ data without the first three baselines

| | $NO_x$, g/mi |
|---|---|
| baseline average | 0.554 |
| baseline standard deviation | 0.051 |
| w/device average | 0.610 |
| w/device standard deviation | 0.029 |
| w/device % change | +10.1 |
| P-value | <0.01 |
| Estimated Minimum Effect | +4.9% |
| w/liquid average | 0.588 |
| w/liquid standard deviation | 0.023 |
| w/liquid % change | 3.4 |
| P-value | 0.06 |

It is difficult to draw a conclusion regarding the average emissions reduction or fuel economy increase that might be expected using the additives of preferred embodiments because results for only two vehicles have been analyzed. However, the minimum improvement that might be realized may be estimated. The average emissions reduction plus one standard deviation, or the average fuel economy increase less one standard deviation is an estimate of the minimum improvement expected for the fuel additive device. These results are reported in Tables 33, 34, and 35 as estimated minimum effect. In some cases, the possibility of zero effect was encompassed by one standard deviation (namely, for the Honda Accord) and for these the estimated minimum effect is reported as zero. The average minimum effect for the two vehicles may be used as a global estimate, although there is considerable uncertainty in this approach given that it is only based on two vehicles. The average minimum emissions reduction and fuel economy improvements expected are: −10.5% for CO; −7.7% for NMHC; −1% for $CO_2$; and +1% for fuel economy.

As noted, the results indicate a significant positive effect of the additives of preferred embodiments on emissions of CO, $CO_2$, NMHC, and on fuel economy. The situation is ambiguous for $NO_x$. Given the small number of vehicles and the ±20% variation typically observed for light-duty vehicle emissions testing, the difference in emissions may not have been caused by the additive. To show cause and effect requires repeated cycles with and without the fuel additive device installed and requires better measures of day-to-day variability (for example, the use of a control vehicle). Testing of two different vehicle. technologies (carburetor and fuel injection) provides a better prediction, but two vehicles are too few to draw definitive conclusions. For example in the case of $NO_x$, the fact that one vehicle exhibited a decrease while the other exhibited an increase could be random error or could be caused by differences in fuel system technology.

Although only two vehicles were tested, it can be concluded that the fuel additive device reduces CO and NMHC, and increases fuel economy. A reduction in $NO_x$ may be observed, but the results are ambiguous because the Honda data exhibits significant drift. Clearly additional testing may be useful in quantifying the magnitude of the emissions and fuel economy effects as well as determining how these effects are altered by additive dosage level. It is noted that fuel economy was observed to increase while at the same time $NO_x$, decreased. This may be an effect of the additive, but could also result from human error or experimental factors. Such factors may include the dynamometer inertial load being incorrectly set, use of a different driver was used or driving the test cycle differently, differences in ambient air temperature or humidity, incorrect application of the humidity correction, or instrumentation malfunction.

Two observations suggest the mechanism of action of the fuel additive. First, fuel economy improves and second, the effect is immediate. This is typical of a driveability improver additive, such as an octane improver. Thus, the data suggest that the additive is somehow altering the combustion process, perhaps by reducing ping, knock, misfire, or similar effects. However, no observations on driveability differences were reported. This conclusion is supported by independent measurements of octane number. These data suggest an increase of 2 octane number units for 1 ml/gallon of additive (roughly 2–3 ppm). However, insufficient information is available to evaluate the quality of the octane number measurements.

It is unlikely that the additive impacts deposits via detergent or dispersant action, however no inspection or analysis of the fuel system or combustion chamber was conducted to confirm this. It is also unlikely that the fuel additive device or additive impacts the exhaust catalyst. The catalyst is very hot in the Hot 505 runs and the additive is primarily organic. Thus, any additive surviving the combustion process should simply be burned by the catalyst.

Statistical analysis of the results indicates statistically significant differences in emissions and fuel economy, compared to baseline runs, for both the fuel additive device and the liquid fuel additive. For the fuel additive device, a significant decrease in emissions of CO, $CO_2$, and NMHC was observed along with an increase in fuel economy. A reduction in $N_x$ emissions may also be observed. The two vehicles tested have different fuel supply system technologies and exhibit different responses, namely, different changes in emissions or fuel economy. Thus, a universal conclusion regarding the magnitude of emissions reduction and fuel economy increase cannot be made. Similar conclusions can be drawn for the liquid fuel additive although the magnitude of the effects is smaller and the uncertainty in the results is greater. Statistical analysis of the data indicates that all baseline runs come from the same population. This means that there is no "memory" effect and the vehicle returns rapidly to baseline upon removal of the device. It is believed that the additive dosage level in tests using the fuel additive device was in the 100 to 1000 ppm range. The observed effects, immediate response, lack of a "memory" effect, and dosage range all suggest that the additives of preferred embodiments act as a driveability improver with a direct effect on the combustion process. The data subjected to statistical analysis are presented in Table 36.

TABLE 36

| Test No. | Vehicle | Fuel | Odometer miles at start | Barometer in. Hg | Dry T ° F. | Wet T ° F. | Start Time | Distance | HC g/mi | CO g/mi | $CO_2$ g/mi | $NO_x$ g/mi | $CH_4$ g/mi | NMHC g/mi | Fuel Econ. MPG |
|---|---|---|---|---|---|---|---|---|---|---|---|---|---|---|---|
| 2254 | Honda baseline | base | 101158 | 29.76 | 77.86 | 64.78 | 8/27/9 11:19 | 3.57 | 0.086 | 2.17 | 324.2 | 0.693 | 0.045 | 0.042 | 27.09 |
| 2255 | Honda baseline | base | 101167 | 29.71 | 78.62 | 66.56 | 8/27/9 11:47 | 3.58 | 0.067 | 1.127 | 320.2 | 0.698 | 0.041 | 0.026 | 27.56 |

TABLE 36-continued

| Test No. | Vehicle | Fuel | Odometer miles at start | Barometer in. Hg | Dry T ° F. | Wet T ° F. | Start Time | Distance | HC g/mi | CO g/mi | $CO_2$ g/mi | $NO_x$ g/mi | $CH_4$ g/mi | NMHC g/mi | Fuel Econ. MPG |
|---|---|---|---|---|---|---|---|---|---|---|---|---|---|---|---|
| 2256 | Honda baseline | base | 101175 | 29.72 | 77.92 | 66.59 | 8/27/9 12:14 | 3.58 | 0.073 | 1.513 | 319.6 | 0.685 | 0.043 | 0.03 | 27.56 |
| 2265 | Honda w/device | base | 101186 | 29.74 | 77.67 | 66.36 | 8/28/9 12:06 | 3.56 | 0.076 | 1.482 | 323 | 0.637 | 0.043 | 0.033 | 27.28 |
| 2266 | Honda w/device | base | 101195 | 29.72 | 77.34 | 66.38 | 8/28/9 12:36 | 3.57 | 0.072 | 1.39 | 317.8 | 0.653 | 0.043 | 0.029 | 27.74 |
| 2267 | Honda w/device | base | 101204 | 29.72 | 78.43 | 66.99 | 8/28/9 13:11 | 3.57 | 0.073 | 1.646 | 316.2 | 0.655 | 0.044 | 0.029 | 27.84 |
| 2268 | Honda w/device | base | 101213 | 29.71 | 78.96 | 67.48 | 8/28/9 13:30 | 3.58 | 0.06 | 1.003 | 318.1 | 0.66 | 0.04 | 0.02 | 27.76 |
| 2274 | Honda w/device #2 | base | 101229 | 29.74 | 75.74 | 66.01 | 8/29/9 10:49 | 3.57 | 0.068 | 1.43 | 315.6 | 0.637 | 0.04 | 0.028 | 27.92 |
| 2275 | Honda w/device #2 | base | 101238 | 29.73 | 75.43 | 65.02 | 8/29/9 11:17 | 3.58 | 0.067 | 1.253 | 316.3 | 0.594 | 0.04 | 0.027 | 27.88 |
| 2277 | Honda w/device #2 | base | 101247 | 29.74 | 75.05 | 63.96 | 8/29/9 12:03 | 3.57 | 0.072 | 1.399 | 314.2 | 0.652 | 0.041 | 0.031 | 28.05 |
| 2278 | Honda w/device #3 | base | 101264 | 29.73 | 75.08 | 63.64 | 8/29/9 13:24 | 3.57 | 0.07 | 1.459 | 314.6 | 0.601 | 0.039 | 0.03 | 28.01 |
| 2279 | Honda w/device #3 | base | 101273 | 29.69 | 76.18 | 64.28 | 8/29/9 13:54 | 3.57 | 0.067 | 1.357 | 315.6 | 0.597 | 0.04 | 0.027 | 27.93 |
| 2280 | Honda w/device #3 | base | 101282 | 29.68 | 76.63 | 64.66 | 8/29/9 14:22 | 3.57 | 0.064 | 1.249 | 311.9 | 0.612 | 0.039 | 0.025 | 28.28 |
| 2281 | Honda w/device #4 | base | 101297 | 29.68 | 76.72 | 64.44 | 8/29/9 15:45 | 3.57 | 0.063 | 1.272 | 311.1 | 0.605 | 0.04 | 0.022 | 28.35 |
| 2282 | Honda w/device #4 | base | 101306 | 29.67 | 76.85 | 64.52 | 8/29/9 16:12 | 3.57 | 0.063 | 1.26 | 310.3 | 0.613 | 0.04 | 0.023 | 28.42 |
| 2283 | Honda w/device #4 | base | 101315 | 29.65 | 77.08 | 64.58 | 8/29/9 16:40 | 3.57 | 0.063 | 1.413 | 313.2 | 0.588 | 0.04 | 0.023 | 28.14 |
| 2284 | Honda w/device #5 | base | 101330. | 29.75 | 74.45 | 62.35 | 8/30/9 10:14 | 3.58 | 0.072 | 1.26 | 304.8 | 0.611 | 0.042 | 0.031 | 28.92 |
| 2285 | Honda w/device #5 | base | 101339 | 29.73 | 74.83 | 63.99 | 8/30/9 10:40 | 3.58 | 0.063 | 1.026 | 304.7 | 0.599 | 0.04 | 0.024 | 28.97 |
| 2286 | Honda w/device #5 | base | 101348 | 29.72 | 74.81 | 63.82 | 8/30/9 11:08 | 3.58 | 0.066 | 1.159 | 301.1 | 0.584 | 0.041 | 0.025 | 29.3 |
| 2288 | Honda w/device #6 | base | 101357 | 29.72 | 75.63 | 63.91 | 8/30/9 12:03 | 3.58 | 0.064 | 1.343 | 301.8 | 0.55 | 0.038 | 0.026 | 29.2 |
| 2289 | Honda w/device #6 | base | 101372 | 29.68 | 76.11 | 64.25 | 8/30/9 12:27 | 3.58 | 0.063 | 1.174 | 301.3 | 0.598 | 0.04 | 0.024 | 29.28 |
| 2290 | Honda device #6 | base | 101381 | 29.67 | 75.78 | 64.32 | 8/30/9 12:54 | 3.58 | 0.073 | 1.148 | 301.5 | 0.627 | 0.038 | 0.035 | 29.26 |
| 2291 | Honda w/device #7 | base | 101392 | 29.66 | 76.87 | 65.63 | 8/30/9 13:32 | 3.59 | 0.068 | 1.206 | 301.9 | 0.597 | 0.039 | 0.029 | 29.22 |
| 2292 | Honda w/device #7 | base | 101401 | 29.64 | 77.51 | 65.97 | 8/30/9 13:56 | 3.59 | 0.065 | 1.209 | 308.4 | 0.573 | 0.04 | 0.024 | 28.6 |
| 2293 | Honda w/device #7 | base | 101408 | 29.64 | 77.69 | 66.45 | 8/30/9 14:20 | 3.57 | 0.063 | 1.315 | 307.8 | 0.586 | 0.04 | 0.023 | 28.64 |
| 2294 | Honda baseline | base | 101442 | 29.81 | 75.48 | 63.08 | 9/2/97 10:34 | 3.59 | 0.07 | 1.771 | 313.2 | 0.56 | 0.036 | 0.034 | 28.09 |
| 2295 | Honda baseline | base | 101451 | 29.8 | 75.61 | 63.36 | 9/2/98 11:02 | 3.58 | 0.064 | 1.641 | 310.4 | 0.537 | 0.035 | 0.029 | 28.36 |
| 2296 | Honda baseline | base | 101460 | 29.8 | 75.66 | 63.68 | 9/2/97 11:37 | 3.59 | 0.067 | 1.605 | 308.3 | 0.575 | 0.036 | 0.031 | 28.55 |
| 2314 | Honda baseline | base | 101502 | 29.74 | 79.68 | 67.19 | 9/3/97 14:37 | 3.57 | 0.073 | 1.586 | 319.3 | 0.5 | 0.042 | 0.031 | 27.58 |
| 2315 | Honda baseline | base | 101510 | 29.71 | 80.58 | 67.37 | 9/3/97 15:09 | 3.58 | 0.072 | 1.869 | 321.4 | 0.527 | 0.043 | 0.029 | 27.36 |

TABLE 36-continued

| Test No. | Vehicle | Fuel | Odometer miles at start | Barometer in. Hg | Dry T ° F. | Wet T ° F. | Start Time | Distance | HC g/mi | CO g/mi | $CO_2$ g/mi | $NO_x$ g/mi | $CH_4$ g/mi | NMHC g/mi | Fuel Econ. MPG |
|---|---|---|---|---|---|---|---|---|---|---|---|---|---|---|---|
| 2340 | Honda baseline | base | 101772 | 29.76 | 76.38 | 65.23 | 9/6/97 10:10 | 3.58 | 0.078 | 1.805 | 310.4 | 0.465 | 0.043 | 0.036 | 28.32 |
| 2341 | Honda baseline | base | 101780 | 29.76 | 76.11 | 64.98 | 9/6/97 10:42 | 3.58 | 0.084 | 1.855 | 308.6 | 0.502 | 0.045 | 0.038 | 28.48 |
| 2346 | Honda baseline | base | 101860 | 29.59 | 79.06 | 66.02 | 9/8/97 16:16 | 3.58 | 0.083 | 1.862 | 311.4 | 0.603 | 0.046 | 0.037 | 28.23 |
| 2347 | Honda baseline | base | 101869 | 29.57 | 79.26 | 66.19 | 9/8/97 16:41 | 3.59 | 0.075 | 1.882 | 308.2 | 0.502 | 0.045 | 0.03 | 28.52 |
| 2315 | Honda baseline | base | 101510 | 29.71 | 80.58 | 67.37 | 9/3/97 15:09 | 3.58 | 0.072 | 1.869 | 321.4 | 0.527 | 0.043 | 0.029 | 27.36 |
| 2340 | Honda baseline | base | 101772 | 29.76 | 76.38 | 65.23 | 9/6/97 10:10 | 3.58 | 0.078 | 1.805 | 310.4 | 0.465 | 0.043 | 0.036 | 28.32 |
| 2341 | Honda baseline | base | 101780 | 29.76 | 76.11 | 64.98 | 9/6/97 10:42 | 3.58 | 0.084 | 1.855 | 308.6 | 0.502 | 0.045 | 0.038 | 28.48 |
| 2346 | Honda baseline | base | 101860 | 29.59 | 79.06 | 66.02 | 9/8/97 16:16 | 3.58 | 0.083 | 1.862 | 311.4 | 0.603 | 0.046 | 0.037 | 28.23 |
| 2347 | Honda baseline | base | 101869 | 29.57 | 79.26 | 66.19 | 9/8/97 16:41 | 3.59 | 0.075 | 1.882 | 308.2 | 0.502 | 0.045 | 0.03 | 28.52 |
| 2375 | Honda baseline | base | 102081 | 29.71 | 74.47 | 62.77 | 9/17/9 10:46 | 3.58 | 0.079 | 1.812 | 320.2 | 0.579 | 0.043 | 0.036 | 27.47 |
| 2376 | Honda baseline | base | 102089 | 29.7 | 75.21 | 63.2 | 9/17/9 11:12 | 3.58 | 0.079 | 1.998 | 314.8 | 0.526 | 0.044 | 0.035 | 27.91 |
| 2377 | Honda baseline | base | 102098 | 29.68 | 75.69 | 63.67 | 9/17/9 11:40 | 3.59 | 0.066 | 1.234 | 313.27 | 0.619 | 0.042 | 0.024 | 28.15 |
| 2378 | Honda baseline | base | 102107 | 29.69 | 76.02 | 63.59 | 9/17/9 12:05 | 3.58 | 0.085 | 2.483 | 313.1 | 0.559 | 0.046 | 0.039 | 27.99 |
| 2379 | Honda baseline | base | 102119 | 29.67 | 76.72 | 63.93 | 9/17/9 12:31 | 3.58 | 0.074 | 1.894 | 312.0 | 0.628 | 0.044 | 0.03 | 28.17 |
| 2380 | Honda baseline | base | 102128 | 29.65 | 77.02 | 64.67 | 9/17/9 12:56 | 3.58 | 0.074 | 1.858 | 311.47 | 0.626 | 0.044 | 0.03 | 28.24 |
| 2389 | Honda | additive | 102141 | 29.62 | 74.32 | 61.68 | 9/18/9 14:44 | 3.57 | 0.067 | 1.475 | 318.05 | 0.591 | 0.042 | 0.025 | 27.7 |
| 2390 | Honda | additive | 102150 | 29.6 | 75.35 | 62.16 | 9/18/9 15:11 | 3.58 | 0.069 | 1.613 | 312.27 | 0.618 | 0.042 | 0.027 | 28.19 |
| 2391 | Honda | additive | 102159 | 29.59 | 75.66 | 62.33 | 9/18/9 15:37 | 3.57 | 0.074 | 1.774 | 313.7 | 0.617 | 0.043 | 0.03 | 28.04 |
| 2392 | Honda | additive | 102168 | 29.58 | 75.87 | 62.4 | 9/18/9 16:03 | 3.58 | 0.074 | 1.923 | 312.12 | 0.604 | 0.043 | 0.031 | 28.16 |
| 2393 | Honda | additive | 102204 | 29.68 | 78.03 | 64.23 | 9/19/9 10:47 | 3.58 | 0.073 | 1.822 | 311.64 | 0.596 | 0.04 | 0.034 | 28.22 |
| 2394 | Honda | additive | 102213 | 29.68 | 74.42 | 62.49 | 9/19/9 11:13 | 3.58 | 0.074 | 1.743 | 311.53 | 0.57 | 0.041 | 0.033 | 28.24 |
| 2395 | Honda | additive | 102222 | 29.67 | 74.22 | 62.24 | 9/19/9 11:39 | 3.58 | 0.071 | 1.601 | 310.82 | 0.587 | 0.04 | 0.03 | 28.32 |
| 2396 | Honda | additive | 102231 | 29.67 | 73.98 | 62.18 | 9/19/9 13:32 | 3.57 | 0.071 | 1.483 | 314.80 | 0.544 | 0.04 | 0.031 | 27.98 |
| 2397 | Honda | additive | 102233 | 29.65 | 74.76 | 62.51 | 9/19/9 14:00 | 3.58 | 0.067 | 1.456 | 308.84 | 0.566 | 0.039 | 0.028 | 28.52 |
| 2398 | Honda | additive | 102250 | 29.64 | 75.1 | 62.74 | 9/19/9 14:32 | 3.58 | 0.07 | 1.514 | 310.41 | 0.582 | 0.041 | 0.029 | 28.37 |
| 2298 | Ford | baseline | 63973 | 29.78 | 76.72 | 65.55 | 9/2/97 12:42 | 3.57 | 0.085 | 1.413 | 383.57 | 0.322 | 0.025 | 0.059 | 23 |
| 2299 | Ford | baseline | 63982 | 29.77 | 77.34 | 65.83 | 9/2/97 13:22 | 3.58 | 0.087 | 1.471 | 383.56 | 0.336 | 0.027 | 0.06 | 23 |
| 2300 | Ford | baseline | 63991 | 29.76 | 77.89 | 66.25 | 9/2/97 14:03 | 3.57 | 0.086 | 1.222 | 383.71 | 0.298 | 0.025 | 0.061 | 23.01 |
| 2306 | Ford w/device | baseline | 64035 | 29.7 | 80.35 | 67.28 | 9/2/97 17:03 | 3.58 | 0.079 | 1.099 | 371.34 | 0.255 | 0.025 | 0.054 | 23.79 |
| 2307 | Ford w/device | baseline | 64044 | 29.71 | 79.8 | 66.68 | 9/2/97 17:35 | 3.57 | 0.087 | 1.352 | 370.60 | 0.274 | 0.027 | 0.06 | 23.81 |
| 2308 | Ford w/device | 6baseline | 4053 | 29.71 | 79.6 | 66.34 | 9/2/97 18:06 | 3.57 | 0.084 | 1.379 | 373.06 | 0.268 | 0.027 | 0.056 | 23.65 |
| 2312 | Ford w/device | baseline | 64123 | 29.77 | 78.84 | 66.99 | 9/3/97 12:47 | 3.57 | 0.079 | 1.242 | 350.59 | 0.185 | 0.027 | 0.052 | 25.17 |
| 2313 | Ford w/device | baseline | 64132 | 29.75 | 79.75 | 67.64 | 9/3/97 13:20 | 3.56 | 0.078 | 0.933 | 352.60 | 0.173 | 0.025 | 0.053 | 25.06 |
| 2321 | Ford baseline | baseline | 64394 | 29.72 | 76.36 | 64.27 | 9/4/97 12:16 | 3.58 | 0.098 | 1.496 | 380.79 | 0.296 | 0.029 | 0.069 | 23.16 |
| 2322 | Ford baseline | baseline | 64403 | 29.69 | 76.97 | 65.15 | 9/4/97 12:49 | 3.58 | 0.103 | 1.564 | 377.87 | 0.304 | 0.03 | 0.073 | 23.33 |
| 2324 | Ford baseline | baseline | 64411 | 29.68 | 77.43 | 65.72 | 9/4/97 13:25 | 3.58 | 0.093 | 1.344 | 378.96 | 0.35 | 0.029 | 0.064 | 23.29 |
| 2333 | Ford | additive | 64446 | 29.61 | 79.04 | 66.64 | 9/4/97 19:02 | 3.56 | 0.081 | 0.993 | 374.56 | 0.217 | 0.025 | 0.056 | 23.59 |

TABLE 36-continued

| Test No. | Vehicle | Fuel | Odometer miles at start | Barometer in. Hg | Dry T ° F. | Wet T ° F. | Start Time | Distance | HC g/mi | CO g/mi | $CO_2$ g/mi | $NO_x$ g/mi | $CH_4$ g/mi | NMHC g/mi | Fuel Econ. MPG |
|---|---|---|---|---|---|---|---|---|---|---|---|---|---|---|---|
| 2334 | Ford | additive | 64454 | 29.62 | 78.81 | 66.32 | 9/4/97 19:35 | 3.57 | 0.091 | 1.225 | 374.91 | 0.205 | 0.028 | 0.063 | 23.55 |
| 2336 | Ford | additive | 64463 | 29.64 | 78.24 | 65.74 | 9/4/97 20:15 | 3.57 | 0.089 | 1.228 | 371.91 | 0.206 | 0.028 | 0.061 | 23.74 |
| 2337 | Ford | additive | 64472 | 29.65 | 78.35 | 65.9 | 9/4/97 20:44 | 3.58 | 0.09 | 1.243 | 372.60 | 0.194 | 0.027 | 0.062 | 23.69 |
| 2338 | Ford | additive | 64481 | 29.66 | 78.01 | 65.63 | 9/4/97 21:15 | 3.58 | 0.09 | 1.266 | 373.08 | 0.219 | 0.029 | 0.061 | 23.66 |

Statistical Analysis—When the sample size is small, namely, less than 20, the standard deviation does not provide a reliable estimate of the standard deviation of the population. The bias introduced by the sample size can be removed by correcting the standard deviation by the statistic known as the Students t. As the sample size increases, the Students t distribution approaches the normal distribution. An important application of the Students t distribution is to use it as the basis for a test to determine if the difference between two means is significant or due to random variation. The Students t for two data sets is calculated from the ratio of the difference in means to the difference in standard deviations. Where this Students t value falls on the Students t distribution for that number of samples gives the confidence probability percent (P-value) that these two samples are the same.

Statistical analysis of the results indicated statistically significant differences in emissions and fuel economy, compared to baseline runs, for both the additive device and liquid fuel additive. For the fuel line additive device, a significant decrease in emissions of CO and NMHC is observed along with an increase in fuel economy. A substantial $NO_x$ reduction was also observed for the Ford. Fuel economy was observed to increase with the decrease in $NO_x$.

The two vehicles tested had different fuel supply system technologies and exhibited different responses (changes in emission or fuel economy). However, the minimum changes in emissions and fuel economy observe were as follows: −10.5% in CO; —7.7% in NMHC; −1% in $C_2$; and +1% in fuel economy.

Similar conclusions were drawn for the liquid fuel additive, although the magnitude of the effects was smaller and the uncertainty in the results was greater. Statistical analysis of the data indicated that all baseline runs come from the same population. This means that there is no "memory" effect and that the vehicle returns rapidly to baseline upon removal of the device.

Vehicle Testing of an OR-2 Additized Diesel Fuel

A 115 foot tug boat equipped with a General Motors Electro Motor Division 645-12, 2000 horsepower, 900 rpm two-cycle engine was operated for approximately 1300 hours on an OR-2 diesel fuel as described above. At full load, the engine consumed 106 gallons of fuel per hour. During the 1300 hours of operation on the OR-2 diesel fuel, the fuel consumption averaged 92 gallons of fuel per hour, corresponding to an improvement in fuel economy of 13.2% or 14 gallons per hour.

Figure 20:
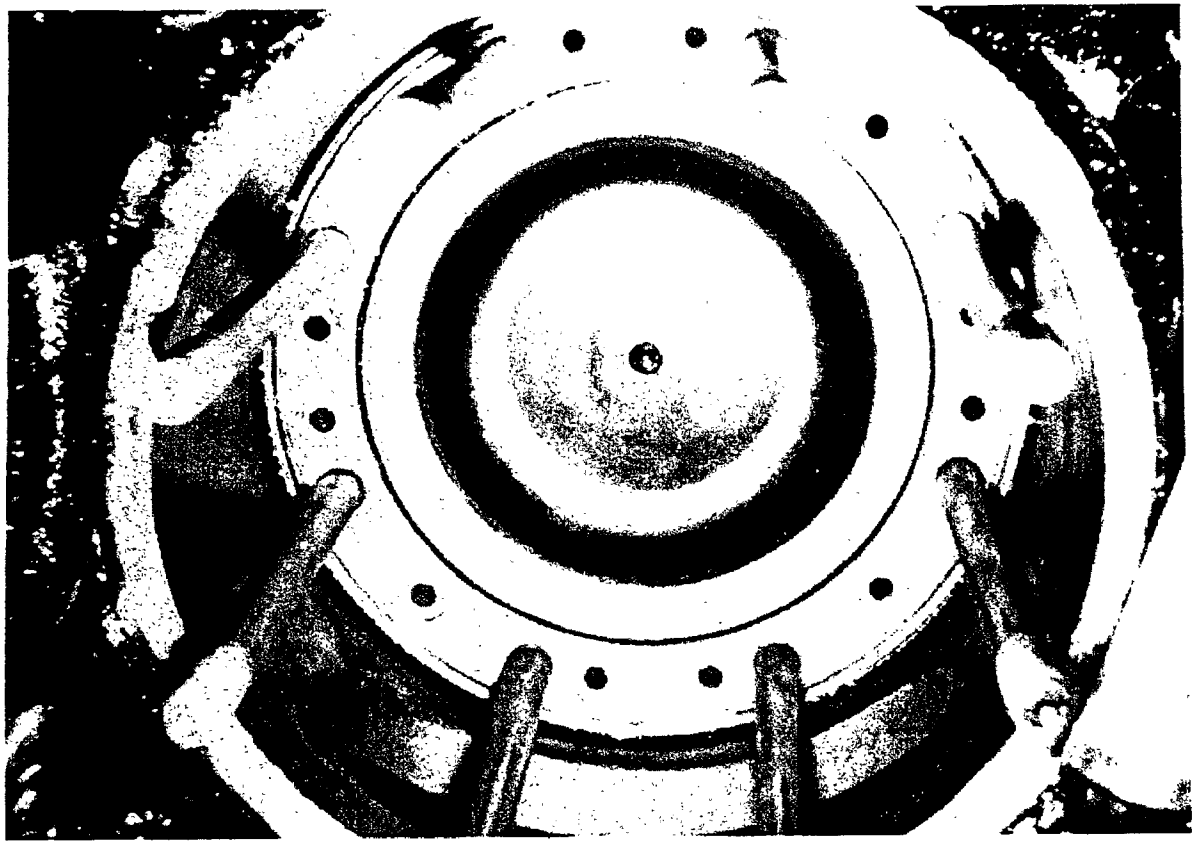
FIG. 20 is a photograph of a piston top of a General Motors Electro Motor Division 645-12, 2000 horsepower, 900 rpm two-cycle engine after 1300 hours of operation on OR-2 diesel fuel.
Figure 21:
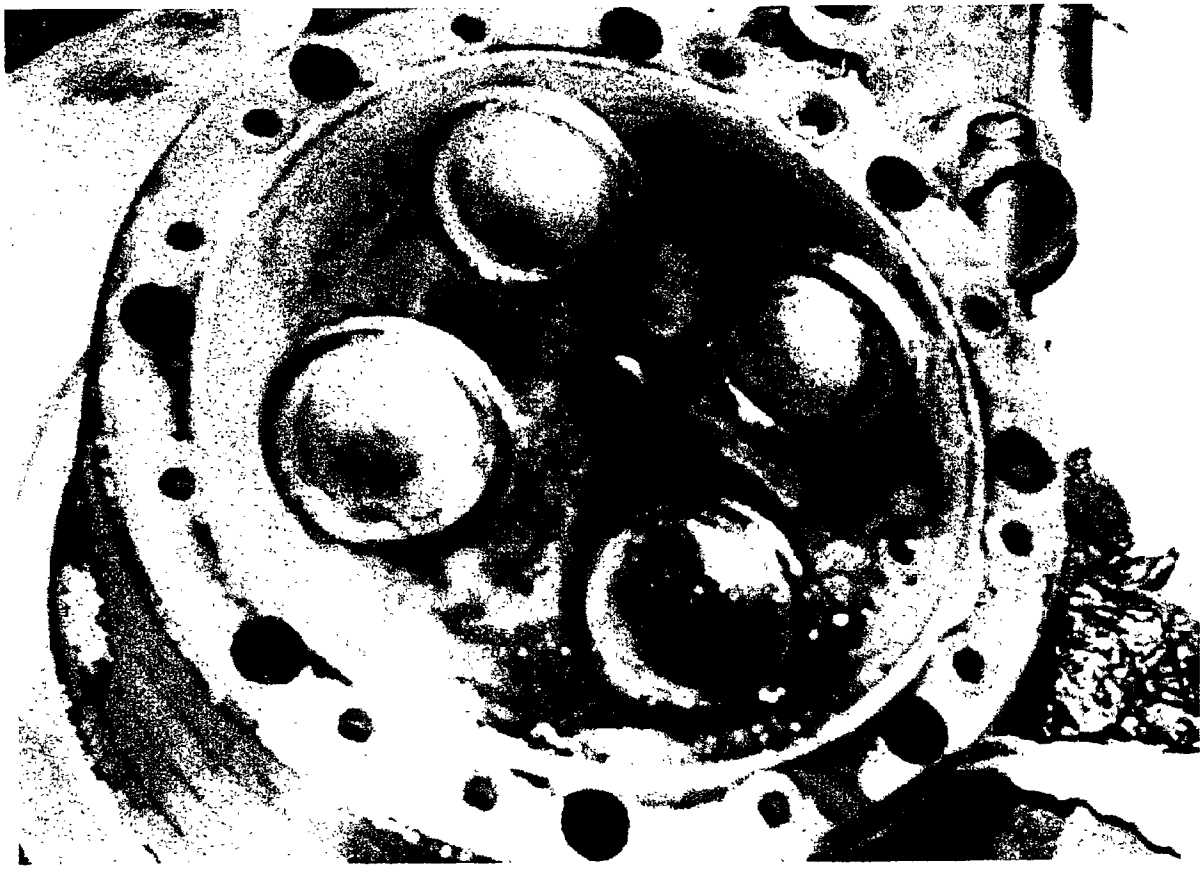
FIG. 21 is a photograph of the head General Motors Electro Motor Division 645-12, 2000 horsepower, 900 rpm two-cycle engine 1300 hours of operation on OR-2 diesel fuel.

After testing, the head from the #8 cylinder was removed for inspection. A visual inspection confirmed that the piston crown was free of ash and carbon deposits, as. were the head, injector tip, and valves (FIGS. 20 and 21). The liner sides were well lubricated and showed no signs of wear. Port inspection revealed the ring to be well lubricated with no deposits and no sign of fouling or sticking.

Figure 22:
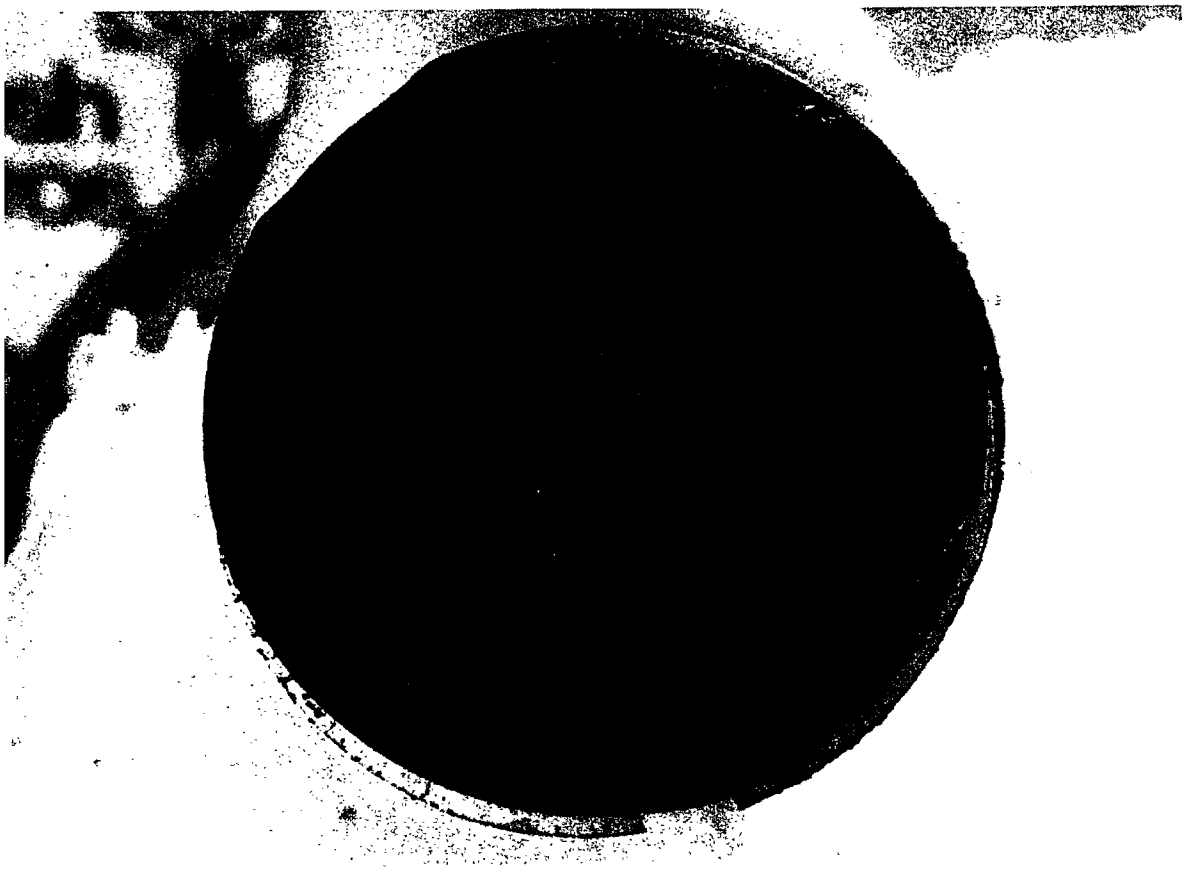
FIG. 22 is a photograph of the #2 piston top of a Caterpillar 930 loader before operation on OR-2 additized diesel fuel.
Figure 23:
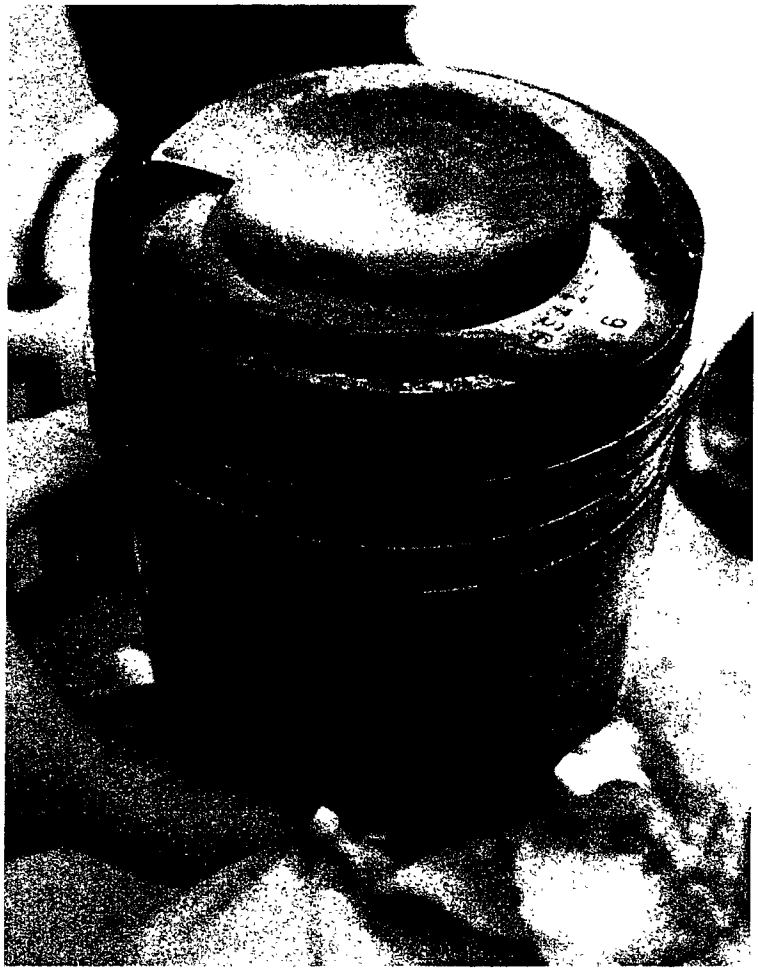
FIG. 23 is a photograph of the #2 piston top of a Caterpillar 930 loader after 7385 hours of operation on OR-2 additized diesel fuel.

A diesel fuel treated with OR-2 as described above was also tested in a Caterpillar 930 loader. FIG. 22 is a photograph of the #2 piston top before operation on the additized fuel. FIG. 23 is a photograph of the #2 piston top after 7385 hours of operation on the additized fuel. The OR-2 additive provided substantial protection against deposit formation, as is demonstrated by the light deposits and areas of bare metal visible on the piston head.

Emissions Testing of a Phase 3 Compliant California Reformulated Gasoline

Additive OR-1 was blended into a base gasoline as described above to yield a candidate gasoline meeting the CARB Phase 3 specifications as reported in Table 37. The candidate gasoline had a 90% by volume distillation point of 317° F. (158.3° C.), 20 ppm sulfur, 1.8±0.2 wt. % oxygen, and 0.80 vol. % benzene. While the ASTM D86 distillation test is commonly used to measure the distillation points of gasolines, it is preferred to measure the distillation points according to the ASTM-3710 standard test method for boiling range distribution of petroleum fractions by gas chromatography. See 1988 *Annual Book of ASTM Standards,* 5:78–88. The ASTM-3710 test has been observed to yield more accurate and reproducible distillation point data than the D86 test.

TABLE 37

Reference and Candidate CaRFG3 Gasolines

| | REFERENCE | | | CANDIDATE | | |
|---|---|---|---|---|---|---|
| PROPERTY | SPEC | VALUE | TARGET | SPEC | VALUE | TARGET |
| Research Octane | Min | 93 | 92–94 | — | — | — |
| Sensitivity | Min | 7.5 | 7.5–9 | — | — | — |

TABLE 37-continued

Reference and Candidate CaRFG3 Gasolines

| | REFERENCE | | | CANDIDATE | | |
|---|---|---|---|---|---|---|
| PROPERTY | SPEC | VALUE | TARGET | SPEC | VALUE | TARGET |
| Lead (organic) | max, g/gal | 0.050 | <0.050 | — | — | — |
| Distillation 10% | ° F. | 130–140 | 138 | — | — | — |
| Distillation 50% | ° F. | 210–213 | 215 | ° F., Max | 220 | 223 |
| Distillation 90% | ° F. | 300–305 | 306 | ° F., Max | 317 | 320 |
| Sulfur | Max, ppm | 20 | 20 | Max, ppm | 20 | 20 |
| Phosphorus | Max, g/gal | 0.005 | <0.005 | — | — | — |
| RVP | psi | 6.9–7.0 | 5.8 | psi | 7.00 | 5.8 |
| Olefins | Max, vol. % | 4 | 5 | Max, vol. % | 10 | 11 |
| Olefins (C3–C5) | Max, vol. % | 1 | <1 | Max, vol. % | 1 | <1 |
| Aromatics | Max, vol. % | 25 | 26 | Max, vol. % | 34 | 35 |
| Oxygen | wt % | 1.8–2.2 | 0 | wt % | 1.8 +/− 0.2 | 0 |
| Benzene | Max, vol. % | 0.80 | 0.80 | Max, vol. % | 0.80 | 1.00 |

The above description discloses several methods and materials of the present invention. This invention is susceptible to modifications in the methods and materials, such as the choice of base fuel, the components selected for the base formulation, as well as alterations in the formulation of fuels and additive mixtures. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. All references cited herein are hereby incorporated by reference in their entireties.

What is claimed is:

1. A hydrocarbon fuel comprising a base fuel and a non-oxygenated cetane improver additive selected from the group consisting of a precursor of carotene, a precursor of carotenoid, a derivative of carotene, a derivative of carotenoid and mixtures thereof.

2. The fuel of claim 1 wherein the base fuel is a diesel fuel.

3. The fuel of claim 1 further comprising a supplemental cetane improver, a diluent, or mixtures thereof.

4. The fuel of claim 3 wherein the supplemental cetane improver comprises an alkyl nitrate.

5. The fuel of claim 4 wherein the alkyl nitrate is 2-ethylhexyl nitrate.

6. The fuel of claim 3 wherein the diluent is toluene.

7. The fuel of claim 1 wherein the additive is a percursor of β-carotene.

8. The fuel of claim 2, wherein the diesel fuel comprises from about 0.0001 g to about 0.03 g non-oxygenated cetane improver per 3785 ml of the diesel fuel.

9. The fuel of claim 2, wherein the diesel fuel comprises from about 0.00025 g to about 0.025 g non-oxygenated cetane improver per 3785 ml of the diesel fuel.

10. The fuel of claim 2, wherein the diesel fuel comprises from about 0.0005 g to about 0.02 g non-oxygenated cetane improver per 3785 ml of the diesel fuel.

11. The fuel of claim 2, wherein the diesel fuel comprises from about 0.001 g to about 0.015 g non-oxygenated cetane improver per 3785 ml of the diesel fuel.

12. The fuel of claim 2, wherein the diesel fuel comprises from about 0.002 g to about 0.01 g non-oxygenated cetane improver per 3785 ml of the diesel fuel.

13. The fuel of claim 4, wherein the diesel fuel comprises from about from about 0.025 g to about 10 g alkyl nitrate per 3785 ml of the diesel fuel.

14. The fuel of claim 4, wherein the diesel fuel comprises from about 0.075 g to about 7.5 g alkyl nitrate per 3785 ml of the diesel fuel.

15. The fuel of claim 4, wherein the diesel fuel comprises from about 0.1 g to about 5 g alkyl nitrate per 3785 ml of the diesel fuel.

16. The fuel of claim 4, wherein the diesel fuel comprises from about 1 g to about 4.0 g alkyl nitrate per 3785 ml of the diesel fuel.

17. The fuel of claim 2, wherein the base fuel comprises No. 2 diesel fuel.

18. A method of increasing a cetane number of a fuel, the method comprising dissolving a non-oxygenated additive in a diluent under an inert atmosphere to yield a cetane improver, the additive being selected from the group consisting of a precursor of carotene, a precursor of a carotenoid, a derivative of carotene, a derivative of carotenoid and mixtures thereof; and adding the cetane improver to a base fuel to yield an additized fuel, such that the additized fuel has a cetane number higher than the cetane number of the base fuel.

19. The method of claim 18, wherein the base fuel comprises diesel fuel.

20. The method of claim 18, wherein the base fuel comprises No. 2 diesel fuel.

21. The method of claim 18, wherein the diluent comprises toluene.

22. The method of claim 18, wherein the inert atmosphere comprises argon, helium, nitrogen or mixtures thereof.

23. The method of claim 18, further comprising the step of:

mixing a supplemental cetane improving component with the cetane improver.

24. The method of claim 23, wherein the supplemental cetane improving component is an alkyl nitrate.

25. The method of claim 24, wherein the alkyl nitrate comprises 2-ethylhexyl nitrate.

26. A hydrocarbon fuel comprising a base fuel and a non-oxygenated cetane improver additive, the additive selected from the group consisting of α-carotene or carotenoids derived from algae xea xabthin, crypotoxanthin, lycopene, lutein, precursors of α-carotene or carotenoids derived from algae xea xabthin, crypotoxanthin, lycopene, lutein; derivative of α-carotene or carotenoids derived from algae xea xabthin, crypotoxanthin, lycopene, lutein and mixtures thereof.

27. The fuel of claim 26 wherein the base fuel is a diesel fuel.

28. The fuel of claim 26 further comprising a supplemental cetane improver, a diluent, or mixtures thereof.

29. The fuel of claim 28 wherein the supplemental cetane improver comprises an alkyl nitrate.

30. The fuel of claim 29 wherein the alkyl nitrate is 2-ethylhexyl nitrate.

31. The fuel of claim 28 wherein the diluent is toluene.

32. The fuel of claim 26 wherein the additive is a percursor of β-carotene.

33. The fuel of claim 27, wherein the diesel fuel comprises from about 0.0001 g to about 0.03 g non-oxygenated cetane improver per 3785 ml of the diesel fuel.

34. The fuel of claim 27, wherein the diesel fuel comprises from about 0.00025 g to about 0.025 g non-oxygenated cetane improver per 3785 ml of the diesel fuel.

35. The fuel of claim 27, wherein the diesel fuel comprises from about 0.0005 g to about 0.02 g non-oxygenated cetane improver per 3785 ml of the diesel fuel.

36. The fuel of claim 27, wherein the diesel fuel comprises from about 0.001 g to about 0.015 g non-oxygenated cetane improver per 3785 ml of the diesel fuel.

37. The fuel of claim 27, wherein the diesel fuel comprises from about 0.002 g to about 0.01 g non-oxygenated cetane improver per 3785 ml of the diesel fuel.

38. The fuel of claim 37, wherein the diesel fuel comprises from about from about 0.025 g to about 10 g alkyl nitrate per 3785 ml of the diesel fuel.

39. The fuel of claim 37, wherein the diesel fuel comprises from about 0.075 g to about 7.5 g alkyl nitrate per 3785 ml of the diesel fuel.

40. The fuel of claim 37, wherein the diesel fuel comprises from about 0.1 g to about 5 g alkyl nitrate per 3785 ml of the diesel fuel.

41. The fuel of claim 37, wherein the diesel fuel comprises from about 1 g to about 4.0 g alkyl nitrate per 3785 ml of the diesel fuel.

42. The diesel fuel of claim 27, wherein the base fuel comprises No. 2 diesel fuel.

43. A hydrocarbon fuel comprising a base fuel and a non-oxygenated cetane improver additive the additive selected from the group consisting of a carotenoid derived from broccoli concentrate, spinach concentrate, tomato concentrate, kale concentrate, cabbage concentrate, and brussel sprout extract and mixtures thereof.

44. The fuel of claim 43 wherein the base fuel is a diesel fuel.

45. The fuel of claim 43 further comprising a supplemental cetane improver, a diluent, or mixtures thereof.

46. The fuel of claim 45 wherein the supplemental cetane improver comprises an alkyl nitrate.

47. The fuel of claim 46 wherein the alkyl nitrate is 2-ethylhexyl nitrate.

48. The fuel of claim 45 wherein the diluent is toluene.

49. The fuel of claim 44, wherein the diesel fuel comprises from about 0.0001 g to about 0.03 g non-oxygenated cetane improver per 3785 ml of the diesel fuel.

50. The fuel of claim 44, wherein the diesel fuel comprises from about 0.00025 g to about 0.025 g non-oxygenated cetane improver per 3785 ml of the diesel fuel.

51. The fuel of claim 44, wherein the diesel fuel comprises from about 0.0005 g to about 0.02 g non-oxygenated cetane improver per 3785 ml of the diesel fuel.

52. The fuel of claim 44, wherein the diesel fuel comprises from about 0.001 g to about 0.015 g non-oxygenated cetane improver per 3785 ml of the diesel fuel.

53. The fuel of claim 44, wherein the diesel fuel comprises from about 0.002 g to about 0.01 g non-oxygenated cetane improver per 3785 ml of the diesel fuel.

54. The fuel of claim 46, wherein the diesel fuel comprises from about from about 0.025 g to about 10 g alkyl nitrate per 3785 ml of the diesel fuel.

55. The fuel of claim 46, wherein the diesel fuel comprises from about 0.075 g to about 7.5 g alkyl nitrate per 3785 ml of the diesel fuel.

56. The fuel of claim 46, wherein the diesel fuel comprises from about 0.1 g to about 5 g alkyl nitrate per 3785 ml of the diesel fuel.

57. The fuel of claim 46, wherein the diesel fuel comprises from about 1 g to about 4.0 g alkyl nitrate per 3785 ml of the diesel fuel.

58. The fuel of claim 44, wherein the base fuel comprises No. 2 diesel fuel.

* * * * *